US012435393B2

(12) United States Patent
Jankowski et al.

(10) Patent No.: US 12,435,393 B2
(45) Date of Patent: Oct. 7, 2025

(54) NICKEL-BASE ALLOYS

(71) Applicant: ATI Properties LLC, Albany, OR (US)

(72) Inventors: Joseph A. Jankowski, Matthews, NC (US); Zachary Schlittenhart, Pittsburgh, PA (US); Matthew Bender, Allison Park, PA (US); Andrew Temple, Indian Trail, NC (US)

(73) Assignee: ATI PROPERTIES LLC, Albany, OR (US)

( * ) Notice: Subject to any disclaimer, the term of this patent is extended or adjusted under 35 U.S.C. 154(b) by 0 days.

(21) Appl. No.: 18/618,395

(22) Filed: Mar. 27, 2024

(65) Prior Publication Data

US 2025/0236930 A1 Jul. 24, 2025

Related U.S. Application Data

(60) Provisional application No. 63/494,572, filed on Apr. 6, 2023.

(51) Int. Cl.
*C22C 19/05* (2006.01)
*C22F 1/10* (2006.01)

(52) U.S. Cl.
CPC ..... *C22C 19/057* (2013.01); *C22F 1/10* (2013.01)

(58) Field of Classification Search
CPC ..... C22C 19/057; C22F 1/10
See application file for complete search history.

(56) References Cited

U.S. PATENT DOCUMENTS

| | | | | |
|---|---|---|---|---|
| 2,747,993 | A | 5/1956 | Johnson | |
| 2,945,758 | A | 7/1960 | Jahnke et al. | |
| 3,222,165 | A | 12/1965 | Bird et al. | |
| 3,248,213 | A | 4/1966 | Smith et al. | |
| 3,356,542 | A | 12/1967 | Smith | |
| 3,385,698 | A | 5/1968 | MacFarlane et al. | |
| 3,576,622 | A * | 4/1971 | McCoy | C22C 19/057 420/451 |
| 4,589,937 | A | 5/1986 | Jackson et al. | |
| 4,765,956 | A | 8/1988 | Smith et al. | |
| 4,769,087 | A | 9/1988 | Genereux et al. | |
| 4,818,486 | A | 4/1989 | Rothman et al. | |
| 5,476,555 | A | 12/1995 | Erickson | |
| 5,882,586 | A | 3/1999 | Tamura et al. | |
| 6,177,046 | B1 * | 1/2001 | Simkovich | C22C 19/056 148/427 |
| 6,458,318 | B1 | 10/2002 | Nishiyama et al. | |
| 6,478,897 | B1 | 11/2002 | Izumida et al. | |
| 6,491,769 | B1 | 12/2002 | Smith et al. | |
| 8,066,938 | B2 | 11/2011 | Pike, Jr. | |
| 8,545,643 | B2 | 10/2013 | Pike et al. | |
| 9,738,953 | B2 | 8/2017 | Osaki et al. | |
| 9,828,657 | B2 | 11/2017 | Abe et al. | |
| 9,932,655 | B2 | 4/2018 | Hamaguchi et al. | |
| 10,280,498 | B2 | 5/2019 | Heck et al. | |
| 10,358,699 | B2 | 7/2019 | Srivastava et al. | |
| 11,186,898 | B2 | 11/2021 | Meck et al. | |
| 2003/0034098 | A1 | 2/2003 | Henry et al. | |
| 2010/0008778 | A1 | 1/2010 | Patrick et al. | |
| 2011/0274579 | A1 | 11/2011 | Arjakine | |
| 2014/0314618 | A1 | 10/2014 | Feng et al. | |
| 2018/0223395 | A1 | 8/2018 | Mourer et al. | |
| 2019/0048451 | A1 | 2/2019 | Ota et al. | |
| 2020/0131614 | A1 | 4/2020 | Ota et al. | |
| 2023/0025204 | A1 | 1/2023 | Jankowski | |
| 2024/0117472 | A1 | 4/2024 | Sharghi-Moshtaghin et al. | |

FOREIGN PATENT DOCUMENTS

| | | | | |
|---|---|---|---|---|
| CN | 105112728 | B | 3/2017 | |
| CN | 112779440 | A | 5/2021 | |
| CN | 112981186 | A | 6/2021 | |
| DE | 69605259 | T2 | 7/2000 | |
| EP | 1842934 | B1 | 10/2011 | |
| GB | 810089 | A * | 3/1959 | C22C 19/057 |
| GB | 1029609 | A | 5/1966 | |
| JP | 1-129942 | A | 5/1989 | |
| JP | 6-172900 | A | 6/1994 | |
| JP | 5127749 | B2 | 1/2013 | |
| WO | 2006059805 | A1 | 6/2006 | |
| WO | 2019021015 | A1 | 1/2019 | |
| WO | 2019/125637 | A2 | 6/2019 | |
| WO | 2020203460 | A1 | 10/2020 | |

OTHER PUBLICATIONS

Haynes® 242@ alloy, Principal Features, Excellent High-Temperature Strength, Low Thermal Expansion Characteristics, and Good Oxidation Resistance, H-3079G, 2017 Haynes International, 18 pages.

Haynes® 242@ Alloy, H-3230a, 2020 Haynes International, 17 pages.

Lu et al., Low temperature physical properties of a Ni—Mo—Cr alloy Haynes® 242™, Journal of Applied Physics 101, Jun. 25, 2007, pp. 123710-1-123710-6.

Fahrmann et al., Development of a New 760° C (1400° F) Capable Low Thermal Expansion Alloy, Superalloys 2012: 12th International Symposium on Superalloys, eds. Huron et al., The Minerals, Metals & Materials Society, 2012, pp. 769-777.

Verma et al., Lattice parameter variation and its effect on precipitation behaviour of ordered Ni2(Cr,Mo) phase in Ni—Cr—Mo alloys. Journal of Alloys and Compounds, Elsevier B.V., Jan. 15, 2020, vol. 813, 11 pages.

Tanner, L.E., The Ordering Transformation in Ni2V, Acta Metallurgiva, vol. 20, Oct. 1972, pp. 1197-1227.

(Continued)

*Primary Examiner* — Jessee R Roe

(74) *Attorney, Agent, or Firm* — K&L Gates LLP

(57) ABSTRACT

Nickel-base alloys are provided. One embodiment of a nickel-base alloy comprises, in weight percent based on total weight of the nickel-base alloy: 8% to 24% molybdenum; 0 to 12% tungsten; 3.5% to 10% chromium; 2% to 10% vanadium; 0 to 10% iron; and nickel.

23 Claims, 31 Drawing Sheets

(56) References Cited

OTHER PUBLICATIONS

Hu et al., First principles investigation on the stability and elastic properties of Ni2Cr1-xMx (M=Nb, Mo, Ta, and W) superlattices, Intermetallics vol. 33, 2013, pp. 60-66.
Srivastava et al., A New Low-Thermal-Expansion, High-Strength Alloy for Gas Turbines, Gas Turbine and Aeroengine Congress and Exposition, Jun. 4-8, 1989, 8 pages.
Srivastava, S. K., A Low-Thermal Expansion, High Strength Ni—Mo—Cr Alloy, Superalloys, The Minerals, Metals & Materials Society, 1992, pp. 227-236.
Mann et al., Ab-initio investigation of planar defects in Immm-Ni2(Cr, Mo, W) strengthened Haynes 244 alloy, Purdue University, 2021, 30 pages.
He et al., Mechanical properties of an aged Ni—Cr—Mo alloy and effect of long-range order phase on deformation behavior, Materials Science & Engineering, A, 731, 2018, pp. 29-35.
Lu et al., Strengthening domains in a Ni-21Cr-17Mo alloy, Scripta Materialia, ScienceDirect, 56, 2007, pp. 121-124.
Miller et al., Microstructural characterization of Haynes® 242™ alloy, Materials Science & Engineering A 327, 2002, pp. 89-93.
Cowen et al., Elevated Temperature Mechanical Behavior of New Low CTE Superalloys, Superalloys, The Minerals, Metals & Materials Society, 2008, pp. 201-207.
Special Metals, Incoloy®, alloy 909 (UNS N19909), SMC-077, Sep. 2004, 8 pages.
Special Metals, Incoloy®, alloy 903 (UNS N19903), SMC-100, Sep. 2004, 4 pages.
Special Metals, INCOLOY®, alloy 783 (UNS R30783), SMC-064, Dec. 2004, 8 pages.
Haynes® 242® alloy, Principal Features, Excellent High-Temperature Strength, Low Thermal Expansion Characteristics, and Good Oxidation Resistance, H-3079H, 2020 Haynes International, 20 pages.
UNS N19909, Nickel and Nickel Alloys, Metals & Alloys in the Unified Numbering System, 13th Edition, Sae HS-1086, ASTM DS56L, SAE International ASTM International, 2017, p. 253.
Haynes® 282® alloy brochure, Principal Features, 2019 Haynes International, 25 pages, https://www.haynesintl.com/docs/default-source/pdfs/new-alloy-brochures/high-temperature-alloys/brochures/282-brochure.pdf?sfvrsn=20.
Inconel® Alloy 740H @ brochure, PCC EnergyGroup, May 13, 2015, 24 pages, https://www.specialmetals.com/documents/technical-bulletins/inconel/inconel-alloy-740h.pdf.
VDM® Alloy C-264, Material Data Sheet No. 4120, Jul. 2020, VDM Metals International GmbH, 9 pages,https://www.vdm-metals.com/fileadmin/user_upload/Downloads/Data_Sheets/Data_Sheet_C_264_EN.pdf.
Haynes® 263 alloy brochure, 2020 Haynes International, Jun. 12, 2020, 10 pages, http://haynesintl.com/docs/default-source/pdfs/new-alloy-brochures/high-temperature-alloys/263-brochure.pdf?sfvrsn=10.
Haynes® R-41 alloy brochure, 2019 Haynes International, Jun. 16, 2020, 9 pages, http://haynesintl.com/docs/default-source/pdfs/new-alloy-brochures/high-temperature-alloys/r-41-brochure.pdf?sfvrsn=4.
"Haynes® Waspaloy alloy brochure, 2020 Haynes International, Jun. 16, 2020, 7 pages, https://www.haynesintl.com/docs/default-source/pdfs/new-alloy-brochures/high-temperature-alloys/brochures/waspaloy.pdf?sfvrsn=10."
Vamsi et al., "Effect of off-stoichiometry and ternary additions on planar fault energies in Ni3Al," Superalloys 2012, 12th International Symposium on Superalloys, The Minerals, Metals & Materials Society, 2012, pp. 521-530.
Crudden et al., "Modelling of the influence of alloy composition on flow stress in high-strength nickel-based superalloys," Acta Materialia 75, 2014, pp. 356-370.
Alman et al., "Low coefficient of thermal expansion (CTE) nickel base superalloys for interconnect applications in intermediate temperature solid oxide fuel cells (SOFC)," Superalloys 2004, The Minerals, Metals & Materials Society, pp. 617-622.
Roth et al., "Modeling solid solution strengthening in nickel alloys," Metallurgical and Materials Transactions A, vol. 28A, Jun. 1997, pp. 1329-1335.
Li et al., "Influence of the initial cooling rate from γ' supersolvus temperatures on microstructure and phase compositions in a nickel superalloy," Journal of Alloys and Compounds, 732, 2018, pp. 765-776.
Karunaratne et al., "Interdiffusion in the face-centred cubic phase of the Ni—Re, Ni—Ta, and Ni—W systems between 900 and 1300 °C," Materials Science and Engineering A281, 2000, pp. 229-233.
Maurer et al., "Role of Cobalt in Waspaloy," Superalloys, 1980, pp. 43-52.
Mishima et al., "Lattice Parameters of Ni(γ), Ni3Al(γ') and Ni3Ga (γ') solid solutions with additions of transition and B-subgroup elements," Acta Metallurgica, vol. 33, No. 6, 1985, pp. 1161-1169.
Pataky et al., "Creep Deformation and mechanisms in Haynes 230 at 800° C and 900° C," Journal of Nuclear Materials, 443, 2013, pp. 484-490.
Barrows et al., "A Modified System for predicting σ Formation," Metallurgical Transaction, 3, 1972, pp. 2889-2893.
Siefert et al., "Weldability and weld performance of candidate nickel based superalloys for advanced ultrasupercritical fossil power plants, Part II: weldability and cross-weld creep performance," Science and Technology of Welding and Joining, 2016, pp. 1-31.
Waspaloy (UNS N07001), Metals & Alloys in the Unified Numbering System, 13th Edition, SAE HS-1086/2017 ASTM DS56L, 2017, p. 244.
Stellar ABD®-900AM, Powder for Additive Manufacturing, Aubert & Duval, Oct. 20, 2023, www.aubertduval.com, 4 pages.
ABD® 900AM, Nickel based superalloy for additive manufacturing, OXMET Technologies, Nov. 2019, 2 pages.
Tang et al., Alloys-by-design: Application to new superalloys for additive manufacturing, Acta Materialia 202 (2021) pp. 417-436.
Murray et al., Preparation and Characterization of Pure Metals, ASM Handbook, vol. 2, Properties and Selection: Nonferrous Alloys and Special-Purpose Materials, ASM Handbook Committee, 1990, pp. 1093-1097.

* cited by examiner

NICKEL-BASE ALLOYS

CROSS REFERENCE TO RELATED APPLICATIONS

The present application claims priority to U.S. Provisional Patent Application No. 63/494,572, filed Apr. 6, 2023, the contents of which are hereby incorporated herein by reference.

FIELD

The present disclosure relates to nickel-base alloys.

BACKGROUND

Superalloys are typically based on nickel, iron, or cobalt. Superalloys are used in aerospace, aeronautic, defense, marine, energy, and automotive applications including, for example, gas turbines, hypersonic devices, and space launch vehicles. These applications can be very demanding, requiring that the superalloys exhibit particularly advantageous combinations of strength, weldability, formability, microstructural stability, and a low coefficient of thermal expansion (CTE) at temperatures up to and in excess of 1400° F. (760° C.).

In certain superalloy applications it can be particularly critical to provide a low CTE from cryogenic temperatures and/or room temperature (e.g., 70° F., 21° C.) up to temperatures at or exceeding 1400° F. (760° C.). In the past, two methods have been used to reduce the CTE of superalloys at high temperatures. A first method exploits magnetic effects at low temperatures to reduce CTE over the operating temperature range. This first method has been applied in, for example, UNS R30783 alloy, UNS N19903 alloy, and UNS N19909 alloy. A second method to reduce high temperature CTE includes engineering the alloy to include the conventional $Ni_2X$ phase (e.g., $Ni_2$(Cr, Mo, W) phase). This second method has been applied in certain Ni—Mo—Cr and Ni—Mo—Cr—W alloys such as, for example, UNS N10242 alloy and HAYNES® 244® alloy. The conventional $Ni_2X$ phase in UNS 10242 and HAYNES® 244® can be expressed as the simplified versions $Ni_2$(Cr, Mo) and $Ni_2$(Cr, Mo, W), respectively, based on the alloying elements. Developing a superalloy that exhibits a desirable combination of strength, weldability, formability, and microstructural stability, while also exhibiting an acceptably low CTE at temperatures up to and including 1400° F. (760° C.), presents challenges.

SUMMARY

The present disclosure is directed to nickel-base alloys that exhibit suitable strength and other mechanical properties along with an acceptably low CTE at temperatures up to and including 1400° F. (760° C.). One non-limiting aspect according to the present disclosure is directed to a nickel-base alloy comprising, in weight percent based on total weight of the nickel-base alloy: 8% to 24% molybdenum; 0 to 12% tungsten; 3.5% to 10% chromium; 2% to 10% vanadium; 0 to 10% iron; and nickel.

Another non-limiting aspect according to the present disclosure is directed to a nickel-base alloy, comprising, in weight percent based on total weight of the nickel-base alloy: 14.5% to 17.5% molybdenum; 8% to 10% tungsten; 6% to 8% chromium; 3.5% to 5.5% vanadium; 0 to 0.3% to niobium: 0 to 3% iron; and nickel. Certain embodiments of the nickel-base alloy exhibit a mean coefficient of linear thermal expansion from 70° F. (21° C.) to 1400° F. (760° C.) that is no greater than 8.5 μin/in-° F.

Yet another non-limiting aspect according to the present disclosure is directed to an article of manufacture comprising a nickel-base alloy according to the present disclosure. For example, one non-limiting aspect according to the present disclosure is directed to an article of manufacture including a nickel-base alloy comprising: 8% to 24% molybdenum; 0 to 12% tungsten; 3.5% to 10% chromium; 2% to 10% vanadium; 0 to 10% iron; and nickel. In certain embodiments, the nickel-base alloy exhibits a mean coefficient of linear thermal expansion from 70° F. (21° C.) to 1400° F. (760° C.) that is no greater than 8.5 μin/in-° F.

A further non-limiting aspect according to the present disclosure is directed to a nickel-base alloy, comprising, in weight percent based on total weight of the nickel-base alloy: 13.5% to 16.5% molybdenum; 5% to 8% tungsten; 7% to 9% chromium; 3% to 5.5% vanadium; 0% to 2% to niobium; 0 to 1.5% iron; and nickel. Certain embodiments of the nickel-base alloy exhibit a mean coefficient of linear thermal expansion from 70° F. (21° C.) to 1400° F. (760° C.) that is no greater than 8.5 μin/in-° F.

It is understood that the inventions disclosed and described in this specification are not limited to the aspects summarized in this Summary. The reader will appreciate the foregoing details, as well as others, upon considering the following detailed description of various non-limiting and non-exhaustive aspects according to this specification.

BRIEF DESCRIPTION OF THE FIGURES

The features and advantages of the examples presented herein, and the manner of attaining them, will become more apparent, and the examples will be better understood, by reference to the following description taken in conjunction with the accompanying figures, wherein.

Figure 1:
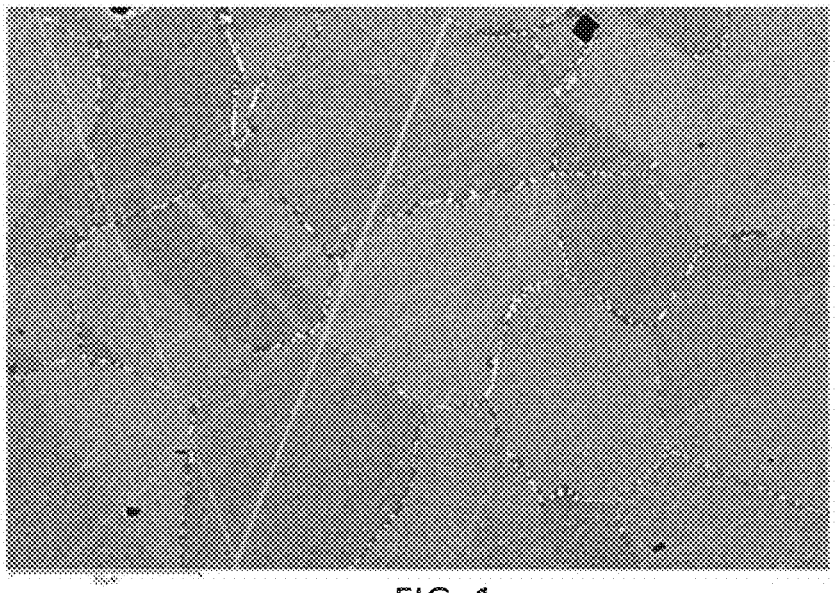
FIG. 1 is a backscattered electron (BSE) image of conventional example X-B after being heat treated for 64 hours at 1400° F. (760° C.)
Figure 2:
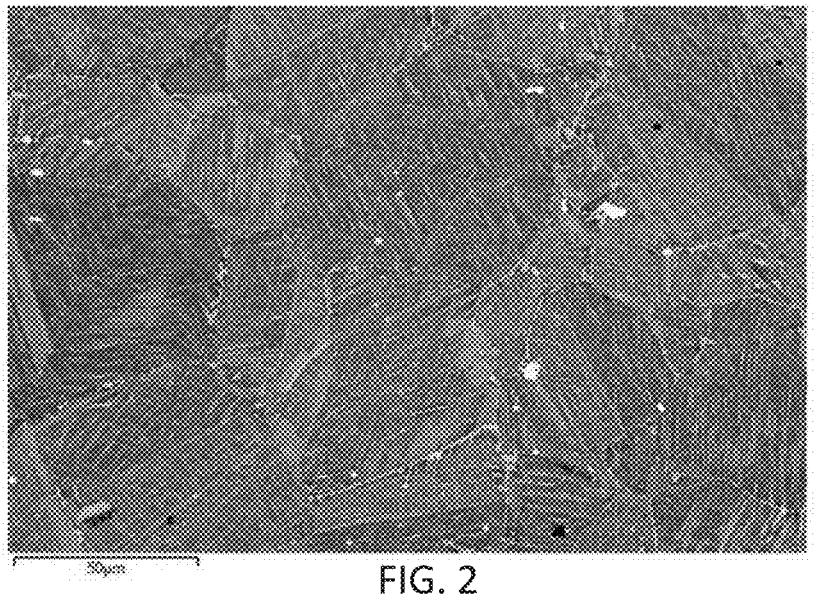
FIG. 2 is a BSE image of conventional example X-B after being heat treated for 1024 hours at 1400° F. (760° C.)
Figure 3:
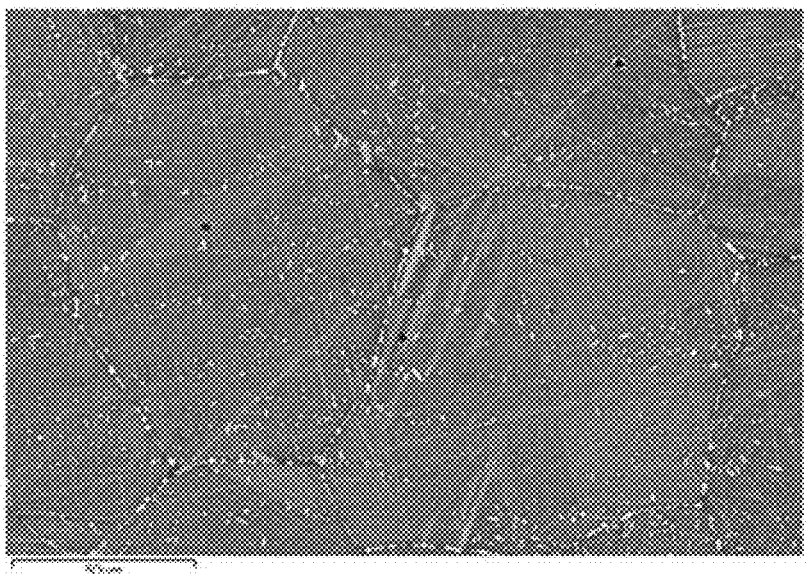
FIG. 3 is a BSE image of example AA after being heat treated for 1024 hours at 1400° F. (760° C.)
Figure 4:
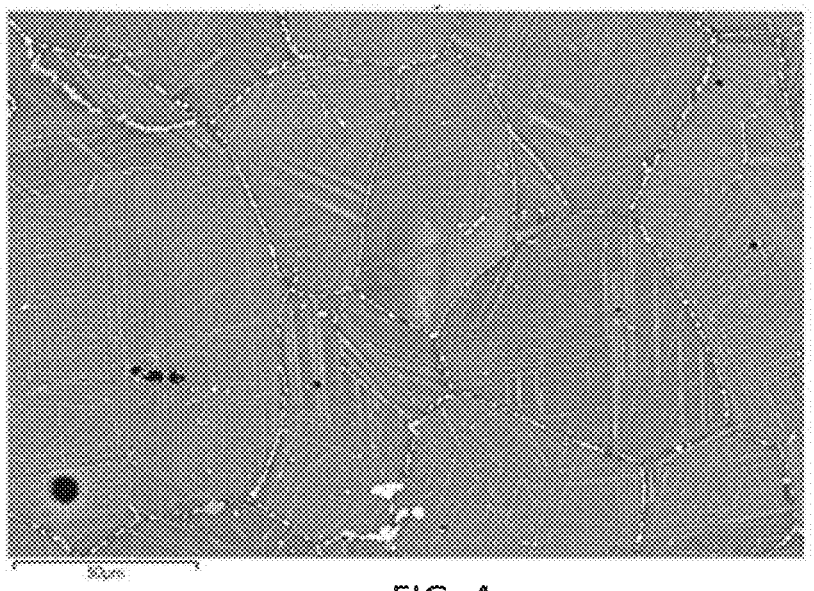
FIG. 4 is a BSE image of example AB after being heat treated for 1024 hours at 1400° F. (760° C.)
Figure 5:
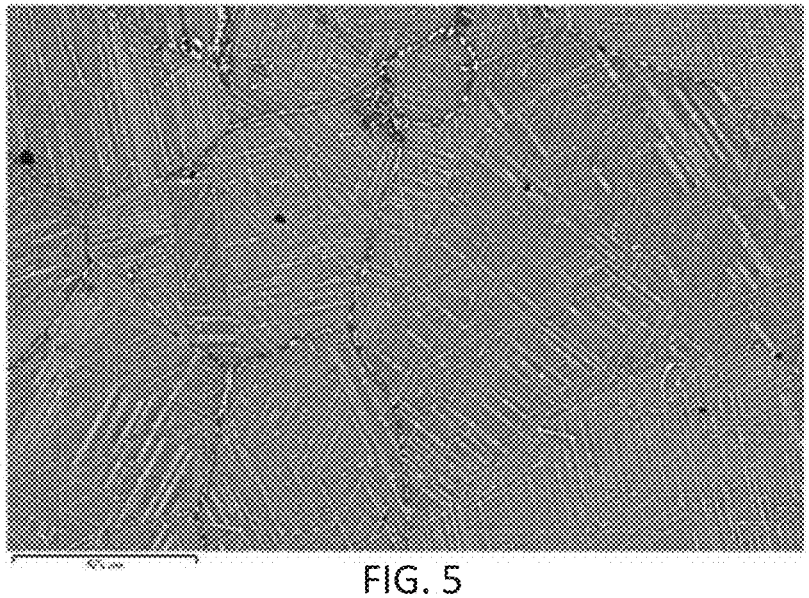
FIG. 5 is a BSE image of example AC after being heat treated for 1024 hours at 1400° F. (760° C.)
Figure 6:
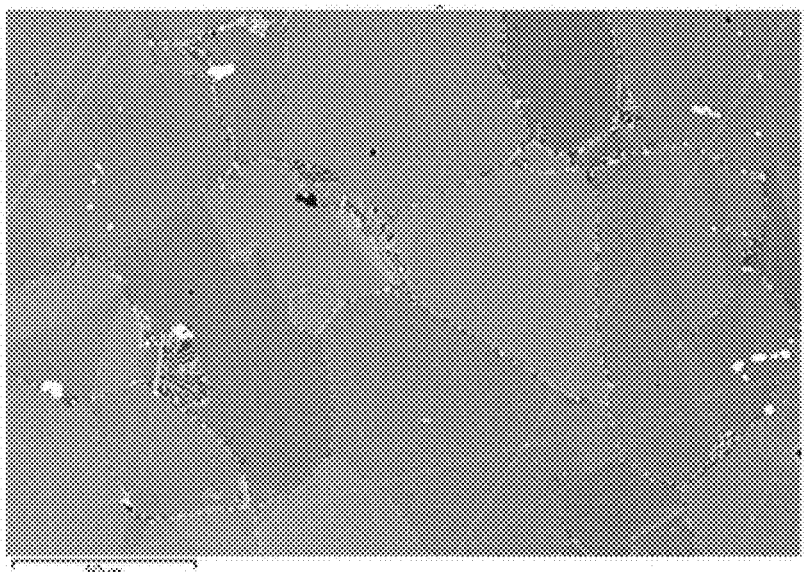
FIG. 6 is a BSE image of example AD after being heat treated for 64 hours at 1400° F. (760° C.)
Figure 7:
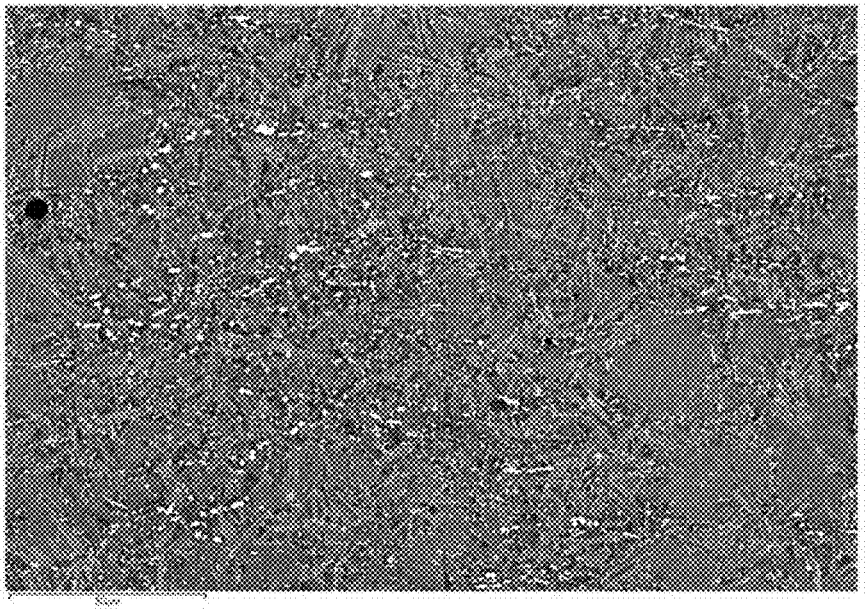
FIG. 7 is a BSE image of example AE after being heat treated for 64 hours at 1400° F. (760° C.)
Figure 8:
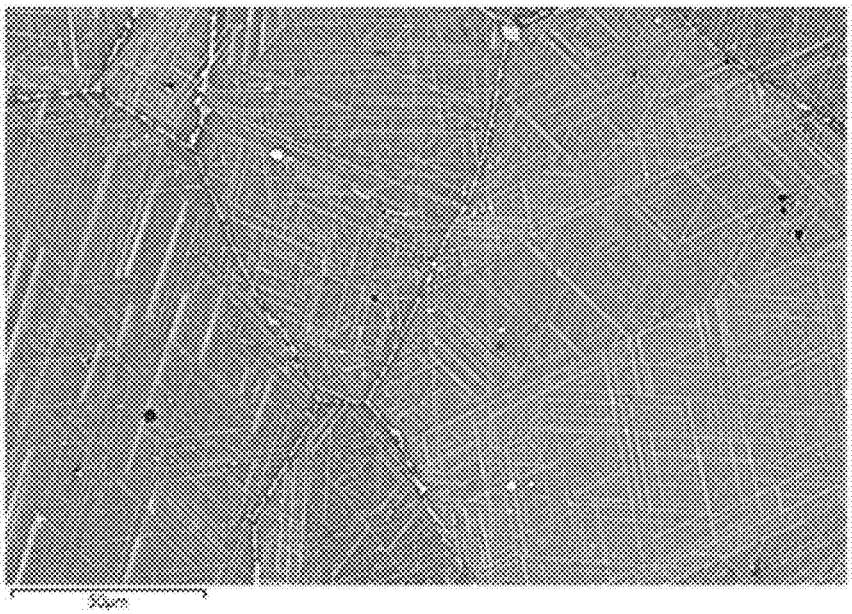
FIG. 8 is a BSE image of example AF after being heat treated for 1024 hours at 1400° F. (760° C.)
Figure 9:
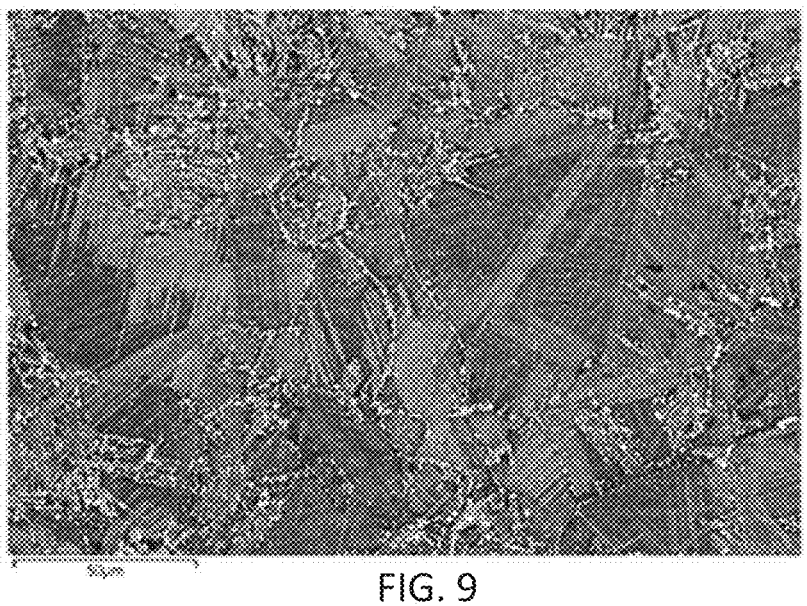
FIG. 9 is a BSE image of example AG after being heat treated for 1024 hours at 1400° F. (760° C.)
Figure 10:
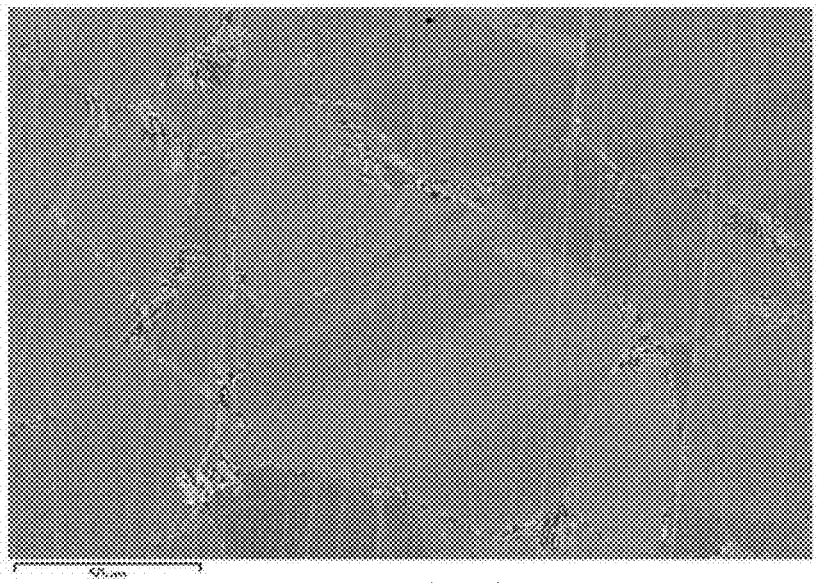
FIG. 10 is a BSE image of example AI after a two-step heat treatment including 48 hours at 1400° F. (760° C.) followed by 72 hours at 1200° F. (649° C.)
Figure 11:
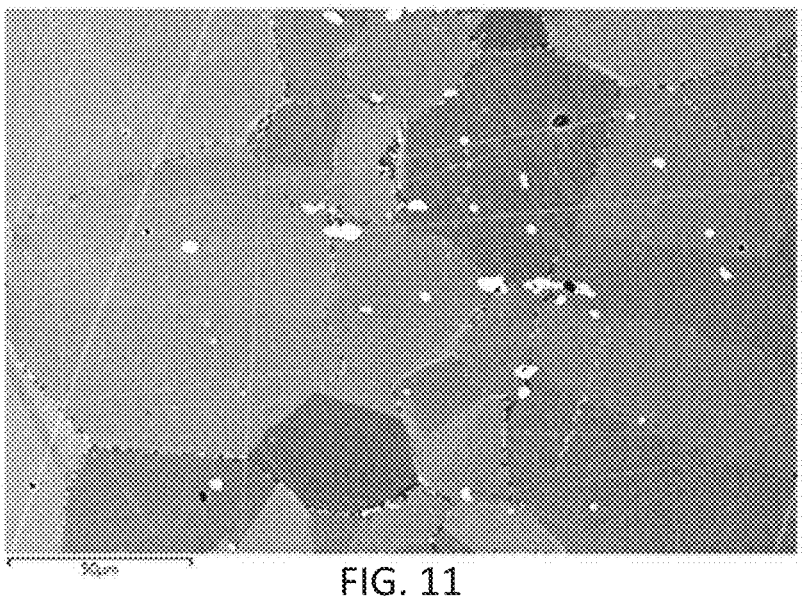
FIG. 11 is a BSE image of example AI after being heat treated for 64 hours at 1400° F. (760° C.)
Figure 12:
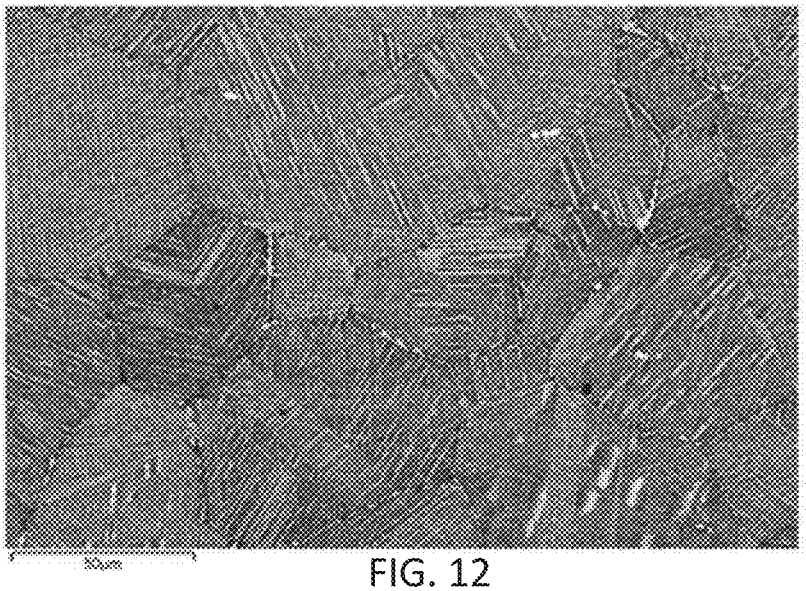
FIG. 12 is a BSE image of example AI after being heat treated for 1024 hours at 1400° F. (760° C.)
Figure 13:
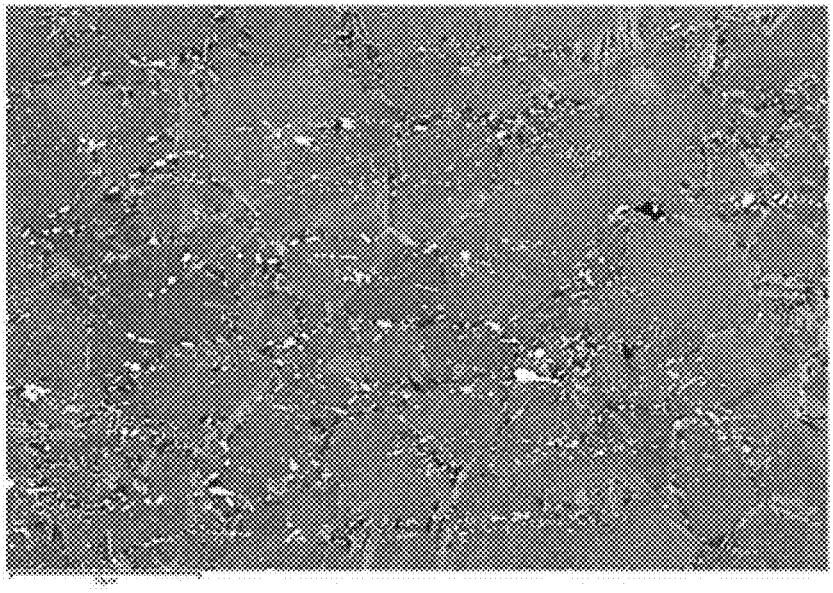
FIG. 13 is a BSE image of example AJ after being heat treated for 64 hours at 1400° F. (760° C.)
Figure 14:
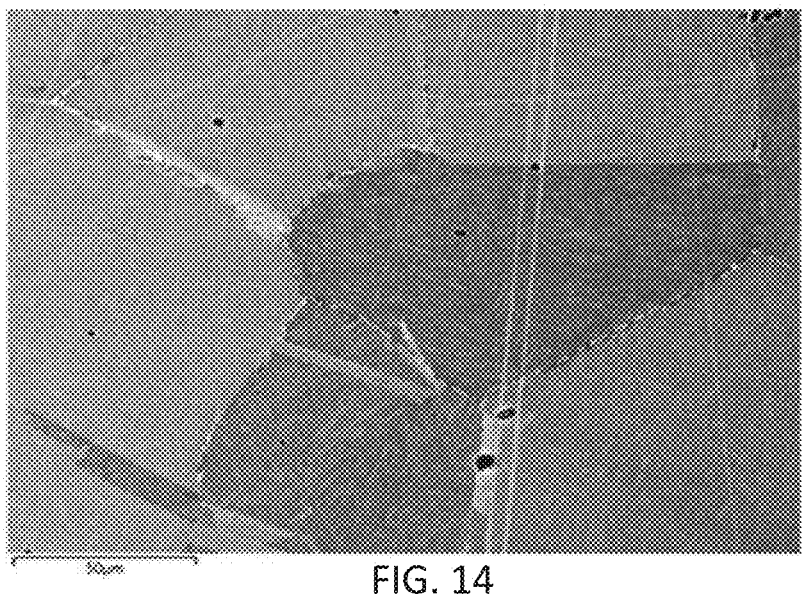
FIG. 14 is a BSE image of example AK after being heat treated for 64 hours at 1400° F. (760° C.)
Figure 15:
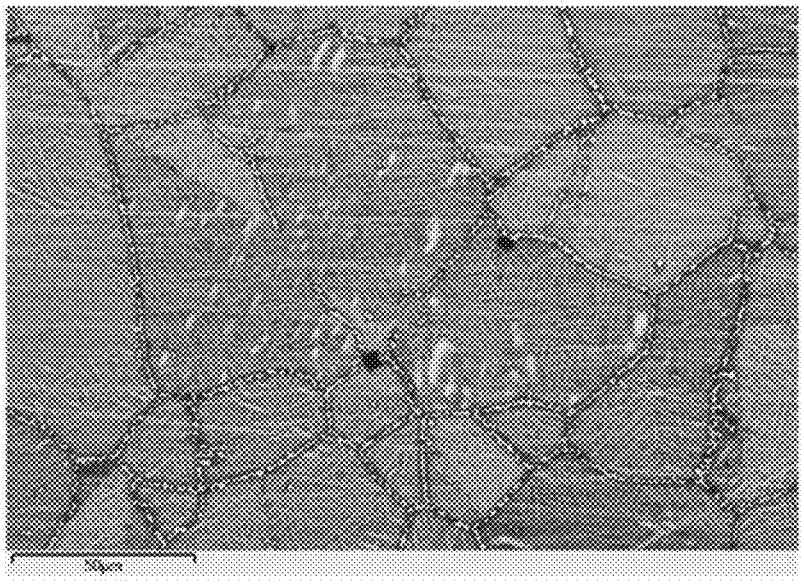
FIG. 15 is a BSE image of example AK after being heat treated for 1024 hours at 1400° F. (760° C.)
Figure 16:
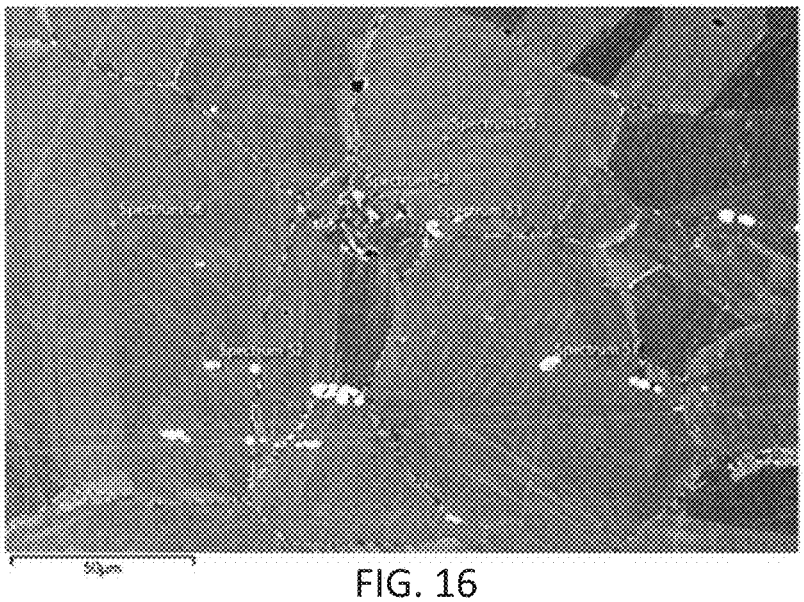
FIG. 16 is a BSE image of example AL chemistry after being heat treated for 64 hours at 1400° F. (760° C.)
Figure 17:
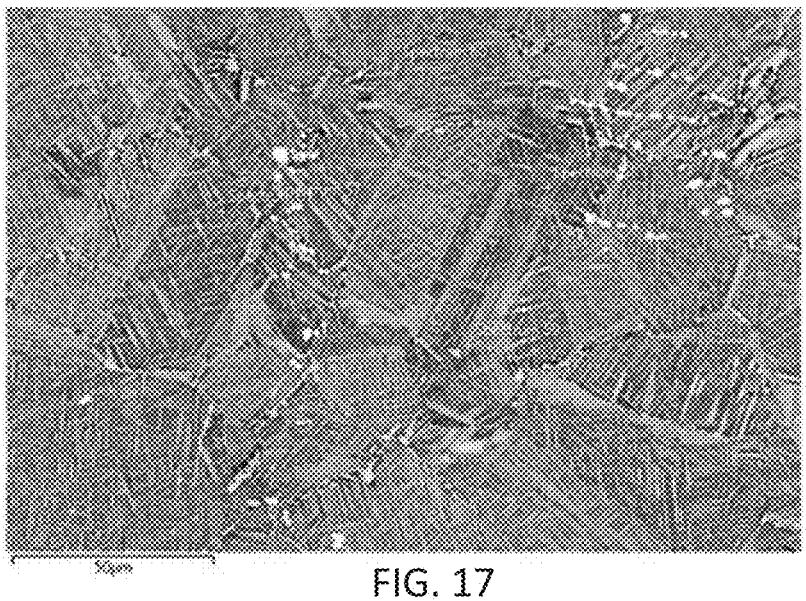
FIG. 17 is a BSE image of example AL after being heat treated for 1024 hours at 1400° F. (760° C.)
Figure 18:
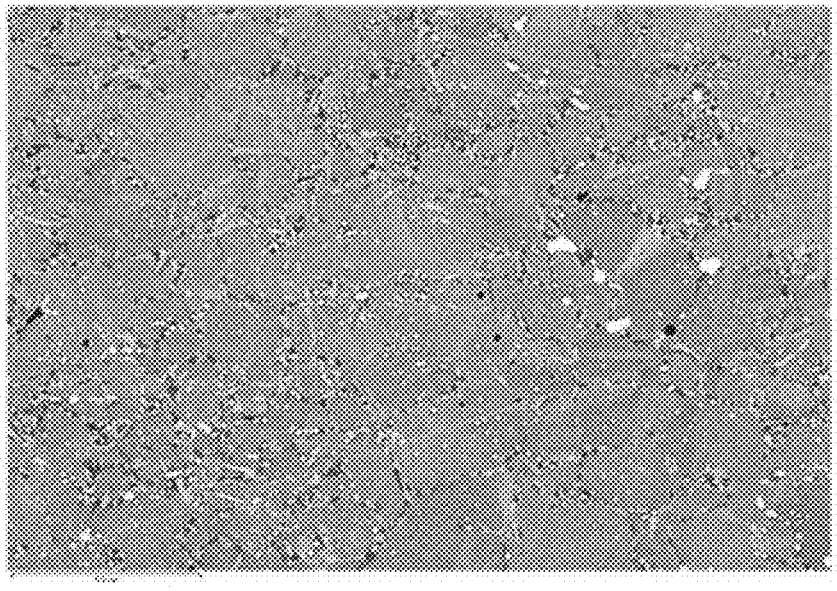
FIG. 18 is a BSE image of example AM after being heat treated for 64 hours at 1400° F. (760° C.)
Figure 19:
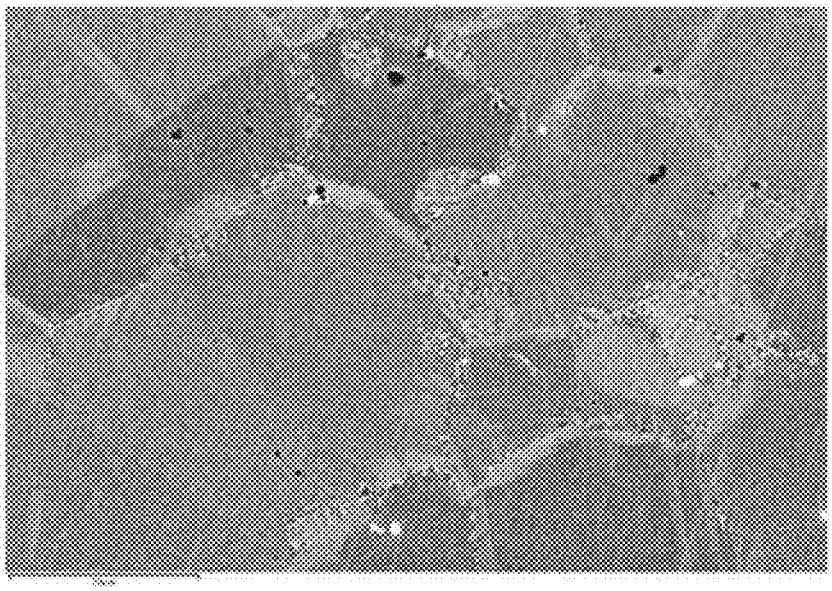
FIG. 19 is a BSE image of example AN after being heat treated for 64 hours at 1400° F. (760° C.)
Figure 20:
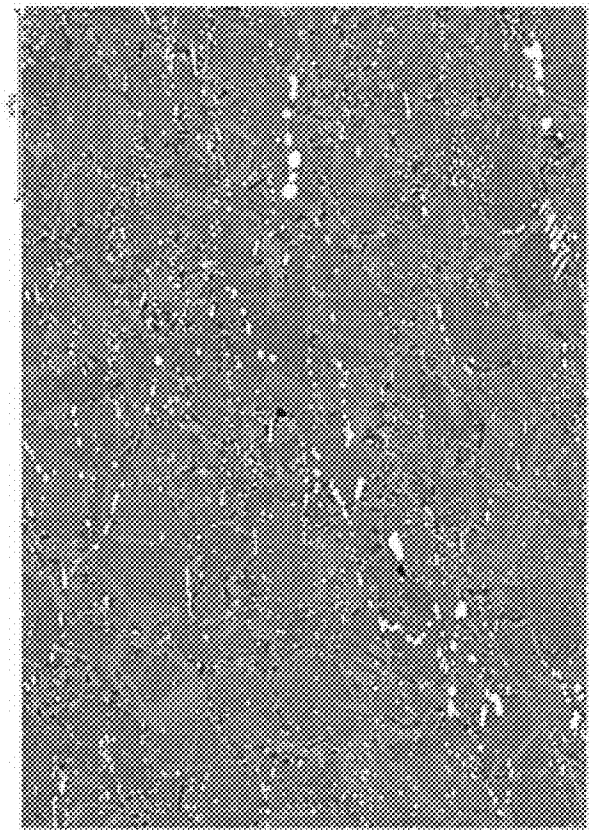
FIG. 20 is a BSE image of example AO after being heat treated for 64 hours at 1400° F. (760° C.)
Figure 21:
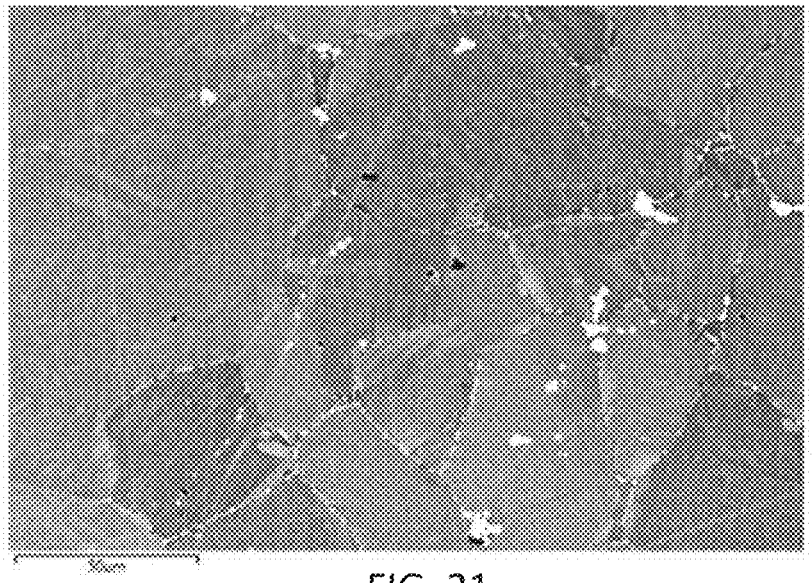
FIG. 21 is a BSE image of example AP after being heat treated for 64 hours at 1400° F. (760° C.)
Figure 22:
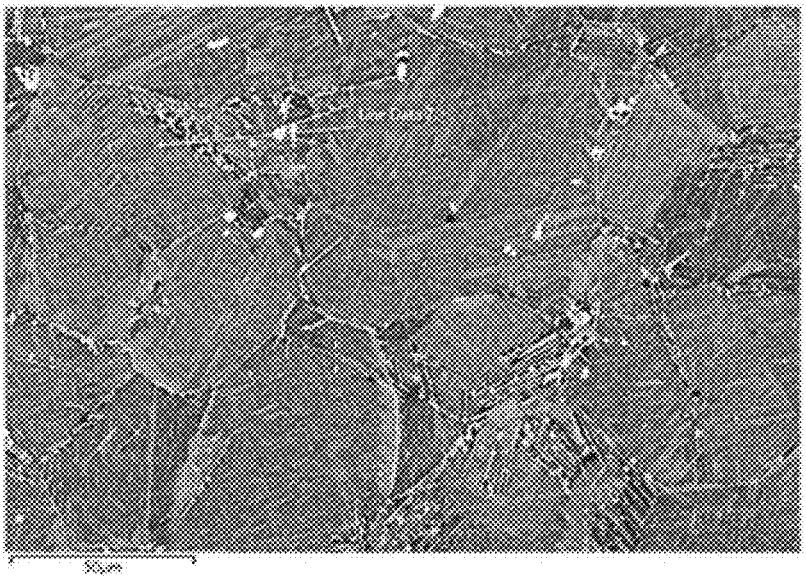
FIG. 22 is a BSE image of example AP after being heat treated for 1024 hours at 1400° F. (760° C.)
Figure 23:
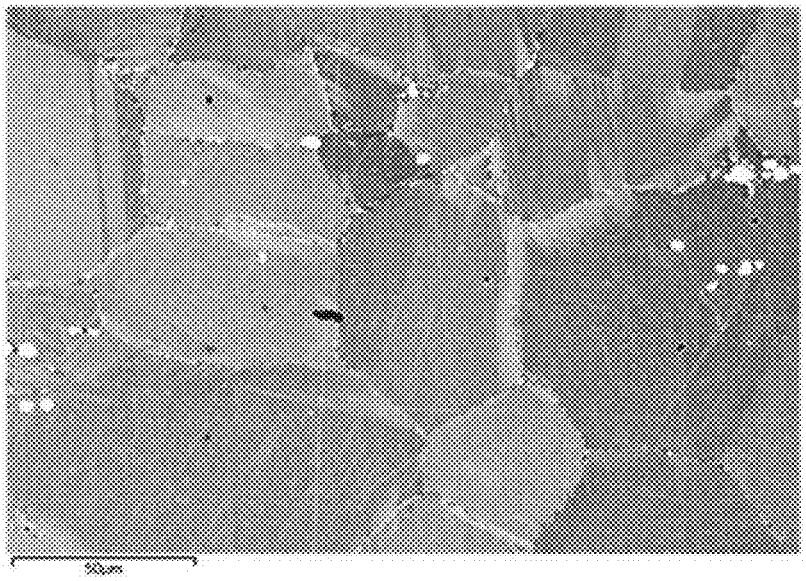
FIG. 23 is a BSE image of example AQ after being heat treated for 64 hours at 1400° F. (760° C.)
Figure 24:
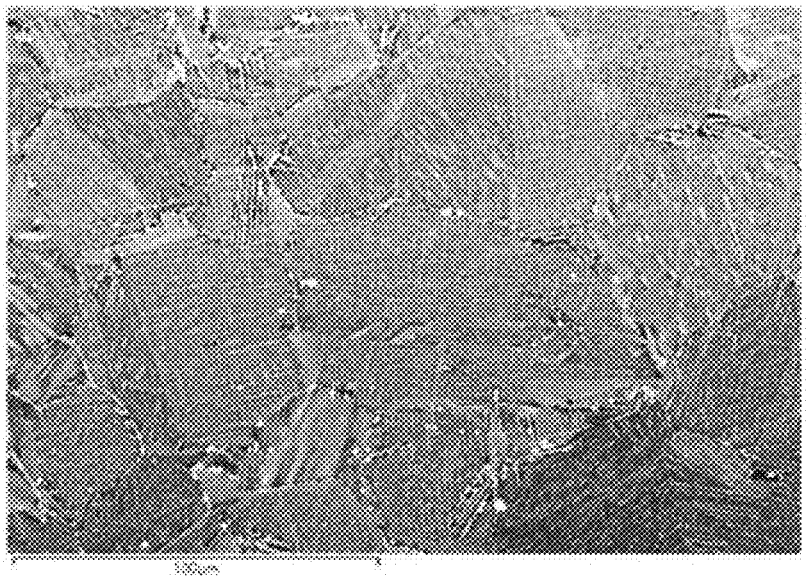
FIG. 24 is a BSE image of example AQ after being heat treated for 1024 hours at 1400° F. (760° C.)
Figure 25:
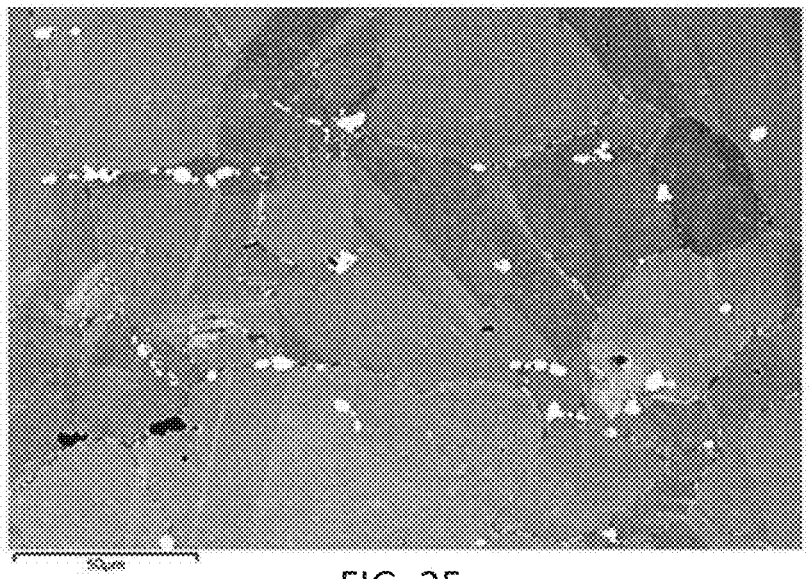
FIG. 25 is a BSE image of example AR after being heat treated for 64 hours at 1400° F. (760° C.)
Figure 26:
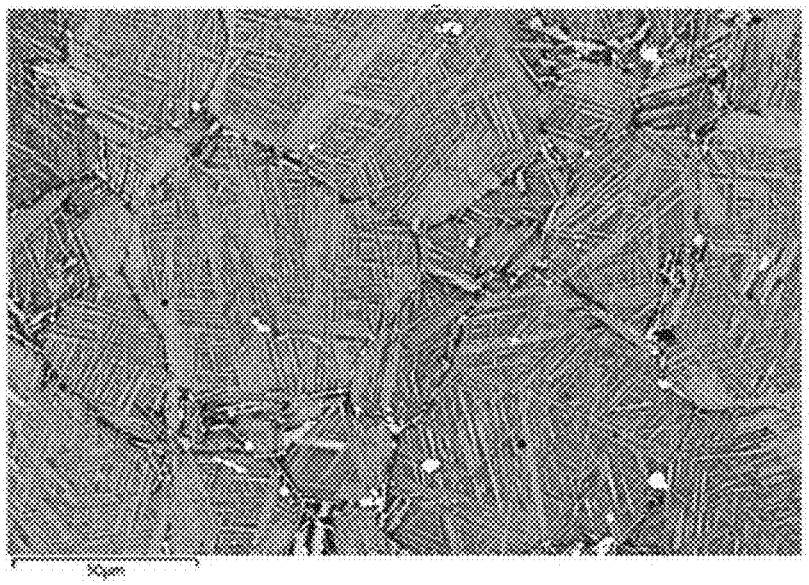
FIG. 26 is a BSE image of example AR after being heat treated for 1024 hours at 1400° F. (760° C.)
Figure 27:
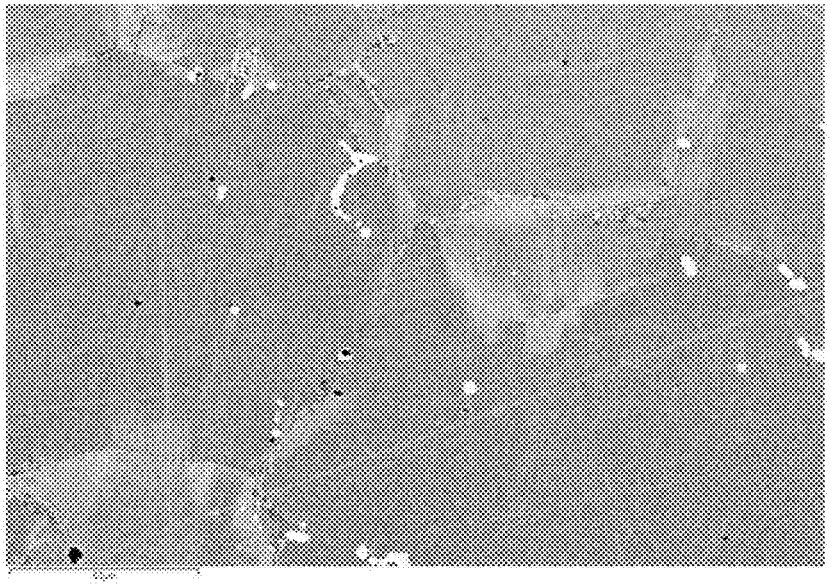
FIG. 27 is a BSE image of example AS after being heat treated for 64 hours at 1400° F. (760° C.)
Figure 28:
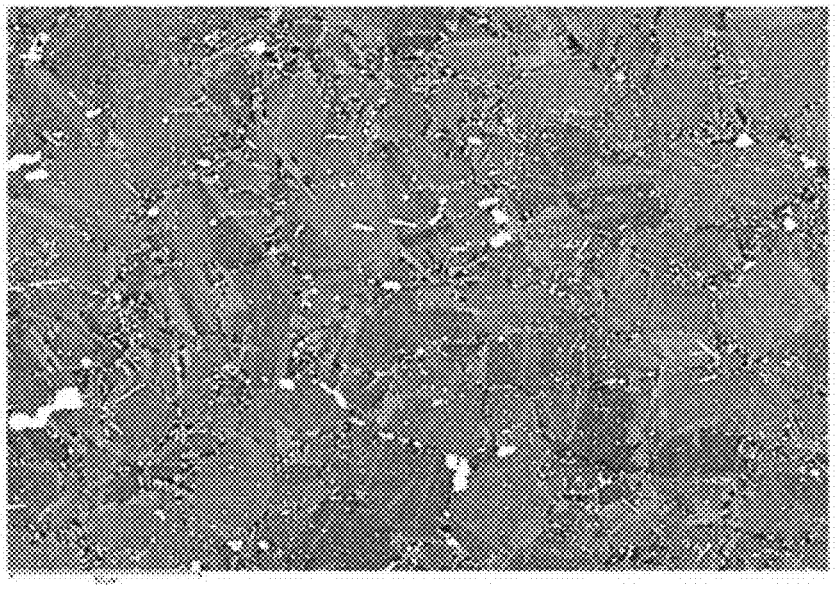
FIG. 28 is a BSE image of example AT after being heat treated for 64 hours at 1400° F. (760° C.).
Figure 29:
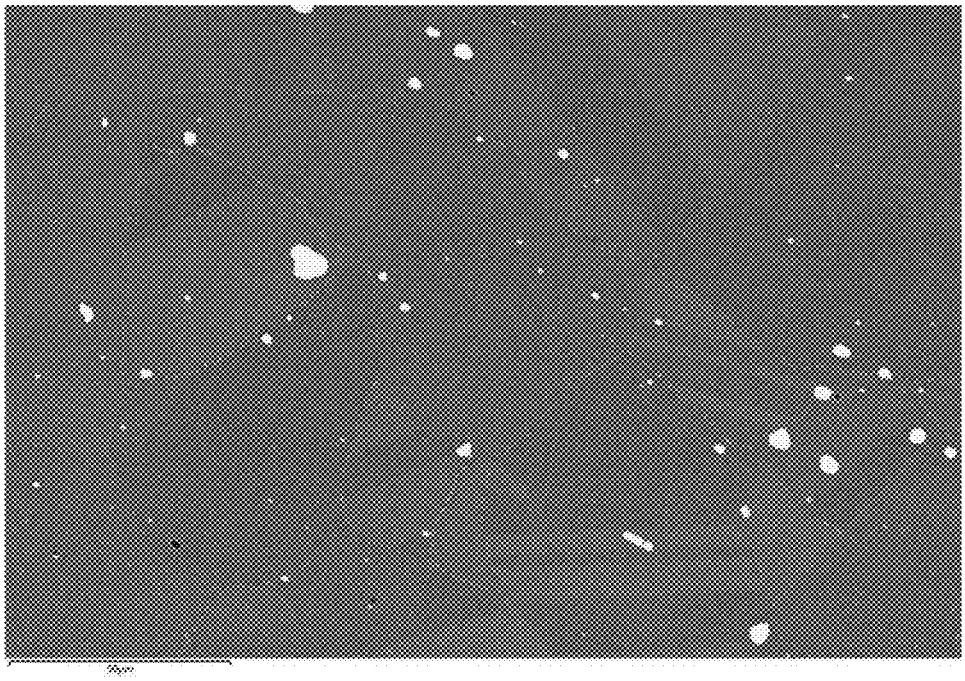
FIG. 29 is a BSE image of example BB after being heat treated for 48 hours at 1400° F. (760° C.) followed by an additional heat treat step at 1200° F. (650° C.) for 48 hours.
Figure 30:
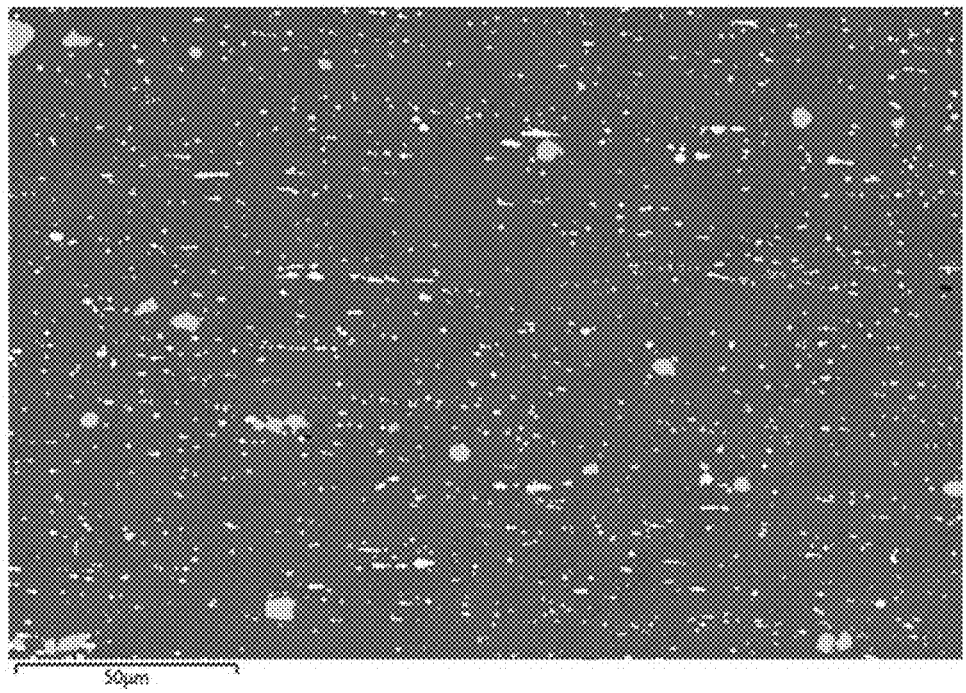
FIG. 30 is a BSE image of example BC after being heat treated for 48 hours at 1400° F. (760° C.) followed by an additional heat treat step at 1200° F. (650° C.) for 48 hours.
Figure 31:
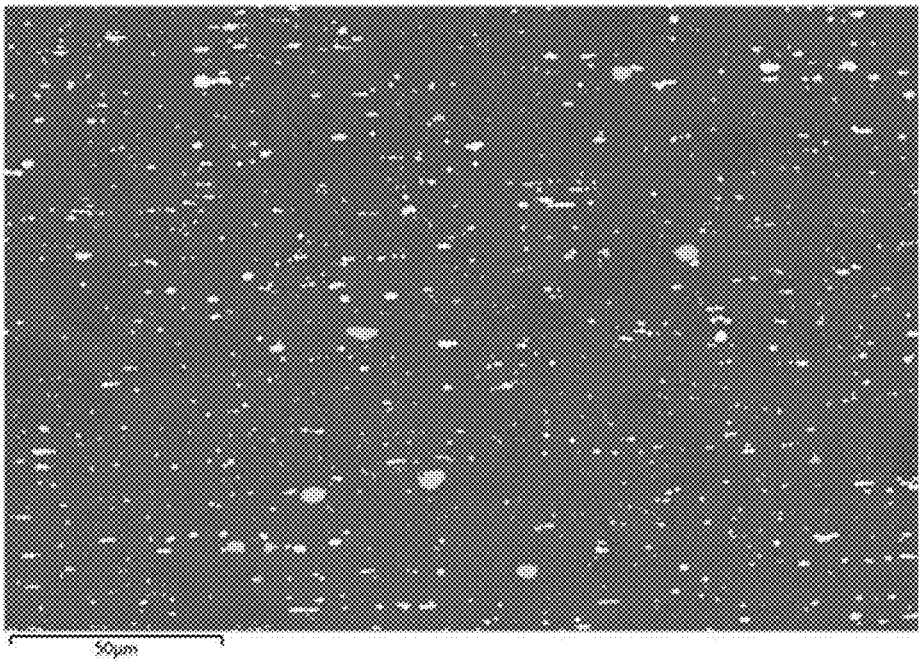
FIG. 31 is a BSE image of example CA after being heat treated for 48 hours at 1400° F. (760° C.) followed by an additional heat treat step at 1200° F. (650° C.) for 48 hours.
Figure 32:
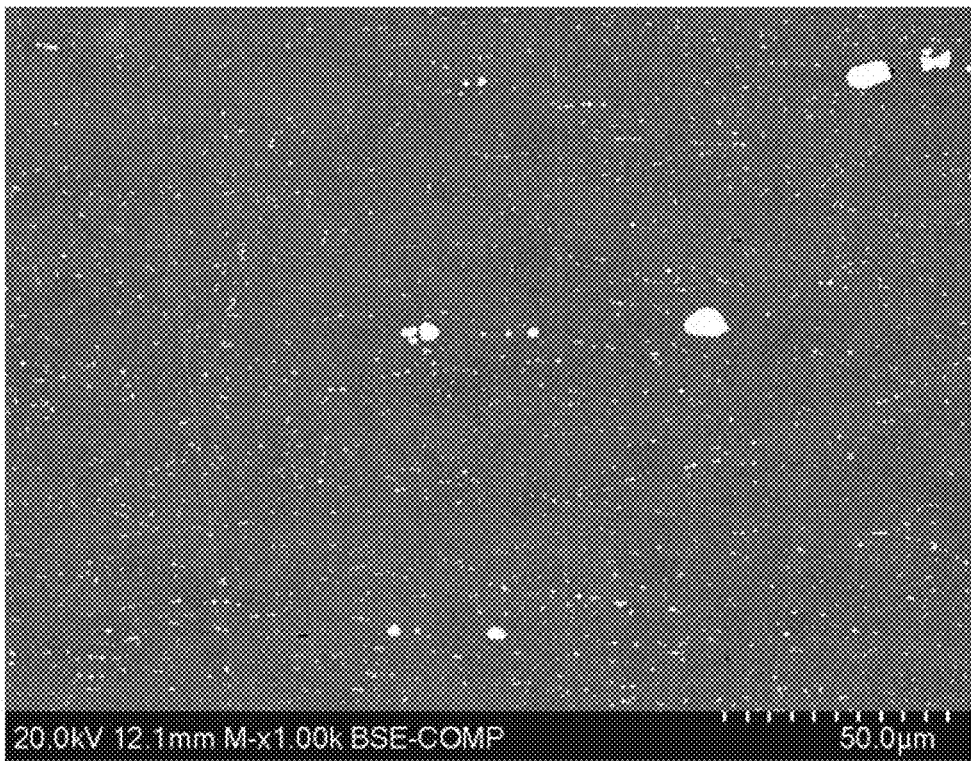
FIG. 32 is a BSE image of example CB after being heat treated for 48 hours at 1400° F. (760° C.) followed by an additional heat treat step at 1200° F. (650° C.) for 48 hours.
Figure 33:
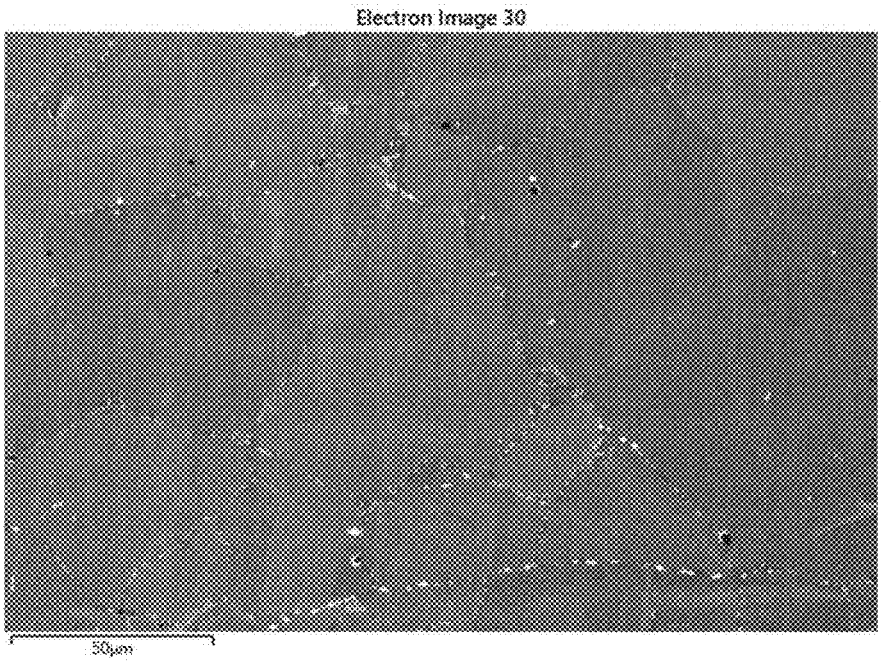
FIG. 33 is a BSE image of example DA after being heat treated for 48 hours at 1400° F. (760° C.) followed by an additional heat treat step at 1200° F. (650° C.) for 48 hours.
Figure 34:
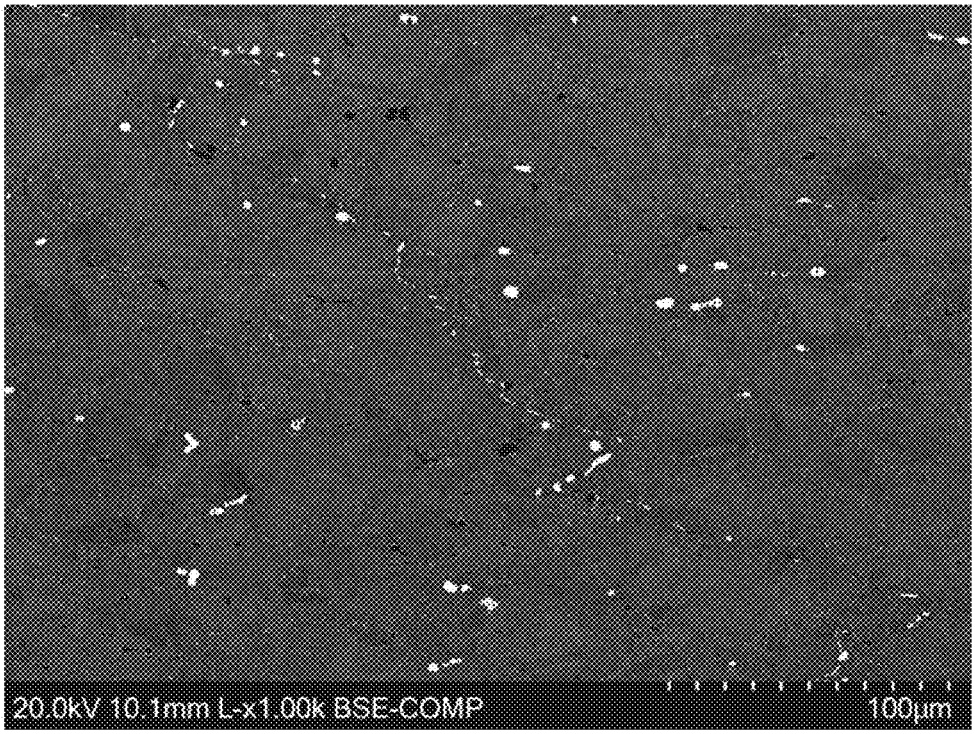
FIG. 34 is a BSE image of example DB after being heat treated for 48 hours at 1400° F. (760° C.) followed by an additional heat treat step at 1200° F. (650° C.) for 48 hours.
Figure 35:
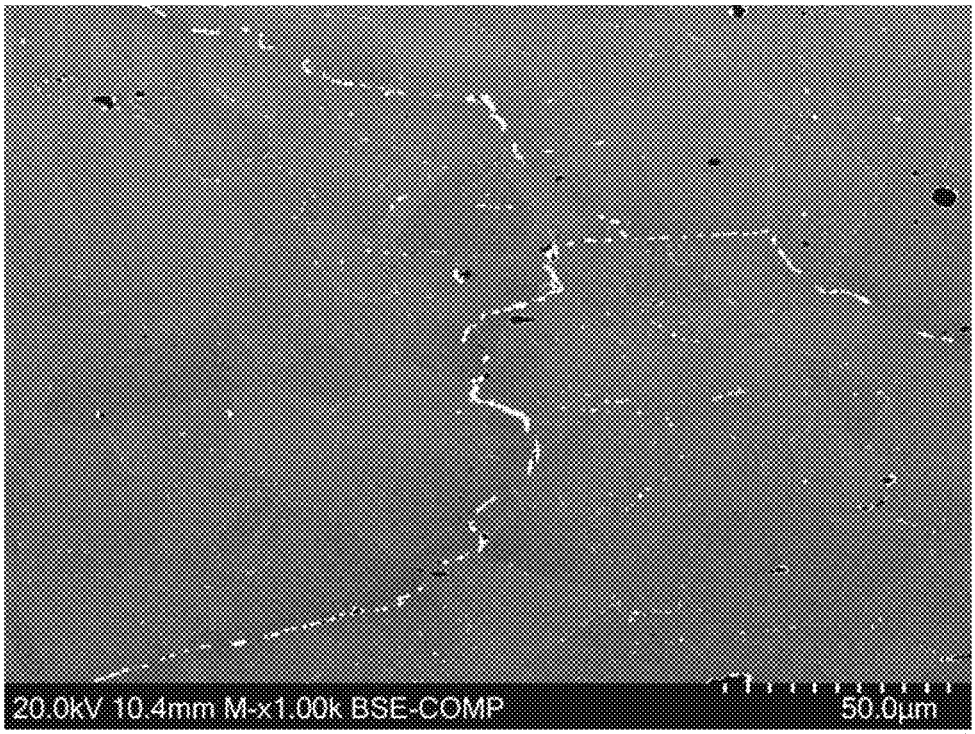
FIG. 35 is a BSE image of example DC after being heat treated for 48 hours at 1400° F. (760° C.) followed by an additional heat treat step at 1200° F. (650° C.) for 48 hours.
Figure 36:
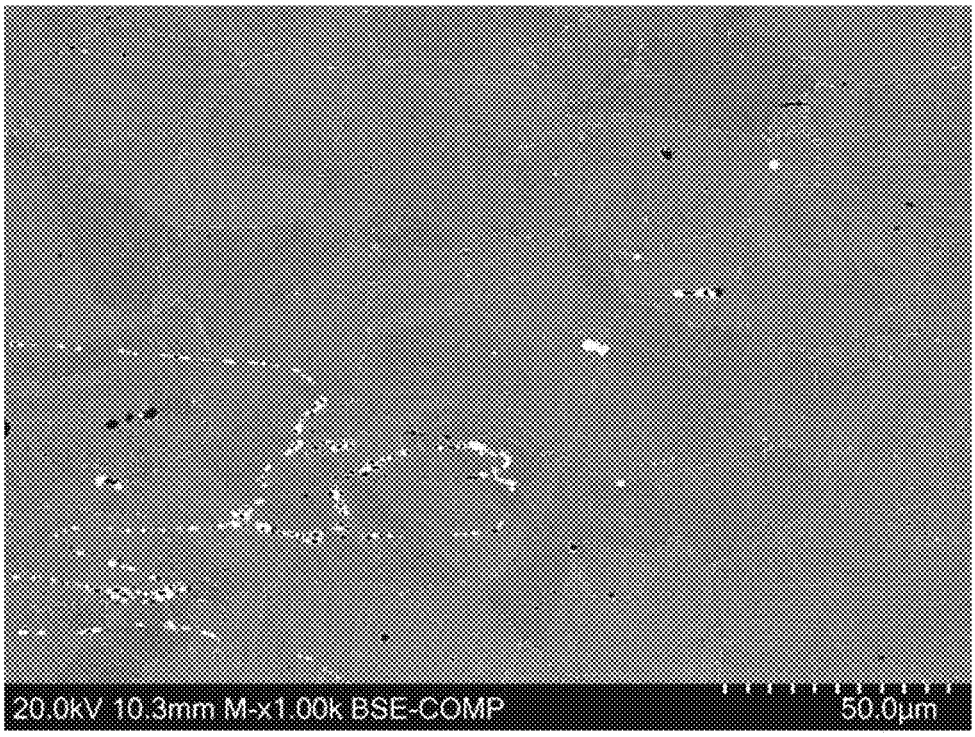
FIG. 36 is a BSE image of example DD after being heat treated for 48 hours at 1400° F. (760° C.) followed by an additional heat treat step at 1200° F. (650° C.) for 48 hours.
Figure 37:
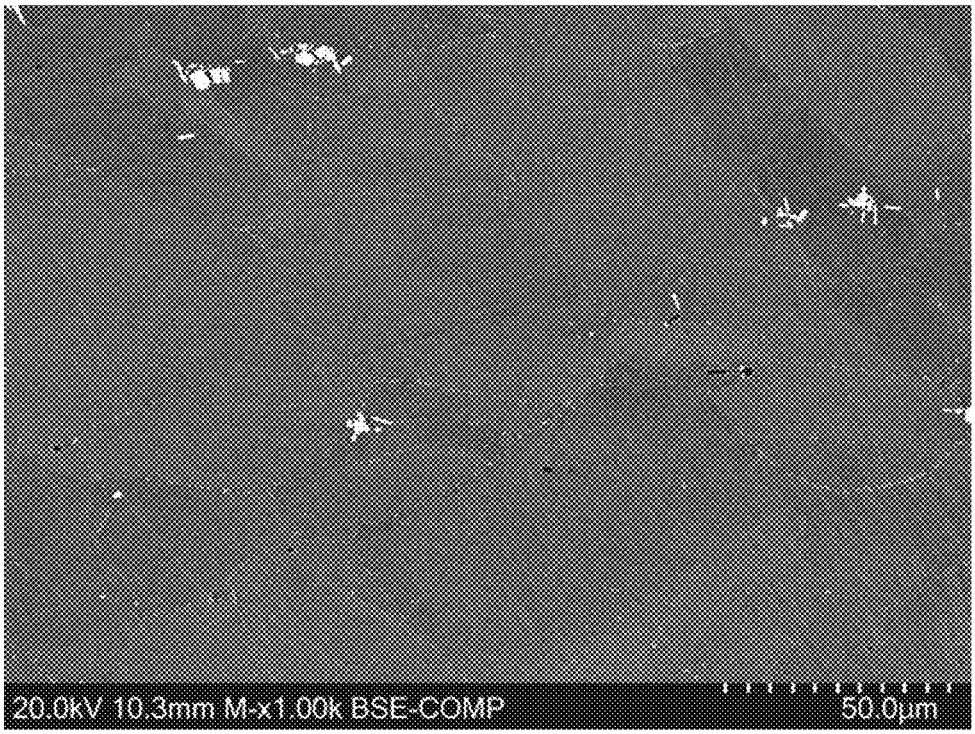
FIG. 37 is a BSE image of example DE after being heat treated for 48 hours at 1400° F. (760° C.) followed by an additional heat treat step at 1200° F. (650° C.) for 48 hours.
Figure 38:
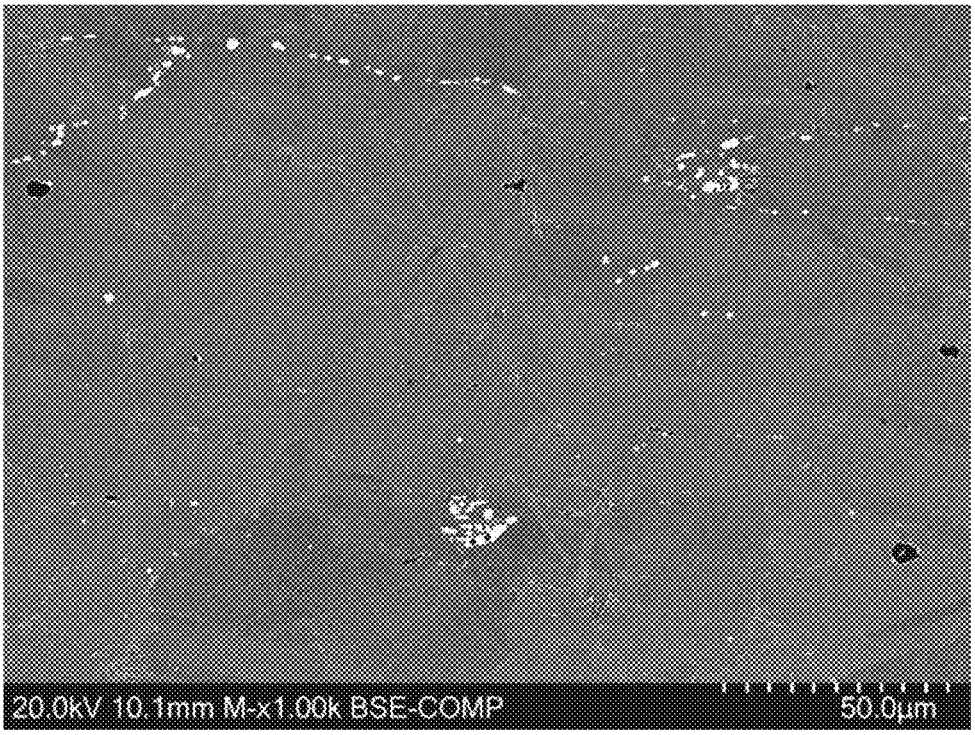
FIG. 38 is a BSE image of example DF after being heat treated for 48 hours at 1400° F. (760° C.) followed by an additional heat treat step at 1200° F. (650° C.) for 48 hours.
Figure 39:
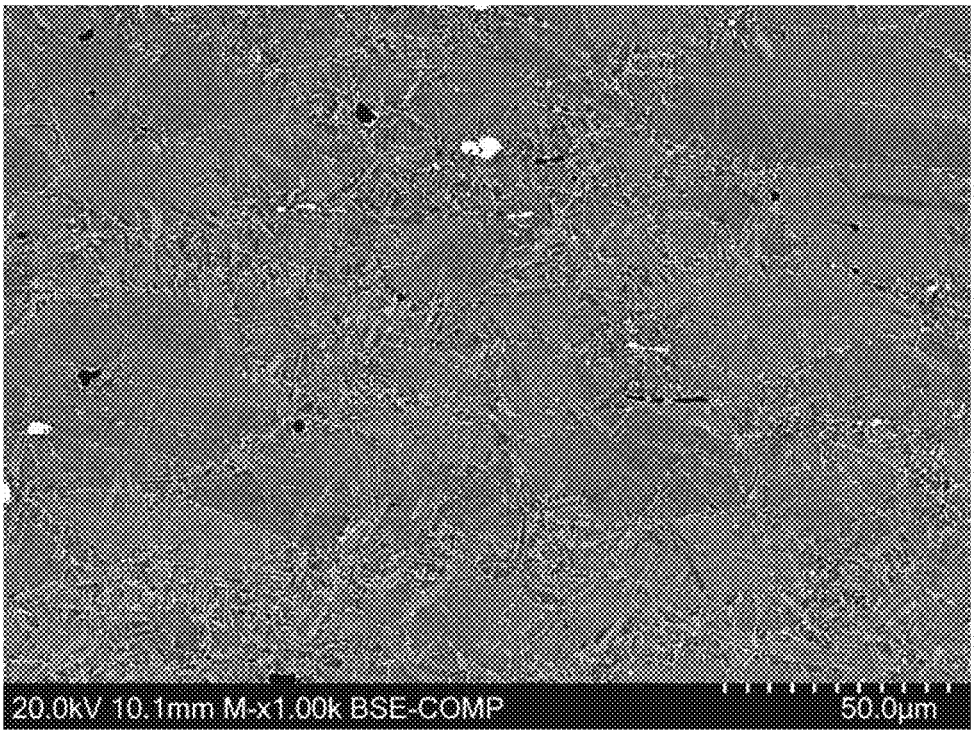
FIG. 39 is a BSE image of example DG after being heat treated for 48 hours at 1400° F. (760° C.) followed by an additional heat treat step at 1200° F. (650° C.) for 48 hours.
Figure 40:
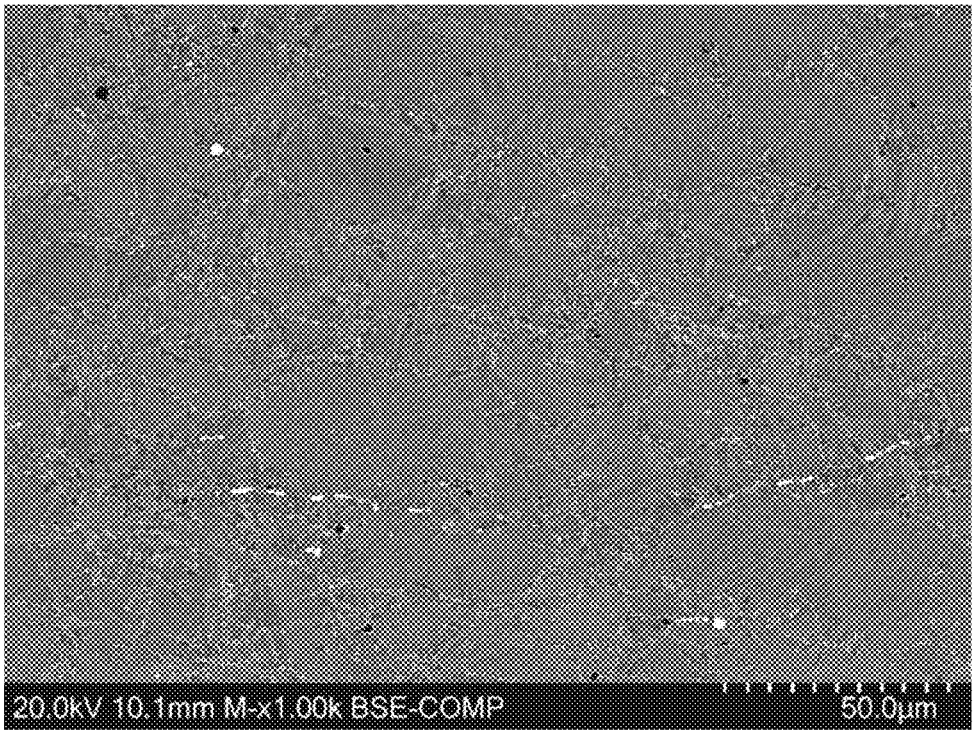
FIG. 40 is a BSE image of example DH after being heat treated for 48 hours at 1400° F. (760° C.) followed by an additional heat treat step at 1200° F. (650° C.) for 48 hours.
Figure 41:
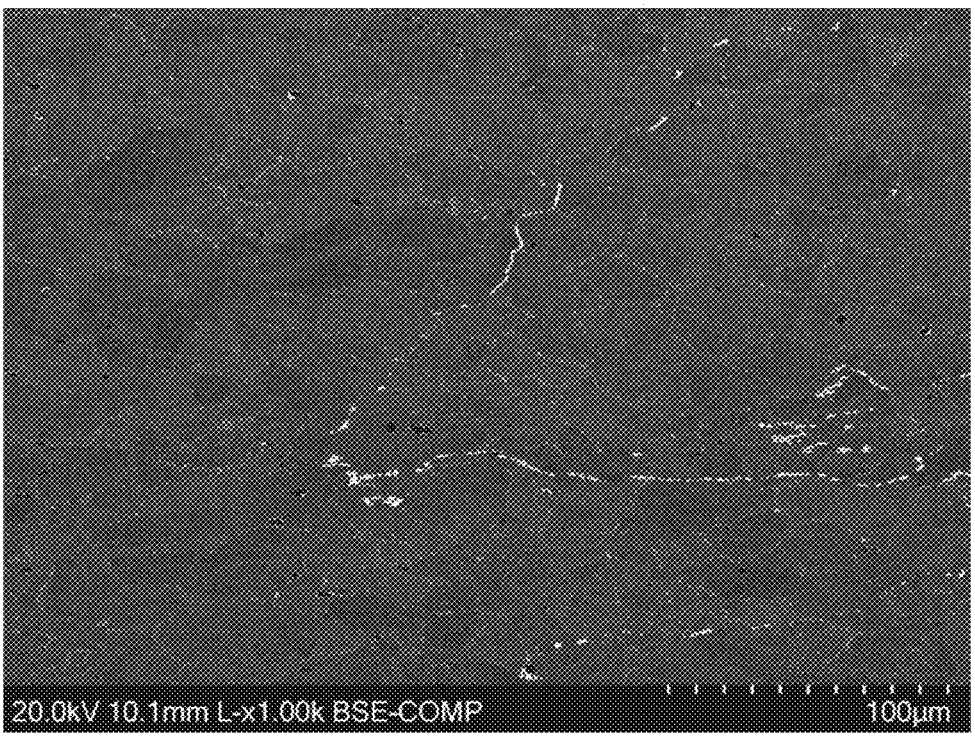
FIG. 41 is a BSE image of example DI after being heat treated for 48 hours at 1400° F. (760° C.) followed by an additional heat treat step at 1200° F. (650° C.) for 48 hours.
Figure 42:
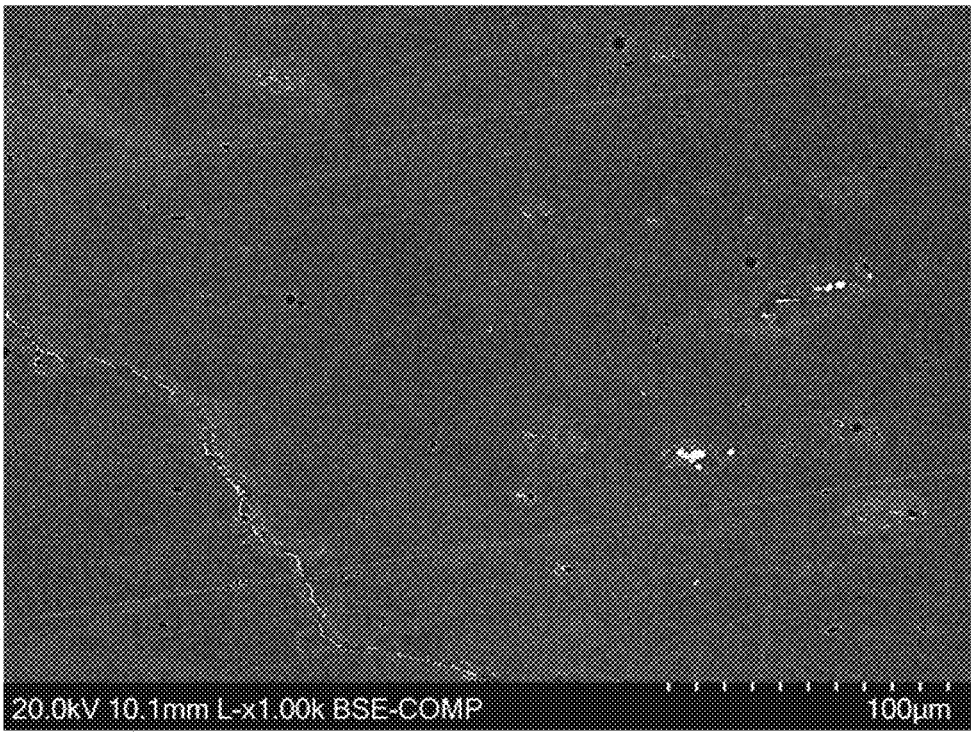
FIG. 42 is a BSE image of example DJ after being heat treated for 48 hours at 1400° F. (760° C.) followed by an additional heat treat step at 1200° F. (650° C.) for 48 hours.
Figure 43:
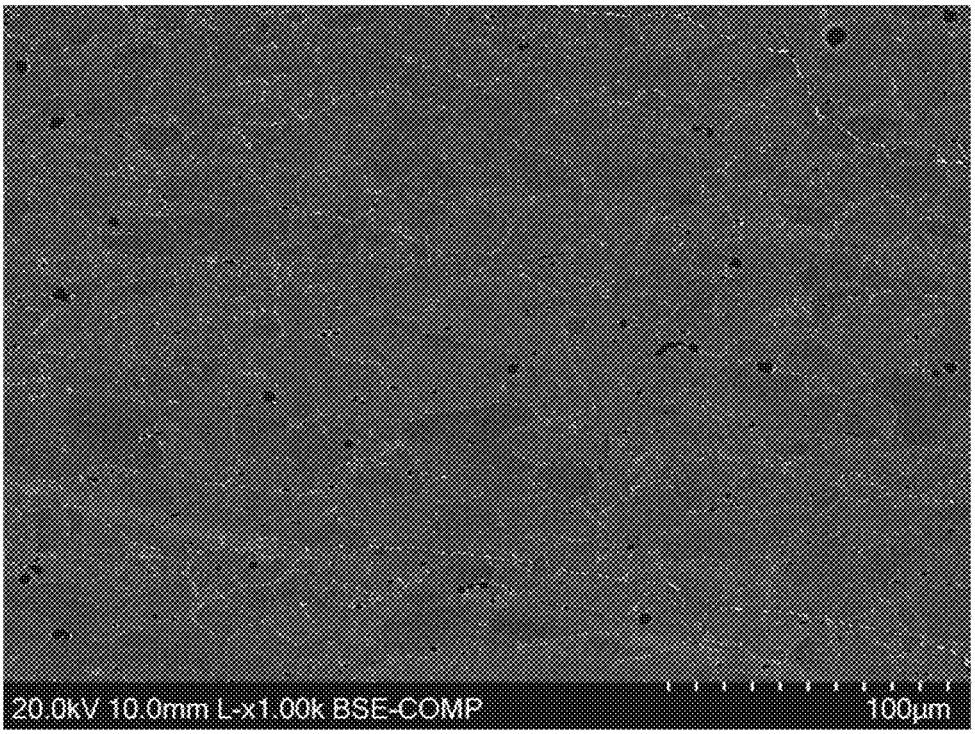
FIG. 43 is a BSE image of example DK after being heat treated for 48 hours at 1400° F. (760° C.) followed by an additional heat treat step at 1200° F. (650° C.) for 48 hours.
Figure 44:
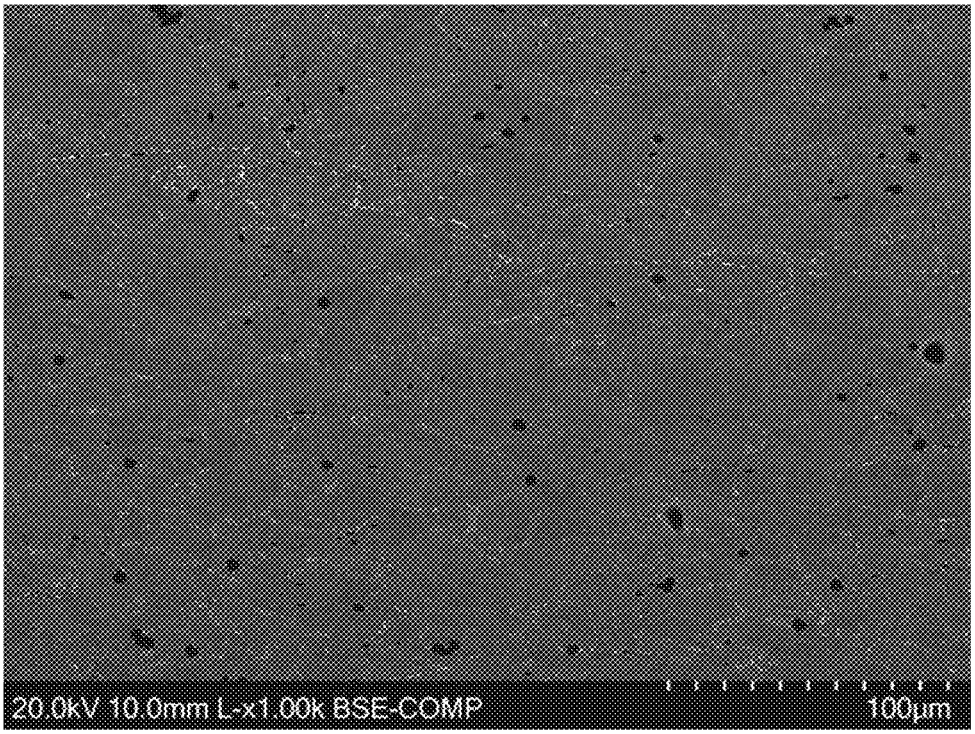
FIG. 44 is a BSE image of example DL after being heat treated for 48 hours at 1400° F. (760° C.) followed by an additional heat treat step at 1200° F. (650° C.) for 48 hours.
Figure 45:
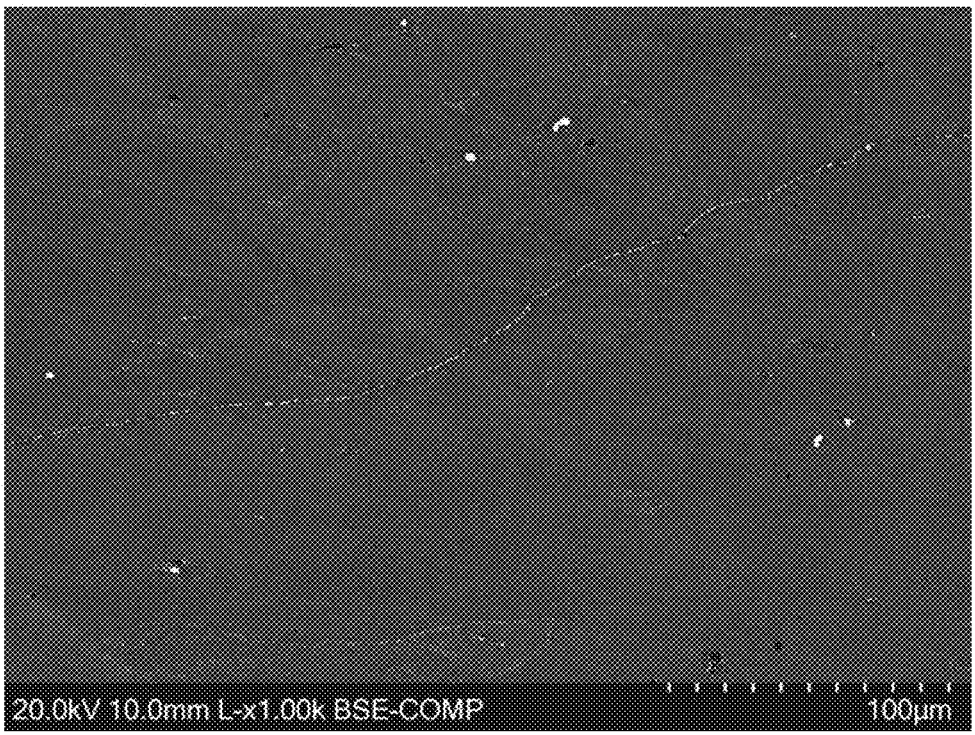
FIG. 45 is a BSE image of example DM after being heat treated for 48 hours at 1400° F. (760° C.) followed by an additional heat treat step at 1200° F. (650° C.) for 48 hours.
Figure 46:
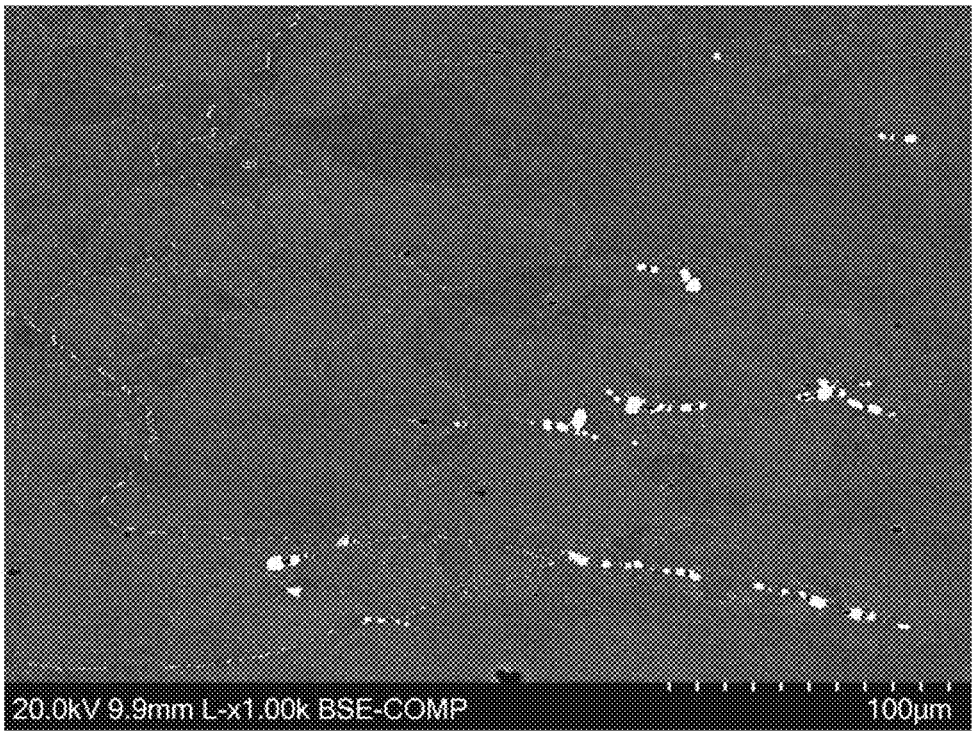
FIG. 46 is a BSE image of example DN after being heat treated for 48 hours at 1400° F. (760° C.) followed by an additional heat treat step at 1200° F. (650° C.) for 48 hours.
Figure 47:
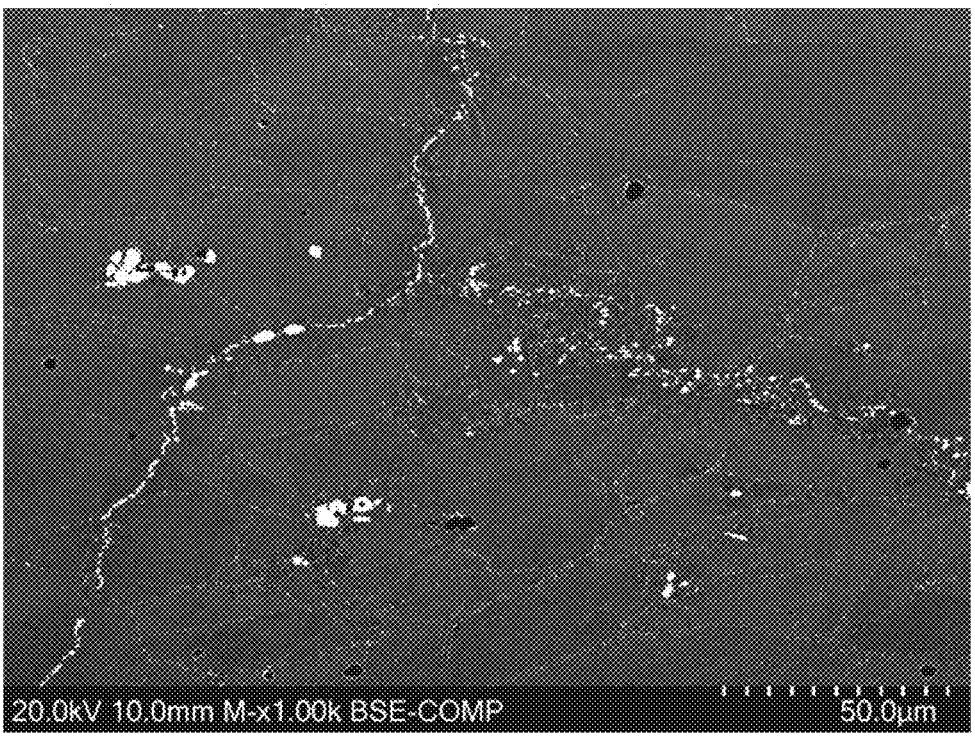
FIG. 47 is a BSE image of example DO after being heat treated for 48 hours at 1400° F. (760° C.) followed by an additional heat treat step at 1200° F. (650° C.) for 48 hours.
Figure 48:
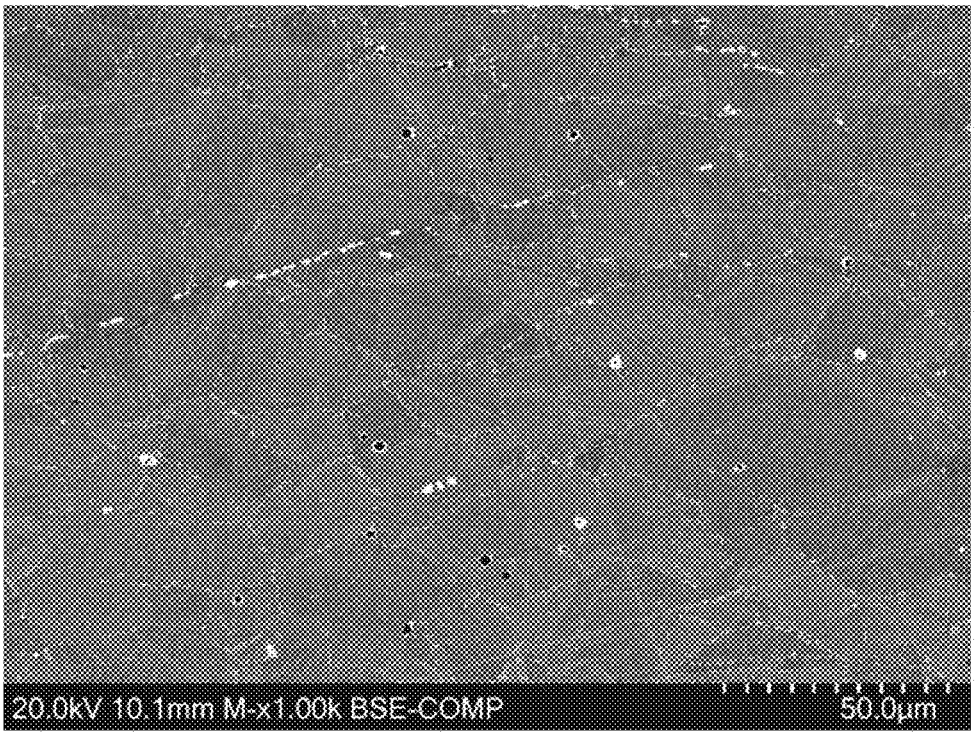
FIG. 48 is a BSE image of example DP after being heat treated for 48 hours at 1400° F. (760° C.) followed by an additional heat treat step at 1200° F. (650° C.) for 48 hours.
Figure 49:
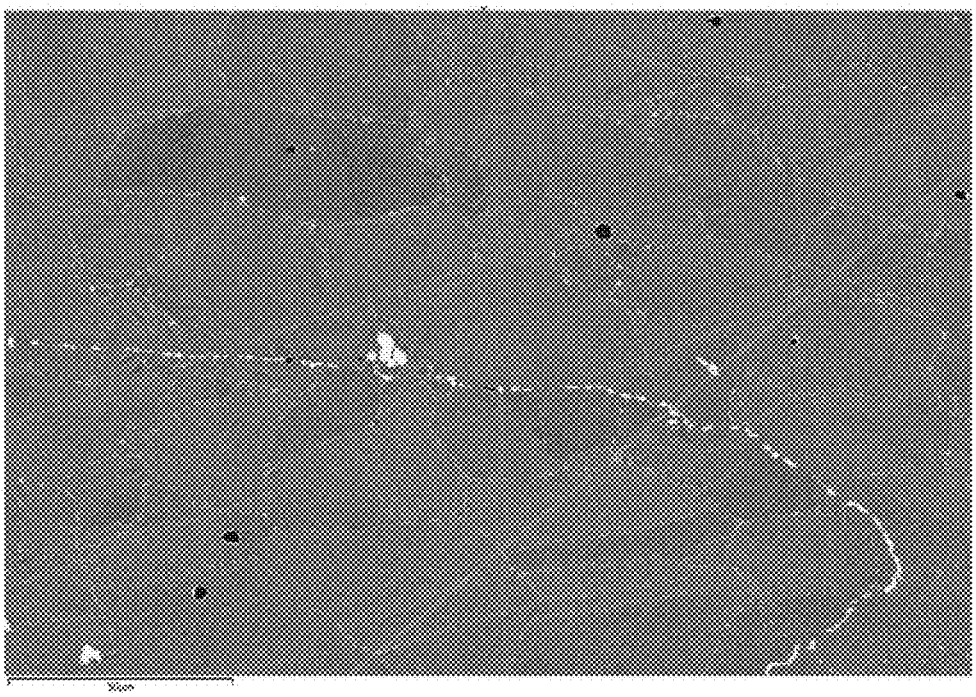
FIG. 49 is a BSE image of example DQ after being heat treated for 48 hours at 1400° F. (760° C.) followed by an additional heat treat step at 1200° F. (650° C.) for 48 hours.
Figure 50:
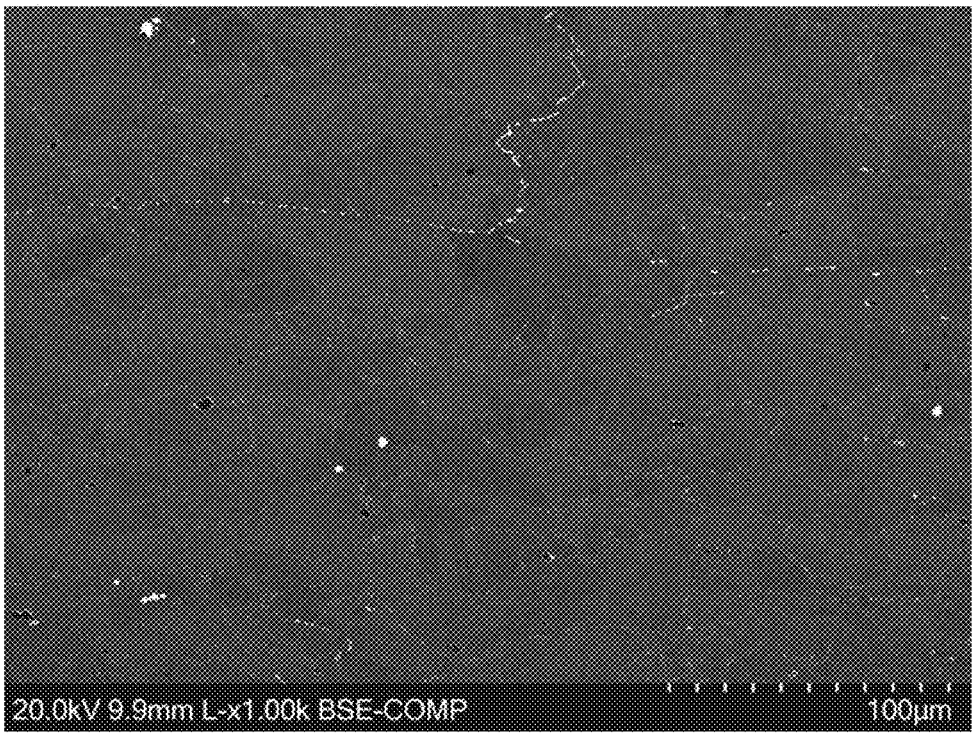
FIG. 50 is a BSE image of example DR after being heat treated for 48 hours at 1400° F. (760° C.) followed by an additional heat treat step at 1200° F. (650° C.) for 48 hours.
Figure 51:
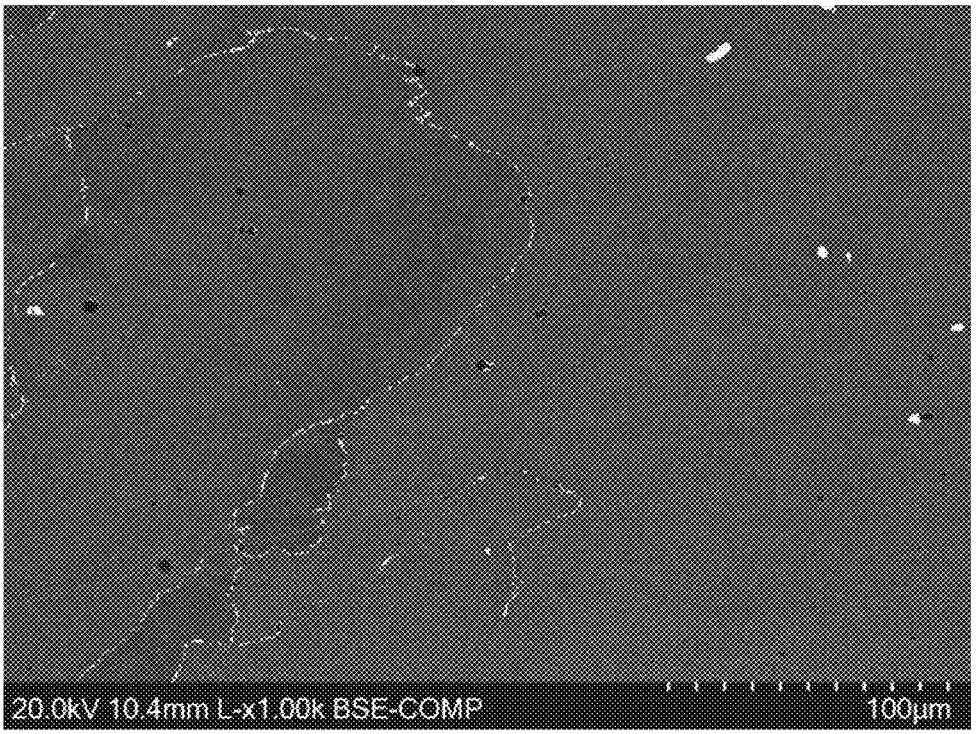
FIG. 51 is a BSE image of example DS after being heat treated 48 hours at 1400° F. (760° C.) followed by an additional heat treat step at 1200° F. (650° C.) for 48 hours.
Figure 52:
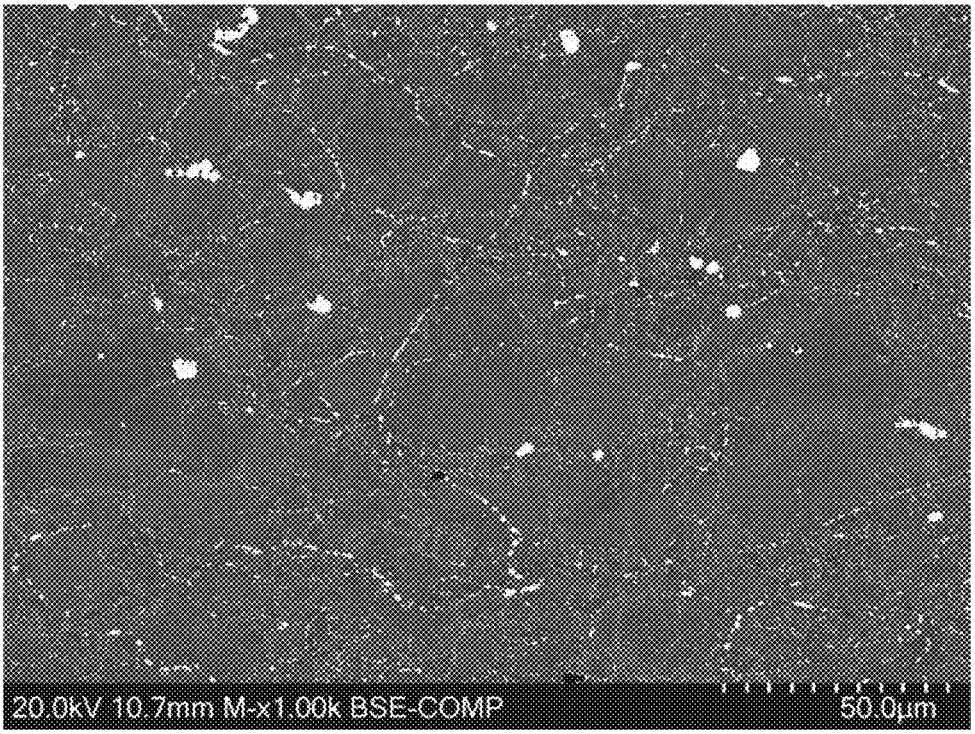
FIG. 52 is a BSE image of example DT after being heat treated for 48 hours at 1400° F. (760° C.) followed by an additional heat treat step at 1200° F. (650° C.) for 48 hours.
Figure 53:
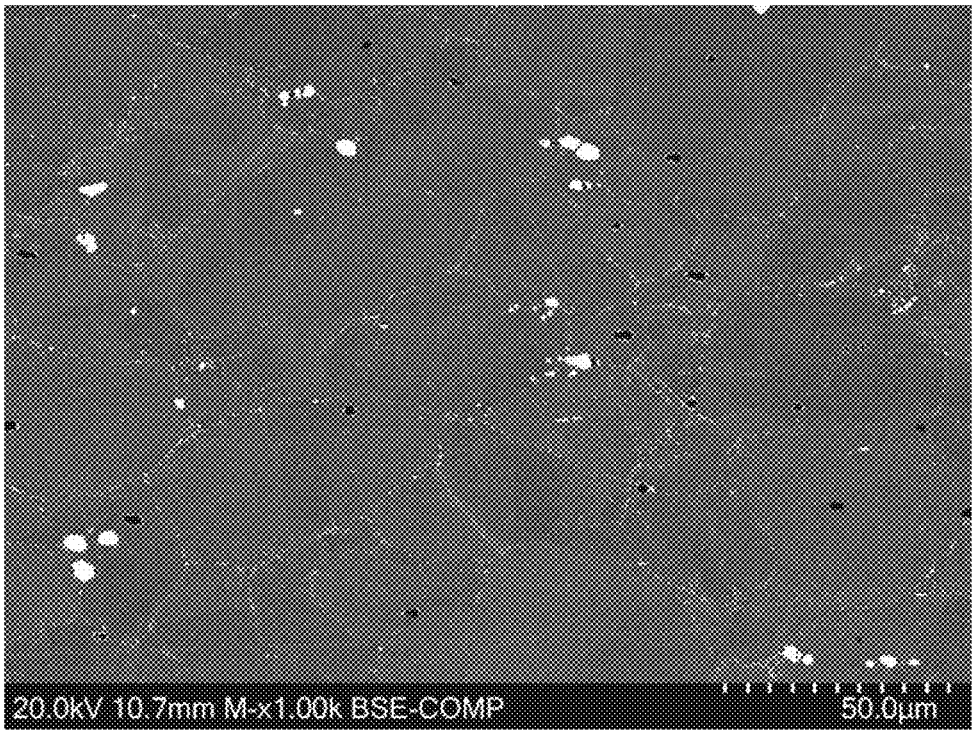
FIG. 53 is a BSE image of example DU after being heat treated for 48 hours at 1400° F. (760° C.) followed by an additional heat treat step at 1200° F. (650° C.) for 48 hours.
Figure 54:
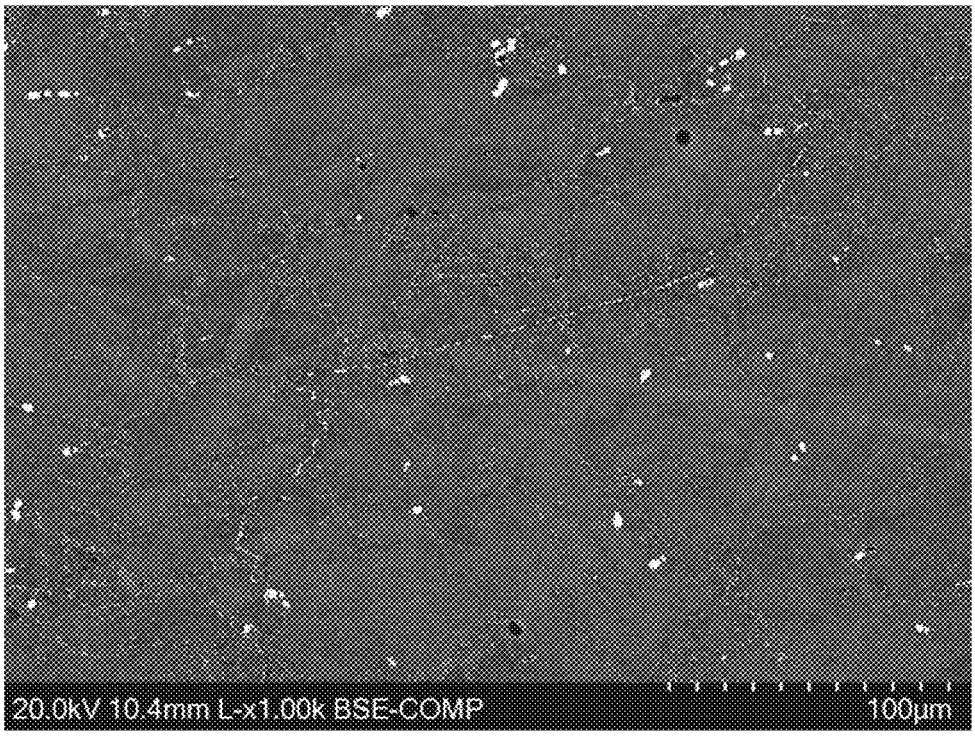
FIG. 54 is a BSE image of example DV after being heat treated for 48 hours at 1400° F. (760° C.) followed by an additional heat treat step at 1200° F. (650° C.) for 48 hours.
Figure 55:
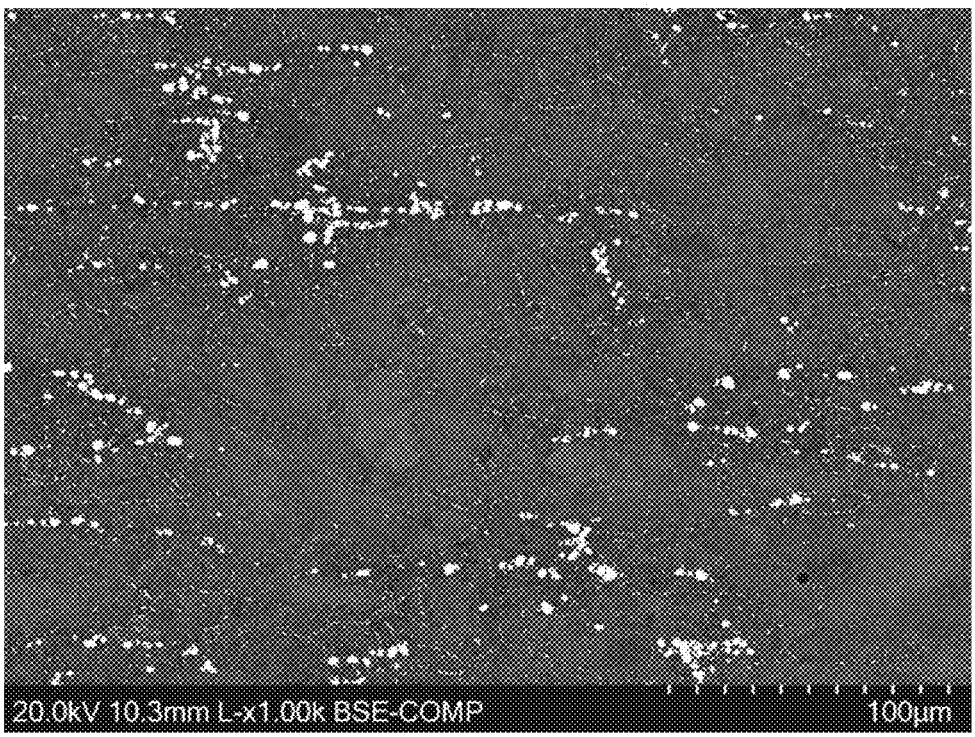
FIG. 55 is a BSE image of example DW after being heat treated for 48 hours at 1400° F. (760° C.) followed by an additional heat treat step at 1200° F. (650° C.) for 48 hours.
Figure 56:
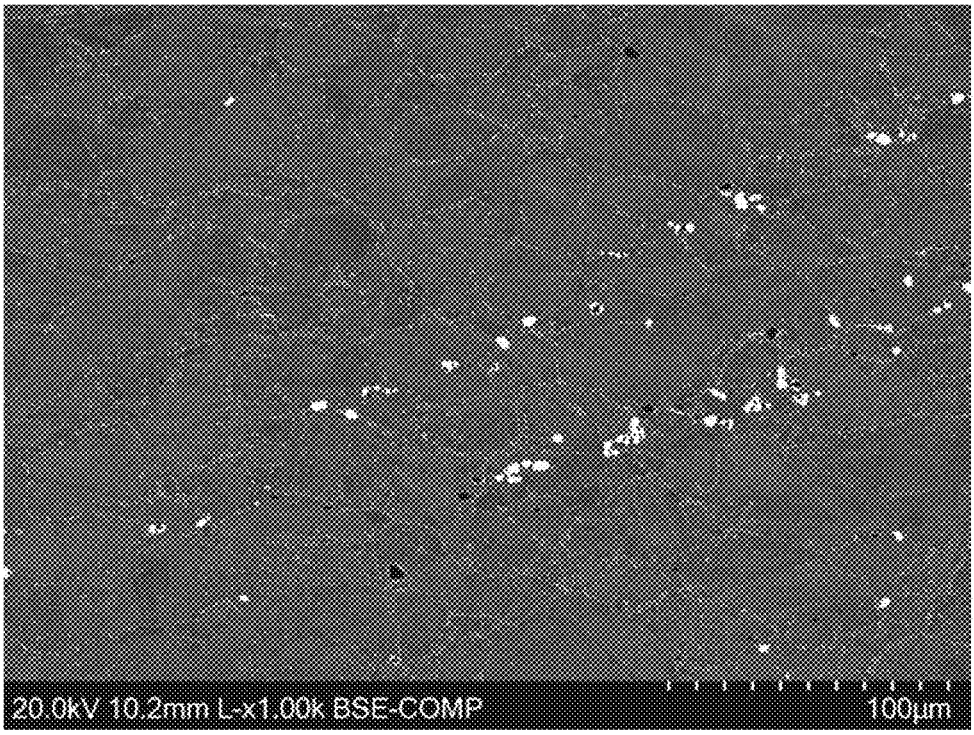
FIG. 56 is a BSE image of example DX after being heat treated for 48 hours at 1400° F. (760° C.) followed by an additional heat treat step at 1200° F. (650° C.) for 48 hours.
Figure 57:
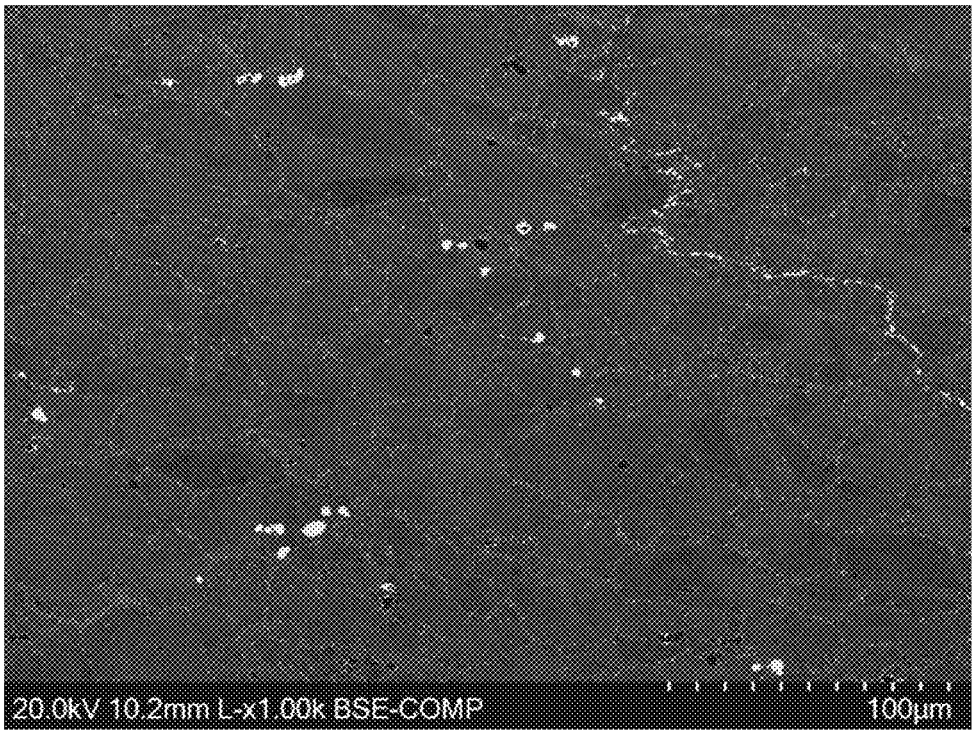
FIG. 57 is a BSE image of example DY after being heat treated for 48 hours at 1400° F. (760° C.) followed by an additional heat treat step at 1200° F. (650° C.) for 48 hours.
Figure 58:
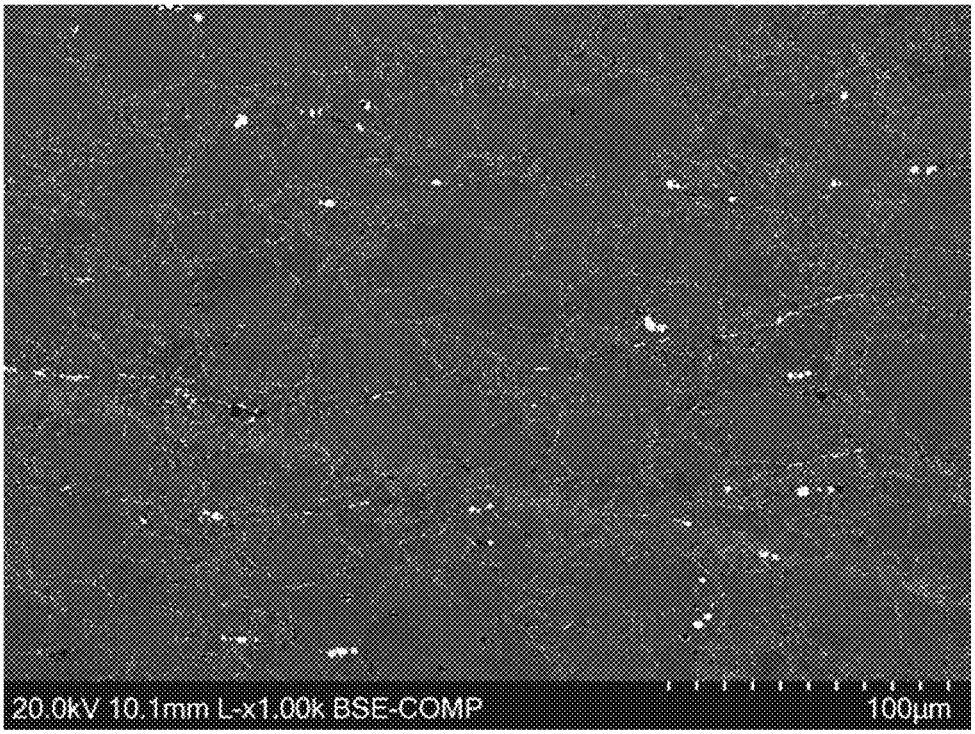
FIG. 58 is a BSE image of example DZ after being heat treated 48 hours at 1400° F. (760° C.) followed by an additional heat treat step at 1200° F. (650° C.) for 48 hours.

The examples set out herein illustrate certain embodiments, in one form, and such examples are not to be construed as limiting the scope of the appended claims in any manner.

DETAILED DESCRIPTION

Various embodiments are described and illustrated herein to provide an overall understanding of the disclosed nickel-base alloys and articles of manufacture. The various embodiments described and illustrated herein are non-limiting and non-exhaustive. Thus, an invention is not limited by the description of the various non-limiting and non-exhaustive embodiments disclosed herein. Rather, the invention is defined solely by the claims.

The features and characteristics illustrated and/or described in connection with various embodiments may be combined with the features and characteristics of other embodiments. Such modifications and variations are intended to be included within the scope of this specification. As such, the claims may be amended to recite any features or characteristics expressly or inherently described in, or otherwise expressly or inherently supported by, this specification. Further, the applicant reserves the right to amend the claims to affirmatively disclaim features or characteristics that may be present in the prior art.

The various embodiments disclosed and described in this specification can comprise, consist of, or consist essentially of the features and characteristics as variously described herein. For example, reference herein to a nickel-base alloy "comprising" a particular elemental composition is intended to also encompass alloys "consisting essentially of" or "consisting of" the stated composition. It will be understood that nickel-base alloy compositions described herein that "comprise", "consist of", or "consist essentially of" a particular composition also may include impurities.

All elemental concentrations provided herein for an alloy composition are weight percentages based on total weight of the particular alloy composition, unless otherwise indicated herein.

It can be challenging to formulate a nickel-base alloy that exhibits an advantageous combination of strength (e.g., creep, yield strength, and/or tensile strength), weldability, formability (e.g., hardness and/or elongation), microstructural stability, and acceptably low CTE at extreme temperatures (e.g., up to and including 1400° F. (760° C.) or less than −130° F. (−90° C.)). For example, there may be tradeoffs between CTE, strength, weldability, formability, and/or microstructural stability in a nickel-base alloy formulation such that improving one property (e.g., lowering CTE) is accompanied by a deterioration in another of the properties (e.g., reducing yield strength).

As is understood in the art, "creep" refers to time-dependent strain occurring under continuous stress below the material's yield strength, such as, for example, at elevated temperature under a load. As used herein in connection with creep properties, "elevated temperature" refers to temperatures in excess of 200° F. (93.3° C.). "Stress rupture" is understood to be the time at which a metallic article ruptures when subjected to a given sustained load at a given temperature. "Creep strength", also known as "creep limit", is a measure of a material's resistance to creep. It may also be described as the stress under particular conditions that results in a particular creep rate. In other words, creep strength may be considered the combination of stress, temperature, and time required to reach a particular percent of creep or rupture. The stress rupture for an alloy article is generally indicative of its creep strength. A higher stress rupture value indicates higher creep strength for an alloy article.

Embodiments of alloys according to the present disclosure are expected to exhibit comparable or superior stress rupture lives at 1400° F. (760° C.) and 1500° F. (816° C.) compared to existing low CTE alloys such as HAYNES® 244® alloy and UNS N19909 alloy due to the increased strength of nickel-base alloy embodiments of the present disclosure at extreme temperatures.

Certain demanding applications can require that an alloy exhibit high strength as well as low CTE at temperatures greater than 1400° F. (760° C.), greater than 1500° F. (816° C.), or even greater than 1600° F. (871° C.). While exploiting magnetic effects has been employed to lower the CTE of certain alloys, such alloys may lack an efficient strengthening mechanism at temperatures at or above 1500° F. (816° C.). Certain alloys engineered to develop $Ni_2X$ phase to reduce CTE at lower temperatures may exhibit a rapid increase in CTE as operating temperatures increase, partially due to dissolution of the reinforcing $Ni_2X$ precipitate. The present disclosure provides a nickel-base alloy that may exhibit a combination of low CTE, high strength, and microstructural stability, even when subjected to extreme temperatures, up to and including 1400° F. (760° C.).

Certain non-limiting embodiments of a nickel-base alloy according to the present disclosure comprise, in weight percent based on total weight of the nickel-base alloy: 8% to 24% molybdenum; 0 to 12% tungsten; 3.5% to 10% chromium; 2% to 10% vanadium; 0 to 10% iron; and nickel. In various non-limiting embodiments, the nickel-base alloys provided herein can exhibit a low CTE, for example, no greater than 9 μin/in-° F. at 1500° F. (816° C.), while also maintaining substantial strength, at extreme temperatures.

In certain non-limiting embodiments, a nickel-base alloy according to the present disclosure comprises, in weight percent based on total weight of the nickel-base alloy: 14.5% to 17.5% molybdenum; 8% to 10% tungsten; 6% to 8% chromium; 3.5% to 5.5% vanadium; 0 to 0.3% niobium; 0 to 3% iron; and nickel. In various non-limiting embodiments, a nickel-base alloy according to the present disclosure comprises, in weight percent based on total weight of the nickel-base alloy: 15.5% to 16.5% molybdenum; 8.5% to 9.5% tungsten; 6.5% to 7.5% chromium; 5% to 6% vanadium; 0 to 0.3% niobium; 0.5% to 3% iron; 0 to 4% titanium; 0 to 15% cobalt; 0 to 5% tantalum; 0 to 2% silicon; 0 to 5% copper; 0 to 2% rhenium; 0 to 1% hafnium; 0 to 1% zirconium; 0 to 0.2% magnesium; 0 to 0.1% boron; 0 to 0.5% carbon; 0 to 1% rare earth elements; 0.05% to 2% aluminum; 0.1% to 2% manganese; impurities; and nickel.

The high temperature strength properties of articles comprising nickel-base superalloys can depend on many factors including, for example, the composition of the matrix and microstructural features. The microstructure of nickel-base alloys can include various phases, such as, for example, gamma (γ) phase, which has a face-centered cubic lattice, and $Ni_2X$ phase, which has an orthorhombic lattice. The γ phase forms a matrix in which the $Ni_2X$ phase precipitates.

The γ phase can include $Ni_2X$ phase, (e.g., $Ni_2$(Cr, Mo, W, V, Nb, etc.) phase), which can contribute to high temperature strength properties and a low CTE. The CTE of some conventional nickel-base superalloys increases rapidly after heating the alloy to near, at, or above the $Ni_2X$ solvus temperature. Embodiments of the nickel-base alloy according to the present disclosure can (i) increase alloy strength compared to other alloys that contain the $Ni_2X$ phase, nominally due to increasing the $Ni_2X$ solvus temperature of the alloy, and/or (ii) lower the CTE of the nickel-base alloy relative to conventional alloys such as UNS N07718.

Chromium can stabilize the $Ni_2X$ phase in nickel-base alloys according to the present disclosure. As the chromium content of the nickel-base alloy decreases, the microstructural stability of the nickel-base alloy may decrease. In various non-limiting embodiments, as the chromium content decreases below 4 wt %, the microstructural stability of the nickel-base alloy may significantly decrease. As used herein, microstructural stability refers to the stability of the γ+$Ni_2X$ phase field. In microstructurally unstable alloys the $Ni_2X$ phase and/or the γ phase will quickly transform into other intermetallics such as those of the $Ni_3Mo$ prototype. Chromium can also enhance hot corrosion and oxidation resistance of the nickel-base alloy. Chromium tends to reduce hardness and slow aging kinetics of the nickel-base alloy.

In various non-limiting embodiments, the CTE for the nickel-base alloy can decrease if the tungsten content is increased. Tungsten can increase the strength and temperature capability of the nickel-base alloy relative to molybdenum and chromium at the expense of increased density and lower workability. When tungsten is out of balance with molybdenum, vanadium, and chromium, the microstructural stability of the nickel-base alloy can be decreased and the $Ni_2X$ phase in the grain interiors can transform into less desirable intermetallics that may deleteriously affect strength and/or ductility of the nickel-base alloy.

Molybdenum can increase the strength and temperature capability of the nickel-base alloy relative to chromium at the expense of increased density and lower workability. Further, molybdenum additions in place of chromium can increase the aging kinetics of the $Ni_2X$ phase. When molybdenum is out of balance with tungsten, vanadium, and chromium, the microstructural stability of the nickel-base alloy can be decreased and the $Ni_2X$ phase in the grain interiors can transform into less desirable intermetallics that may deleteriously affect strength and/or ductility of the nickel-base alloy.

Vanadium can increase the temperature capability of the nickel-base alloy relative to chromium, molybdenum, and tungsten additions. Vanadium additions may increase the $Ni_2X$ phase fraction, contributing to extreme temperature strength and low CTE. When vanadium is out of balance with tungsten, molybdenum, and chromium, the microstructural stability of the nickel-base alloy can be decreased and the $Ni_2X$ phase in the grain interiors can transform into less desirable intermetallics that may deleteriously affect strength and/or ductility of the nickel-base alloy.

The appropriate balance between tungsten, molybdenum, and chromium can be determined by the chromium content, as previously mentioned, the $Cr_{eq}$ number, and by the ratio of the $Mo_{eq}$ number to the $Cr_{eq}$ number. The $Cr_{eq}$ and $Mo_{eq}$ numbers are as defined below.

$$Cr_{eq} = \{[Cr] + 0.54[Mo] + 0.28[W] + 1.02[V] + 0.55[Nb] + 1.09[Ti] + 0.29[Ta]\}$$

$$Mo_{eq} = \{[Mo] + 1.06[W] + 6.61[V] + 4.14[Nb] + 14.07[Ti] + 4.26[Ta]\}$$

In the above equation [Cr], [Mo], [W], [V], [Nb], [Ti], and [Ta] refer to the weight percentage of the respective element in the nickel-base alloy.

In various embodiments, the composition of the nickel-base alloy according to the present disclosure can satisfy the following equation:

$$18 < Cr_{eq} < 33$$

In certain non-limiting embodiments, the composition of the nickel-base alloy according to the present disclosure can satisfy the following equation:

$$20 < Cr_{eq} < 26$$

In various embodiments, the composition of the nickel-base alloy according to the present disclosure can satisfy the following equation:

$$Mo_{eq}/Cr_{eq} > 1.8$$

In certain non-limiting embodiments, the composition of the nickel-base alloy according to the present disclosure can satisfy the following equation:

$$Mo_{eq}/Cr_{eq} > 2$$

Certain non-limiting embodiments of a nickel-base alloy according to the present disclosure can comprise, in weight percent based on total weight of the nickel-base alloy, 8% to 24% molybdenum, such as, for example, 8% to 22%, 8% to 20%, 10% to 20%, 10% to 19%, 10% to 18%, 11% to 19%, 13% to 19%, 14% to 18%, 12% to 17%, 13% to 17%, 14% to 17%, 15% to 17%, 14.5% to 17.5%, 14.5% to 17%, 14.5% to 16.5%, 15.25% to 16.75%, 14.5% to 17.5%, or 13.5% to 15% molybdenum.

Certain non-limiting embodiments of a nickel-base alloy according to the present disclosure can comprise, in weight percent based on total weight of the nickel-base alloy, 3.5% to 10% chromium, such as, for example, 4% to 10%, 4% to 9%, 5% to 9%, 6% to 8.5%, 6% to 8%, 6% to 9%, 6% to 7%, 5% to 8%, 5% to 8.5%, 5% to 7%, 5.5% to 7.5%, 5.5% to 7%, 7% to 9%, or 7.5% to 8.5% chromium.

Certain non-limiting embodiments of a nickel-base alloy according to the present disclosure can comprise, in weight percent based on total weight of the nickel-base alloy, 0 to 12% tungsten, such as, for example, 1% to 12%, 2% to 12%, 3% to 12%, 4% to 12%, 8% to 12%, 4% to 11%, 4% to 8%, 5% to 8%, 5.5% to 7.5%, 5% to 7%, 5.5% to 6.5%, 5% to 11%, 6% to 8%, 6% to 11%, 7% to 11%, 8% to 11%, 8.5% to 12%, 8.5% to 11%, 9% to 11%, 9% to 10%, 0% to 6%, 0% to 4%, 2% to 6%, 0% to 2%, 2% to 4%, or 9.5% to 10.5% tungsten.

Certain non-limiting embodiments of a nickel-base alloy according to the present disclosure can comprise, in weight percent based on total weight of the nickel-base alloy, 2% to 10% vanadium, such as, for example, 2% to 8%, 2% to 6%, 3% to 7%, 3% to 6%, 3% to 9%, 4% to 9%, 4% to 8%, 7% to 9%, 3.5% to 6%, 3.5% to 5.5%, 3.5% to 5%, 3.5% to 4.5%, 4% to 5%, 3% to 5.5%, 3.75% to 5.5%, or 3% to 5% vanadium.

Certain non-limiting embodiments of a nickel-base alloy according to the present disclosure can include a weight ratio of chromium content to vanadium content ([Cr]/[V]) in the alloy that is in a range of 0.8 to 5, such as, for example, 0.8 to 4.5, 0.9 to 5, 1 to 4.5, 1 to 3, 1.2 to 2.8, 1.5 to 4, or 1.5 to 2.5. All ranges described in the present description are inclusive of the stated range end points unless otherwise stated.

Niobium additions can increase strength and aging kinetics of the nickel-base alloy according to the present disclosure. Additionally, niobium additions may increase the strength and temperature capabilities of the alloy more effectively on an atomic basis than chromium, molybdenum, tungsten, and vanadium additions. If present, niobium can also inhibit secondary carbide precipitation. Niobium can form primary carbides (i.e., MC carbides) and inhibit precipitation of secondary carbides at grain boundaries and within the grains. A significantly unbalanced amount of niobium can decrease microstructural stability of the nickel-base alloy, resulting in the formation of deleterious intermetallic phases.

Certain non-limiting embodiments of a nickel-base alloy according to the present disclosure can comprise, in weight percent based on total weight of the nickel-base alloy, 0 to 3% niobium, such as, for example, 0 to 2%, 0.3% to 2%, 0.5% to 2%, 1% to 2%, 1.1% to 1.9%, 0.5% to 1.5%, 0 to 1%, 0 to 0.5%, or 0 to 0.3% niobium.

Certain non-limiting embodiments of a nickel-base alloy according to the present disclosure can comprise, in weight percent based on total weight of the nickel-base alloy, 0 to 10% iron, such as, for example, 0 to 7%, 0 to 5%, 0 to 4%, 0 to 3%, 0 to 2%, 0 to 1.5%, 0.1% to 5%, 0.1% to 3%, 0.5% to 4%, 0.5% to 3%, 0.5% to 2%, 0.5% to 1.5%, or 0.75% to 1.25% iron.

Certain non-limiting embodiments of a nickel-base alloy according to the present disclosure optionally can additionally comprise, in weight percent based on total weight of the nickel-base alloy, one or more of: up to 4% titanium; up to 15% cobalt; up to 5% tantalum; up to 2% silicon; up to 5% copper; up to 2% rhenium; up to 1% hafnium; up to 1% zirconium; up to 0.2% magnesium; up to 0.1% boron; up to 0.5% carbon; up to a total of 1% rare earth elements; up to 2% aluminum; and up to 5% manganese.

Tantalum, if present, may affect the CTE, strength, hardness, and/or aging kinetics of the nickel-base alloy, similar to niobium. Tantalum can inhibit secondary carbide precipitation by forming primary carbides (i.e., MC carbides) and inhibiting precipitation of secondary carbides at grain boundaries and within the grains. A significantly unbalanced amount of tantalum can decrease microstructural stability of the nickel-base alloy, resulting in the formation of deleterious intermetallic phases.

Certain non-limiting embodiments of a nickel-base alloy according to the present disclosure can comprise, in weight percent concentrations based on total weight of the nickel-base alloy, 0 to 5% tantalum, such as, for example, 0 to 4%, 0 to 3%, 0 to 0.5%, 0 to 2%, 0 to 1%, 0.1% to 5%, 0.5% to 5%, 0.1% to 4%, 0.1% to 3%, 0.5% to 4%, 0.5% to 3%, 0.5% to 2%%, or 1% to 2% tantalum.

Titanium, if present, may affect the CTE, strength, hardness, and/or aging kinetics of the nickel-base alloy, similar to niobium. Titanium can inhibit secondary carbide precipitation by forming primary carbides (i.e., MC carbides) and inhibit precipitation of secondary carbides at grain boundaries and within the grains. A significantly unbalanced amount of titanium can decrease microstructural stability of the nickel-base alloy, resulting in the formation of deleterious intermetallic phases.

Certain non-limiting embodiments of a nickel-base alloy according to the present disclosure can comprise, in weight percent based on total weight of the nickel-base alloy, 0 to 4% titanium, such as, for example, 1% to 4%, 1.3% to 3.5%, 0.1% to 1.5%, 0.2% to 1.5%, 0.3% to 1.4%, 0.5% to 1.5%, 0.3% to 1.3%, or 0.5% to 1.3% titanium.

Aluminum, if present, may increase the CTE and oxidation resistance of the nickel-base alloy. Excessive additions of aluminum may result in undesirably high CTE values at high temperature or formation of the γ'-phase with a simple cubic lattice within the alloy instead of or alongside the $Ni_2X$ phase.

Certain non-limiting embodiments of a nickel-base alloy according to the present disclosure can comprise, in weight percent based on total weight of the nickel-base alloy, 0 to 2% aluminum, such as, for example, 0 to 0.5%, 0.05% to 2%, 0.05% to 0.5%, 0.1% to 1%, 0.1% to 0.75%, or 0.1% to 0.5% aluminum.

Cobalt, if present, may be used to control the $Ni_2X$ solvus temperature. Cobalt additions may also promote formation of topologically closed-packed (TCP) phases (e.g., μ-phase, σ-phase) in the nickel-base alloy after long holds at elevated temperatures. Inhibiting formation of TCP phases can increase the ductility of the nickel-base alloy. The nickel-base alloy's cobalt concentration can affect the ductility and the stress rupture life of the nickel-base alloy. For example, increasing cobalt concentration may increase creep strength of the nickel-base alloy.

Certain non-limiting embodiments of a nickel-base alloy according to the present disclosure can comprise, in weight percent based on total weight of the nickel-base alloy, 0 to 15% cobalt, such as, for example, 0 to 15%, 0 to 10%, 0 to 5%, 0 to 0.5%, 0 to 1%, 0.1 to 1%, 1% to 12%, 2% to 12%, 5% to 12%, 6% to 15%, 6% to 13%, 7% to 12%, 8% to 11%, or 9% to 11% cobalt.

Silicon and manganese, if present, can improve oxidation resistance of the nickel-base alloy according to the present disclosure in particular oxidizing environments. Silicon and manganese may adversely affect $Ni_2X$ solvus temperature and the strength of the nickel-base alloy according to the present disclosure if present at excessively high levels.

Certain non-limiting embodiments of a nickel-base alloy according to the present disclosure can comprise, in weight percent based on total weight of the nickel-base alloy, 0 to 2% silicon, such as, for example, 0 to 1%, 0 to 0.5%, 0.01% to 1.5%, 0.01% to 1.0%, 0.01% to 0.5%, 0.02% to 0.5%, or 0.02% to 0.2% silicon.

Certain non-limiting embodiments of a nickel-base alloy according to the present disclosure can comprise, in weight percent based on total weight of the nickel-base alloy, 0 to 5% manganese such as, for example, 0 to 4%, 0 to 2%, greater than 0 to 0.5%, greater than 0 to 1%, greater than 0 to 1.5%, 0 to 1.5%, 0 to 1%, 0 to 0.5%, 0 to 0.1%, 0.1 to 2%, 0.1% to 1%, 0.1% to 0.5%, 0.25% to 1.5%, or 1% to 2% manganese.

Copper can be included in various non-limiting embodiments of the nickel-base alloy according to the present disclosure, for example, to reduce solute solubility in the γ-phase matrix and enhance corrosion resistance in certain environments. Certain non-limiting embodiments of a nickel-base alloy according to the present disclosure can comprise, in weight percent based on total weight of the nickel-base alloy, 0 to 5% copper such as, for example, 0 to 4%, 0 to 3%, 0 to 2%, 0 to 1%, 0 to 0.5%, 0.01% to 4%, 0.01% to 2%, 0.01% to 1%, 0.01% to 0.5%, or 0.01% to 0.2% copper.

Zirconium, hafnium, and rhenium may improve stress rupture life of the nickel-base alloy according to the present disclosure. Excessive levels of zirconium and hafnium additions can adversely impact workability and weldability.

Certain non-limiting embodiments of a nickel-base alloy according to the present disclosure can comprise, in weight percent based on total weight of the nickel-base alloy, 0 to 1% zirconium such as, for example, greater than 0 to 1%, greater than 0 to 0.5%, 0 to 0.5%, 0 to 0.25%, 0 to 0.2%, 0.1% to 1%, 0.1% to 0.5%, 0.25% to 1.0%, or 0.25% to 0.75% zirconium.

Certain non-limiting embodiments of a nickel-base alloy according to the present disclosure can comprise, in weight percent based on total weight of the nickel-base alloy, 0 to 1% hafnium such as, for example, greater than 0 to 1%, greater than 0 to 0.5%, 0 to 0.5%, 0 to 0.25%, 0.1% to 1%, 0.1% to 0.5%, 0.25% to 1.0%, or 0.25% to 0.75% hafnium.

Certain non-limiting embodiments of a nickel-base alloy according to the present disclosure can comprise, in weight percent based on total weight of the nickel-base alloy, 0 to 2% rhenium such as, for example, greater than 0 to 2%, greater than 0 to 1%, greater than 0 to 0.5%, 0 to 1%, 0 to 0.5%, 0 to 0.25%, 0.1% to 1%, 0.1% to 0.5%, 0.25% to 1.0%, or 0.25% to 0.75% rhenium.

Certain non-limiting embodiments of a nickel-base alloy according to the present disclosure can comprise, in weight percent concentrations based on total weight of the nickel-base alloy, 0 to 0.2% magnesium such as, for example, greater than 0 to 0.2%, greater than 0 to 0.1%, 0 to 0.1%, or greater than 0 to 0.08% magnesium.

Carbon and/or boron additions can enhance stress rupture properties and workability of the nickel-base alloy. Excessive levels of carbon and/or boron can adversely impact workability and weldability.

Certain non-limiting embodiments of a nickel-base alloy according to the present disclosure can comprise, in weight percent based on total weight of the nickel-base alloy, 0 to 0.5% carbon, such as, for example, greater than 0 to 0.5%, greater than 0 to 0.4%, 0 to 0.2%, 0 to 0.1%, 0.01% to 0.5%, 0.01% to 0.2%, 0.01% to 0.1%, 0 to 0.2%, 0.02% to 0.5%, 0.02% to 0.3%, 0.02% to 0.1%, 0.03% to 0.5%, 0.03% to 0.3%, 0.03% to 0.1%, or 0.04% to 0.5% carbon.

Certain non-limiting embodiments of a nickel-base alloy according to the present disclosure can comprise, in weight percent based on total weight of the nickel-base alloy, 0 to 0.1% boron, such as, for example, greater than 0 to 0.1%, greater than 0 to 0.05%, 0 to 0.05%, 0 to 0.01%, 0.001% to 0.1%, 0.001% to 0.05%, or 0.001% to 0.01% boron.

Rare earth elements can enhance the oxidation resistance of a nickel-base alloy. In various non-limiting embodiments, a nickel-base alloy according to the present disclosure can comprise one or more rare earth elements selected from, for example, scandium, yttrium, lanthanum, cerium, praseodymium, neodymium, samarium, europium, gadolinium, terbium, dysprosium, holmium, erbium, and ytterbium. In certain non-limiting embodiments, a nickel-base alloy according to the present disclosure can comprise, in weight percent based on total weight of the nickel-base alloy, a total of 0 to 1% rare earth elements. Certain non-limiting embodiments of a nickel-base alloy according to the present disclosure can comprise, in weight percent based on total weight of the nickel-base alloy, a total of greater than 0 to 1%, greater than 0 to 0.5%, 0 to 0.5%, 0 to 0.25%, 0.1% to 1%, 0.1% to 0.5%, 0.25% to 1.0%, or 0.25% to 0.75% rare earth elements.

The nickel weight percent content of embodiments of nickel-base alloys according to the present disclosure may be at least 40% based on the total weight of the alloy, such as, for example, at least 45%, at least 50%, at least 55%, at least 60%, or at least 61%, based on total weight of the alloy. Certain non-limiting embodiments of a nickel-base alloy according to the present disclosure can comprise, in weight percent based on total weight of the nickel-base alloy, 40% to 82% nickel, such as, for example, 45% to 80%, 50% to 75%, 55% to 75%, 55% to 70%, 60% to 75%, 60% to 70%, or 61% to 68% nickel.

Nickel-base alloys according to the present disclosure may include impurities. Impurities may be present in the alloys as a result of, for example, impurities in the starting materials (e.g., recycled scrap materials) and/or processing of the alloy during production. In various non-limiting embodiments of alloys according to the present disclosure, one or more of the following elements may be present as impurities: sulfur, phosphorus, calcium, oxygen, nitrogen, bismuth, lead, tin, antimony, selenium, arsenic, silver, tellurium, thallium, zinc, ruthenium, platinum, rhodium, palladium, osmium, iridium, gold, fluorine, and chlorine. Impurity elements, if present, typically are present in individual concentrations no greater than about 0.1 weight percent, and the total content of such impurities typically is no greater than 5.0 weight percent. It will be understood that the foregoing list of impurity elements is not necessarily inclusive of all elements that might be present as impurities in an alloy according to the present disclosure.

In various non-limiting embodiments, a nickel-base alloy according to the present disclosure can be aged at a temperature in a range of at 1000° F. (538° C.) to 2000° F. (1093° C.), such as, for example, 1300° F. (704° C.) to 1800° F. (982° C.), for a time period in a range of 0.1 hours to 168 hours, such as, for example 1 hour to 12 hours. The aging may be a single-step heat treatment or a multi-step heat treatment. The parameters of the aging can be selected based on the properties of the nickel-base alloy desired after heat treatment.

Non-limiting examples of possible heat treatments that may be applied to a nickel-base alloy according to the present disclosure include one-step, two-step, and three-step heat treatments. In certain non-limiting embodiments, a one-step heat treatment that may be applied to a nickel-base alloy according to the present disclosure may involve a single subsolvus aging heat treat step, for example, at a temperature of 1200° F. to 1600° F. (649° C. to 871° C.), e.g., at approximately 1400° F. (760° C.) for 1 to 72 hours, e.g., 24 to 48 hours, or about 36 hours. In certain non-limiting embodiments, a two-step heat treatment that may be applied to a nickel-base alloy according to the present disclosure may involve a supersolvus heat treat step (e.g., at about 1700° F. to 1900° F. (927° C. to 1038° C.), e.g., at approximately 1800° F. (982° C.)), followed by a subsolvus heat treat step (e.g., at about 1300° F. to 1500° F. (704° C. to 816° C.), e.g., at approximately 1350° F. (732° C.) or approximately 1400° F. (760° C.)), for 1 to 72 hours. Various embodiments of a two-step heat treatment that may be applied to a nickel-base alloy according to the present disclosure may involve two subsolvus heat treat steps, such as, for example, a step at higher subsolvus temperature (e.g., at 1300° F. to 1500° F. (704° C. to 816° C.)) and a step at lower subsolvus temperature (e.g., at 1100° F. to 1300° F. (593° C. to 704° C.)). In certain non-limiting embodiments, a three-step heat treatment that may be applied to a nickel-base alloy according to the present disclosure may involve a supersolvus heat treat step (e.g., at about 1850° F. to 1900° F. (1010° C. to 1038° C.)) followed by two subsolvus heat treat steps, such as, for example, a step at higher subsolvus temperature (e.g., at 1300° F. to 1500° F. (704° C. to 816° C.)) and a step at lower subsolvus temperature (e.g., at 1100° F. to 1300° F. (593° C. to 704° C.)).

Balancing the chemistry of the nickel-base alloy to achieve a high $Ni_2X$ solvus temperature and a high phase fraction of the $Ni_2X$ phase can reduce the CTE of the nickel-base alloy and increase the temperature range of the alloy. In certain non-limiting embodiments of nickel-base alloys according to the present disclosure, the composition of the alloy is such as to satisfy one or more of the mechanical properties described herein. For example, various embodiments of a nickel-base alloy according to the present disclosure can exhibit a mean coefficient of linear thermal expansion from 70° F. (21° C.) to 1400° F. (760° C.) no greater than 8.5 μin/in-° F., such as, for example, no greater than 8, no greater than 7.9, no greater than 7.8, no greater than 7.6, or no greater than 7.5 μin/in-° F. The mean coefficient of linear thermal expansion can be determined according to ASTM E228-17.

Certain non-limiting embodiments of a nickel base alloy according to the present disclosure can exhibit a yield strength in an aged condition at room temperature of at least 130 ksi (896 MPa), such as, for example at least 135 ksi (931 MPa), at least 140 ksi (965 MPa), or at least 145 ksi (1000 MPa) at room temperature. Tensile properties at room temperature can be determined according to ASTM E8/E8M-16.

Certain non-limiting embodiments of the nickel-base alloy according to the present disclosure can exhibit a yield strength at 1400° F. (760° C.) of at least 60 ksi (414 MPa), such as, for example, at least 65 ksi (448 MPa) or at least 70 ksi (483 MPa). In certain non-limiting embodiments, the nickel-base alloy can exhibit a yield strength at 1500° F. (816° C.) of at least 35 ksi (241 MPa), such as, for example, at least 45 ksi (310 MPa), at least 50 ksi (345 MPa), or at least 55 ksi (379 MPa). Yield strength at 1400° F. (760° C.) and 1500° F. (816° C.) can be measured according to standard ASTM E21-20.

Certain non-limiting embodiments of a nickel base alloy according to the present disclosure can exhibit an average Rockwell hardness using the Rockwell C Scale (HRC) in a range of 25 HRC to 60 HRC, after aging at 1400° F. (760° C.) for about 1024 hours, such as, for example, 35 to 55, 40 to 55, or 40 to 50 HRC. HRC values may be measured according to ASTM E18-02 (2017).

EXAMPLES

The following examples are intended to further describe certain non-limiting embodiments, without restricting the scope of the present disclosure. Persons having ordinary skill in the art will appreciate that variations of the following examples are possible within the scope of the disclosure.

Scanning electron microscopy (SEM) characterization was performed using backscattered electron (BSE) imaging and energy dispersive spectroscopy (EDS). Chemical analysis was performed using X-ray fluorescence spectroscopy (XRF) or EDS. Hardness testing was performed with a Rockwell hardness tester using the Rockwell C scale, unless indicated otherwise.

Twenty-one 1 lb. arc-melted buttons were prepared. The measured chemistries of the twenty-one examples appear in Table 1 below. Example X-B has the nominal chemistry of a conventional alloy.

TABLE 1

Measured chemistries

| | Measured Chemistry (wt %) | | | | | | | Measurement | | |
|---|---|---|---|---|---|---|---|---|---|---|
| Example | Ni | Mo | W | Cr | V | Fe | Nb | Method | $Mo_{eq}/Cr_{eq}$ | $Cr_{eq}$ |
| X-B | 63.12 | 21.79 | 5.93 | 8.04 | 0.01 | 1.03 | 0.01 | XRF | 1.3 | 21.47 |
| AA | 65.08 | 15.90 | 6.04 | 7.91 | 4.09 | 0.79 | 0.01 | XRF | 2.21 | 22.36 |
| AB | 63.70 | 13.68 | 10.05 | 7.88 | 4.02 | 0.79 | 0.01 | XRF | 2.29 | 22.18 |
| AC | 62.53 | 10.99 | 14.08 | 7.69 | 3.81 | 0.76 | 0.01 | XRF | 2.38 | 21.45 |
| AD | 61.1 | 16.5 | 11.2 | 6.5 | 3.9 | 0.8 | — | EDS | 2.40 | 22.52 |
| AE | 61.63 | 13.42 | 14.09 | 6.07 | 3.88 | 0.73 | 0.01 | XRF | 2.54 | 21.21 |
| AF | 65.15 | 14.60 | 6.08 | 7.85 | 5.14 | 0.95 | 0.01 | XRF | 2.43 | 22.68 |
| AG | 64.10 | 12.04 | 10.05 | 7.75 | 4.92 | 0.93 | 0.01 | XRF | 2.50 | 22.08 |
| AH | 63.12 | 9.28 | 14.20 | 7.51 | 4.75 | 0.92 | 0.01 | XRF | 2.61 | 21.34 |
| AI | 63.07 | 14.86 | 10.04 | 6.08 | 4.83 | 0.92 | 0.01 | XRF | 2.63 | 21.84 |
| AJ | 61.0 | 12.3 | 15.0 | 6.1 | 4.6 | 1.0 | — | EDS | 2.71 | 21.58 |
| AK | 65.01 | 14.36 | 6.08 | 7.95 | 4.17 | 0.82 | 1.44 | XRF | 2.42 | 22.45 |
| AL | 63.03 | 11.74 | 10.14 | 7.76 | 3.98 | 0.80 | 1.36 | XRF | 2.50 | 21.75 |
| AM | 61.86 | 9.55 | 13.98 | 7.60 | 4.47 | 0.88 | 1.44 | XRF | 2.72 | 22.02 |
| AN | 62.86 | 14.73 | 9.97 | 6.16 | 3.85 | 0.78 | 1.45 | XRF | 2.62 | 21.63 |
| AO | 61.2 | 11.8 | 14.8 | 6.4 | 3.8 | 0.8 | 1.1 | EDS | 2.67 | 21.40 |
| AP | 64.6 | 13.3 | 6.6 | 8.3 | 4.8 | 0.9 | 1.4 | EDS | 2.51 | 23.00 |
| AQ | 63.90 | 10.75 | 10.06 | 7.76 | 4.94 | 0.95 | 1.42 | XRF | 2.70 | 22.20 |
| AR | 62.6 | 8.1 | 14.3 | 8.2 | 4.7 | 1.1 | 1.1 | EDS | 2.68 | 21.98 |
| AS | 62.5 | 13.5 | 10.6 | 6.6 | 4.5 | 1.1 | 1.3 | EDS | 2.70 | 22.16 |
| AT | 61.9 | 10.7 | 14.2 | 6.6 | 4.5 | 0.9 | 1.2 | EDS | 2.80 | 21.60 |

The examples were plate shaped with a width and length of about 2.75 inches and a thickness of about 0.4 inches. No indications of unmelted material or chemical inhomogeneities were observed in the examples.

The examples were homogenized and then hot rolled. It was observed that decreasing the tungsten concentration increased hot workability of the examples. After hot rolling, the examples were annealed and then air cooled. The examples exhibited a recrystallized grain structure after annealing.

Coupons for testing were sheared from the as-hot rolled and annealed examples. Coupons for hardness testing were aged at 1400° F. (760° C.) for 4 hours, 16 hours, 64 hours, 256 hours, and 1024 hours. Microstructural stability was examined in a SEM using BSE after aging at 64 and/or 1024 hours. Microstructural stability here refers to the extent that the γ-matrix and fine $Ni_2X$ precipitates transformed into coarse intermetallics. High stability means good retention of the γ-matrix and fine $Ni_2X$ precipitates. Low stability means the γ-matrix and fine $Ni_2X$ precipitates have substantially transformed. Hardness was measured in all heat-treated conditions.

The measured hardness and SEM microstructural analysis results from the aged button examples are shown in Tables 2-4.

TABLE 2

Rockwell C hardness and microstructural stability results

| Hours at 1400° F. | Example | | | | | | |
|---|---|---|---|---|---|---|---|
| (760° C.) | X-B | AA | AB | AC | AD | AE | AF |
| 0 (As Annealed) | 12* | 11* | 11* | 12* | 14* | 37.2 | 8* |
| 4 | 26.8 | 10* | 10* | 11.5* | 31.4 | 42.6 | 11* |
| *16 | 27.4 | 11* | 11.5* | 14* | 32 | 44.9 | 11* |
| 64 | 13.5 [1] | 10.5* | 11.5* | 14* | 36 [2] | 46.8 [4] | 11.5* |
| 256 | 27.0 | 21.9 | 23.7 | 30.1 | 42.7 | 48.1 | 22.1 |
| 1024 | 22.4 [1] | 26.6 [1] | 29.8 [1] | 34.9 [2] | 46.7 | 47.6 | 29.2 [1] |

*Measured with Rockwell B scale and converted to Rockwell C Scale
[1] Did not appear microstructurally unstable
[2] Potential microstructural instability
[3] Notable microstructural instability
[4] Extensive microstructural instability

TABLE 3

Rockwell C hardness and microstructural stability results

| Hours at 1400° F. | Example | | | | | | |
|---|---|---|---|---|---|---|---|
| (760° C.) | AG | AH | AI | AJ | AK | AL | AM |
| 0 (As Annealed) | 11.5* | 15.5* | 12.5* | 23.8 | 12* | 12* | 23.5 |
| 4 | 10.5* | 15.5* | 28.3 | 28.1 | 9* | 11* | 31.1 |
| 16 | 12.5* | 16.5* | 32.1 | 32.7 | 11* | 12.5* | 34 |
| 64 | 11* | 17.5* | 35 [1] | 37 [4] | 29.5 [1] | 33.3 [1] | 39.8 [3] |
| 256 | 25.6 | 32.2 | 40.5 | 44.0 | 36.5 | 40.9 | 44.1 |
| 1024 | 32.7 | 37.7 | 45.1 [1] | 45.6 | 41.2 [1] | 43.5 [3] | 43.9 |

*Measured with Rockwell B scale and converted to Rockwell C Scale
[1] Did not appear microstructurally unstable
[2] Potential microstructural instability
[3] Notable microstructural instability
[4] Extensive microstructural instability

TABLE 4

Rockwell C hardness and microstructural stability results

| Hours at 1400° F. | Example | | | | | | |
|---|---|---|---|---|---|---|---|
| (760° C.) | AN | AO | AP | AQ | AR | AS | AT |
| 0 (As Annealed) | 13* | 26.2 | 13* | 13* | 15* | 15.5* | 23.7 |
| 4 | 28.7 | 26.7 | 11.5* | 12* | 27.3 | 29.6 | 33.7 |
| 16 | 31.9 | 38.2 | 15* | 20* | 30.8 | 34.9 | 39.6 |
| 64 | 44.7 [2] | 44.8 [4] | 35.5 [1] | 32.7 [1] | 33.9 [1] | 40.6 [2] | 45.3 [4] |
| 256 | 45.2 | 48.1 | 38.7 | 38.1 | 39.2 | 43.7 | 46.4 |
| 1024 | 47.5 | 48.0 | 41.0 [3] | 40.8 [3] | 42.7 [2] | 46.5 | 47.5 |

*Measured with Rockwell B scale and converted to Rockwell C Scale
[1] Did not appear microstructurally unstable
[2] Potential microstructural instability
[3] Notable microstructural instability
[4] Extensive microstructural instability BSE images of the microstructure of the examples in Table 1 are shown in FIGS. 1-28. Dark particles shown in the BSE images are oxides, surface contamination, or holes. The coarsest bright particles in the images may be primary phases or transformed primary phases from solidification. It was observed that almost all examples had reasonable microstructural stability for short times at 1400° F. (760° C.).

50 lb. ingots were prepared by vacuum induction melting (VIM) followed by vacuum arc remelting (VAR). The measured chemistries of the 50 lb. ingots are shown in Table 5.

TABLE 5

| Measured chemistries | | | | | | | | | | | | | |
|---|---|---|---|---|---|---|---|---|---|---|---|---|---|
| | Element (wt %) | | | | | | | | | | | | |
| Alloy | Ni | Mo | W | Cr | V | Fe | Al | Mn | Si | C | B | $Mo_{eq}/Cr_{eq}$ | $Cr_{eq}$ |
| X-V | Bal. | 22.35 | 6.01 | 8.14 | 0.014 | 1.33 | 0.173 | 0.31 | 0.097 | 0.001 | 0.0062 | 1.31 | 21.90 |
| BA | Bal. | 16.06 | 7.43 | 8.12 | 4.08 | 0.96 | 0.191 | 0.34 | 0.121 | 0.019 | 0.006 | 2.21 | 23.03 |
| BB | Bal. | 15.15 | 7.24 | 8.22 | 4.79 | 0.96 | 0.20 | 0.35 | 0.117 | 0.019 | 0.0061 | 2.34 | 23.30 |
| BC | Bal. | 15.08 | 11.86 | 6.50 | 4.51 | 0.97 | 0.17 | 0.34 | 0.111 | 0.017 | 0.0057 | 2.54 | 22.56 |
| BD | Bal. | 14.67 | 7.38 | 8.09 | 4.04 | 0.96 | 0.185 | 0.34 | 0.103 | 0.020 | 0.0061 | 2.21 | 22.19 |
| CA | Bal. | 15.86 | 10.28 | 6.87 | 4.86 | 1.04 | 0.25 | 0.46 | 0.12 | 0.018 | 0.006 | 2.53 | 22.3 |
| CB | Bal. | 14.96 | 6.74 | 8.38 | 3.98 | 1.01 | 0.24 | 0.33 | 0.117 | 0.012 | 0.0053 | 2.16 | 22.41 |

The processing steps of the alloys in Table 5 are as follows. First, the vacuum arc remelted ingots were homogenized. A mult from the bottom of each ingot was then cut, reheated, upset, water quenched, hot rolled, annealed, and aged. Alloys of the present disclosure exhibited less cracking than conventional alloys. All alloys from Table 5 were aged using a two-step subsolvus aging heat treatment. The first heating step was 48 hours at 1400° F. (760° F.), and the second heating step was 48 hours at 1200° F. (649° C.).

BSE images of the microstructure of select alloys in Table 5 are shown in FIGS. 29-32. Dark particles shown in the BSE images are oxides, surface contamination, or holes. The coarsest bright particles in the images may be primary phases or transformed primary phases from solidification. It was observed that almost all examples had reasonable microstructural stability for short times at 1400° F. (760° C.).

An aging study was performed using the AA, AF, AI, and AK buttons. The aging study results are shown in Table 6 below.

TABLE 6

| Aging study results | | | | | |
|---|---|---|---|---|---|
| Heat Treatment | | Hardness (HRC) | | | |
| Aging Step 1 | Aging Step 2 | AA | AF | AI | AK |
| 1400° F. (760° C.) for 48 hr | none | 13.6 | 17.6 | 36.3 | 34.7 |
| | 1200° F. (649° C.) for 24 hr | 32.3 | 34.8 | 44.8 | 45 |
| | 1200° F. (649° C.) for 48 hr | 33.4 | 33.7 | 44.8 | 44 |
| | none | 33.6 | 34 | 44.1 | 43 |
| | 1200° F. (649° C.) for 72 hr | 36.8 | 36.7 | 46 | 46.9 |
| 1450° F. (788° C.) for 8 hr | none | 36.1 | 38.7 | 45.7 | 46.2 |
| 1450° F. (788° C.) for 24 hr | none | 12.3 | 11.8 | 28.9 | 11.2 |
| 1450° F. (788° C.) for 48 hr | none | 11.8 | 13.3 | 30.7 | 20.3 |
| | 1200° F. (649° C.) for 24 hr | 12.2 | 12.3 | 33 | 32.3 |
| | 1200° F. (649° C.) for 48 hr | 33.4 | 35.3 | 43.8 | 41.7 |
| | 1200° F. (649° C.) for 72 hr | 33.9 | 34.5 | 44 | 43 |
| 1500° F. (816° C.) for 1 hr | none | 37.7 | 35.1 | 44.9 | 42.5 |
| 1500° F. (816° C.) for 2 hr | none | 10.8 | 12 | 12.3 | 12.2 |
| 1500° F. (816° C.) for 4 hr | none | 11.7 | 13.2 | 13.8 | 15 |
| 1500° F. (816° C.) for 8 hr | none | 10 | 11.7 | 15 | 14 |
| 1500° F. (816° C.) for 24 hr | none | 11 | 11.5 | 16.5 | 13 |

TABLE 6-continued

| Aging study results | | | | | |
|---|---|---|---|---|---|
| Heat Treatment | | Hardness (HRC) | | | |
| Aging Step 1 | Aging Step 2 | AA | AF | AI | AK |
| 1500° F. (816° C.) for 48 hr | none | 11.2 | 16.7 | 16 | 18 |
| | 1200° F. (649° C.) for 24 hr | 11.8 | 21.7 | 13.7 | 28.4 |
| | 1200° F. (649° C.) for 48 hr | 33.1 | 34.5 | 38.8 | 37.8 |
| | 1200° F. (649° C.) for 72 hr | 34.4 | 34.7 | 37 | 37.3 |
| | 1300° F. (704° C.) for 24 hr | 34.1 | 37.8 | 38.1 | 39 |
| | 1300° F. (704° C.) for 48 hr | 27.3 | 30.4 | 39.2 | 33.2 |
| | 1300° F. (704° C.) for 72 hr | 31.2 | 33.3 | 41.4 | 39.1 |
| 1600° F. (871° C.) for 1 hr | none | 31.5 | 34.5 | 41.9 | 39.9 |
| 1600° F. (871° C.) for 2 hr | none | 10.2 | 11.2 | 13.3 | 12.7 |
| 1600° F. (871° C.) for 4 hr | none | 10.5 | 10.5 | 14.8 | 10.5 |
| | | 9.8 | 9.3 | 14.2 | 11.4 |

It was observed that the alloys responded well to a variety of aging heat treatments, and that there was a substantial hardening response even at 1500° F. (816° C.) for AF and AK.

The measured chemistries of two heats produced by VIM melting to provide 50 lb. ingots are shown in Table 7. The ingots were homogenized, hot rolled, annealed, cold rolled, annealed, and aged.

TABLE 7

| Measured chemistries | | | | | | | | |
|---|---|---|---|---|---|---|---|---|
| | Element (wt %) | | | | | | | |
| Alloy | Ni | Mo | W | Cr | V | C | $Mo_{eq}/Cr_{eq}$ | $Cr_{eq}$ |
| X-I | Bal. | 22.49 | 5.94 | 8.07 | 0.014 | 0.012 | 1.31 | 21.89 |
| B | Bal. | 22.64 | 5.98 | 3.76 | 4.17 | 0.002 | 2.55 | 22.28 |

The aging response of alloy B of Table 7 is shown in Table 8. The hot rolled and annealed material has a low hardness, indicative of good formability. After aging, the hardness almost doubles, indicating a strong aging response. The tensile yield strength and elongation of the two conditions are shown for cold rolled and annealed sheet in Table 8 as well. The low tensile yield strength and high elongation in the annealed condition further suggest the formability of the alloy. Hardness measurements are the average of three points, and tensile results are the average of two tests.

TABLE 8

| Alloy B aging response | | | | |
|---|---|---|---|---|
| Alloy | Condition | Hardness (HRC) | Yield Strength (ksi) | Elongation (%) |
| B | Annealed | 23.8 | 64.5 | 53.1 |
| | 1200 F./48 h | 42 | 139.7 | 30.7 |

Based on the results from testing the 1 lb. buttons and the 50 lb. ingots of examples AA-AT and X-B, additional alloy heats DA-DZ having the chemistries listed in Table 9 were prepared and evaluated. Although the nickel contents are listed as "Bal." in Table 9 and in tables above, it will be understood that the alloys may include impurity elements and also might include relatively minor concentrations of intentionally added elements that improve or at least do not materially adversely affect one or more important properties of the alloys. All alloy chemistries in Table 9 are measured chemistries.

The alloys listed in Table 9 were homogenized, hot rolled, and direct-aged under various conditions for evaluation of microstructural stability and mechanical properties such as hardness.

TABLE 9

| Measured chemistries | | | | | | | | | | |
|---|---|---|---|---|---|---|---|---|---|---|
| | Element (wt %) | | | | | | | | | |
| Alloy | Ni | Mo | W | Cr | V | Nb | Fe | Other | $Mo_{eq}/Cr_{eq}$ | $Cr_{eq}$ |
| DA | Bal. | 17.79 | 6.01 | 6.65 | 4.80 | — | 0.89 | — | 2.45 | 22.84 |
| DB | Bal. | 13.19 | 6.07 | 7.95 | 3.96 | 2.96 | 0.76 | — | 2.45 | 22.42 |
| DC | Bal. | 15.25 | 5.14 | 8.12 | 4.31 | — | 0.83 | 1.44 Ta | 2.81 | 22.86 |
| DD | Bal. | 14.87 | 5.73 | 7.53 | 4.13 | — | 0.76 | 3.03 Ta | 2.69 | 23.07 |
| DE | Bal. | 14.70 | 6.14 | 7.87 | 4.16 | — | 0.77 | 0.78 Ti | 2.66 | 22.23 |
| DF | Bal. | 13.55 | 6.09 | 7.76 | 3.92 | — | 0.74 | 1.52 Ti | 2.99 | 23.43 |
| DG | Bal. | 15.98 | 6.29 | 7.11 | 4.19 | — | 0.81 | 4.94 Co | 2.21 | 20.78 |
| DH | Bal. | 15.99 | 6.17 | 7.28 | 4.23 | — | 0.78 | 9.87 Co | 2.31 | 21.77 |
| DI | Bal. | 15.99 | 6.18 | 7.99 | 4.04 | — | 0.76 | 0.11 Si | 2.30 | 21.96 |
| DJ | Bal. | 15.48 | 6.24 | 7.29 | 5.11 | — | 0.92 | — | 2.19 | 22.48 |
| DK | Bal. | 15.91 | 6.08 | 7.48 | 6.18 | — | 1.06 | — | 2.47 | 22.61 |
| DL | Bal. | 15.91 | 6.23 | 7.09 | 6.89 | — | 1.19 | — | 2.63 | 24.08 |
| DM | Bal. | 15.89 | 6.10 | 7.83 | 4.16 | — | 4.73 | — | 2.78 | 24.45 |
| DN | Bal. | 16.6 | 3.05 | 8.04 | 4.27 | 1.49 | 0.78 | — | 2.23 | 22.36 |
| DO | Bal. | 16.87 | 3.06 | 7.98 | 4.36 | — | 0.77 | 0.76 Ti | 2.72 | 23.86 |
| DP | Bal. | 18.92 | — | 7.99 | 4.20 | 1.50 | 0.79 | — | 2.19 | 22.39 |
| DQ | Bal. | 18.83 | — | 7.90 | 4.29 | — | 0.79 | 0.77 Ti | 2.64 | 24.16 |
| DR | Bal. | 15.80 | 6.18 | 7.77 | 3.96 | — | 0.76 | 3.85 Co, 0.71 Re | 2.10 | 22.44 |
| DS | Bal. | 15.98 | 6.35 | 7.99 | 3.83 | — | 0.72 | 3.61 Cu | 2.20 | 22.07 |
| DT | Bal. | 15.18 | 7.25 | 6.36 | 5.04 | 1.31 | 0.93 | — | 2.74 | 22.45 |
| DU | Bal. | 15.78 | 6.03 | 6.46 | 5.41 | — | 0.97 | 0.84 Ti | 3.02 | 23.10 |
| DV | Bal. | 14.88 | 10.00 | 6.11 | 4.59 | — | 0.87 | 4.96 Co | 2.58 | 21.63 |
| DW | Bal. | 14.64 | 10.27 | 6.14 | 4.74 | — | 0.91 | 9.79 Co | 2.61 | 21.76 |
| DX | Bal. | 17.31 | 3.09 | 6.33 | 5.13 | 1.47 | 1.00 | — | 2.68 | 22.58 |
| DY | Bal. | 19.47 | — | 6.46 | 5.30 | 1.48 | 0.96 | — | 2.61 | 23.19 |
| DZ | Bal. | 13.58 | 10.19 | 6.08 | 5.63 | — | 1.00 | — | 2.80 | 22.01 |

The aging response of alloys DA-DZ are shown in Table 10. Each chemistry was aged using the following parameters: Charge into furnace at 1400° F. (760° C.) for 48 hours, then furnace cool to 1200° F. (649° C.) and hold for an additional 48 hours. All Hardness measurements in Table 10 are an average of three points and are in Rockwell C.

TABLE 10

| Rockwell C hardness results | |
|---|---|
| Alloy | Hardness (HRC) |
| DA | 43.7 |
| DB | 49.5 |
| DC | 44.1 |
| DD | 50.0 |
| DE | 49.1 |
| DF | 47.6 |
| DG | 45.0 |
| DH | 47.0 |
| DI | 46.5 |
| DJ | 49.7 |
| DK | 48.7 |
| DL | 51.5 |
| DM | 44.8 |
| DN | 53.0 |
| DO | 47.0 |
| DP | 51.1 |
| DQ | 47.9 |
| DR | 45.9 |
| DS | 38.9 |
| DT | 52.0 |
| DU | 51.6 |
| DV | 51.1 |
| DW | 55.0 |
| DX | 55.1 |

TABLE 10-continued

| Rockwell C hardness results | |
|---|---|
| Alloy | Hardness (HRC) |
| DY | 52.4 |
| DZ | 51.3 |

BSE images of the microstructure of alloys DA-DZ are shown in FIGS. 33-58. Dark particles shown in the BSE images are oxides, surface contamination, or holes. The coarsest bright particles in the images may be primary phases or transformed primary phases from solidification. It was observed that almost all examples had reasonable microstructural stability for short times at 1400° F. (760° C.).

An alloy E having the chemistry in Table 11 was prepared by vacuum induction melting followed by vacuum arc remelting (VIM+VAR double melting) as an ingot. Alloy E was evaluated for both mechanical properties and CTE.

TABLE 11

Measured chemistry

| | Element (wt %) | | | | | | |
|---|---|---|---|---|---|---|---|
| Alloy | Ni | Mo | W | Cr | V | Fe | Al |
| E | Bal. | 15.77 | 8.92 | 7.21 | 4.72 | 1.43 | 0.21 |

| Element (wt %) | | | | | | |
|---|---|---|---|---|---|---|
| Mn | Si | C | B | Mg | $Mo_{eq}/Cr_{eq}$ | $Cr_{eq}$ |
| 0.44 | 0.094 | 0.026 | 0.0078 | 0.05 | 2.45 | 23.04 |

Figure 59:
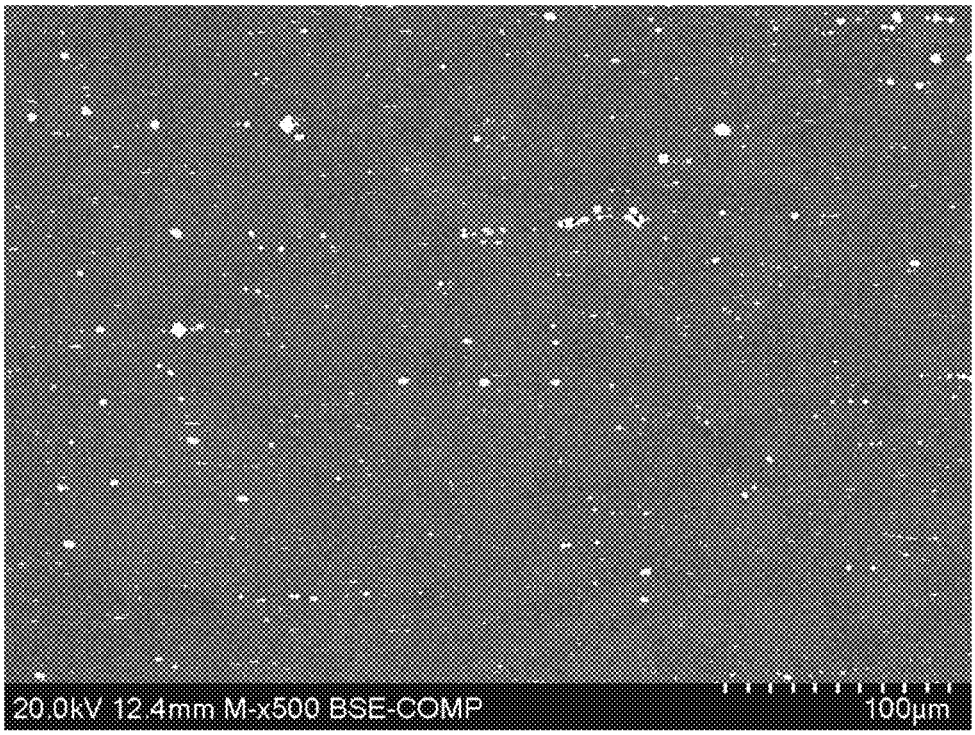
FIG. 59 is a BSE image of example E after being solution annealed at 2100° F. (1150° C.) for 10 minutes.

A BSE image of the microstructure of alloy E is shown in FIG. 59. Dark particles shown in the BSE image are oxides, surface contamination, or holes. The coarsest bright particles in the image may be primary phases or transformed primary phases from solidification.

Tables 12-14 illustrate a comparison of yield strength of several examples described above to reported commercial data for UNS N19909 alloy and HAYNES® 244® alloy. Table 15 illustrates an example of the stress rupture behavior of alloy CA. Table 16 illustrates a comparison of CTE of several examples. Compared to the commercial alloys, alloy example CA exhibits a significant strength increase at 1400° F. (760° C.) and 1500° F. (816° C.). Additionally, the CTE of alloy example CA was observed to be less than the CTE of alloy example X-I at temperatures up to 1400° F. (760° C.). Alloy examples X-I and alloy example B were aged using a 48 hr/1200° F. (649° C.) heat treatment. Alloy examples X-V, BA, BB, BC, BD, CA, CB, DA, and E were heat treated using a 48 hr/1400° F. (760° C.) first aging step followed by a 48 hr/1200° F. (649° C.) second aging step.

TABLE 12

Room temperature (RT) tensile yield strength

| Alloy | Yield Strength (ksi) |
|---|---|
| X-V | 135 |
| B | 138 |
| BA | 143 |
| BB | 142 |
| BC | 194 |
| BD | 127 |
| CA | 198 |
| CB | 145 |
| DA | 154 |
| E | 161 |
| HAYNES ® 244 ® | 130 |
| UNS N19909 | 150 |

TABLE 13

Elevated temperature tensile yield strength at 1400° F. (760° C.)

| Alloy | Yield Strength (ksi) |
|---|---|
| X-V | 76 |
| B | 91 |
| BA | 71 |
| BB | 72 |
| CA | 101 |
| CB | 84 |
| HAYNES ® 244 ® | 78 |
| UNS N19909 | 77 |

TABLE 14

Elevated temperature tensile yield strength at 1500° F. (816° C.)

| Alloy | Yield Strength (ksi) |
|---|---|
| B | 86 |
| BB | 40 |
| CA | 70 |
| CB | 57 |
| HAYNES ® 244 ® | 43 |

TABLE 15

Stress rupture properties at 1400° F. (760° C.) and 1500° F. (816° C.)

| Alloy | Temperature (° F.) | Stress (ksi) | Time (hr) |
|---|---|---|---|
| CA | 1400 | 50 | 37.8 |
| CA | 1500 | 40 | 3.2 |

TABLE 16

Mean CTE of selected alloys from 70° F. (21° C.) to 1400° F. (760° C.)

| Alloy | Mean CTE from RT to 1400° F. (760° C.) (μin/in/° F.) |
|---|---|
| X-V | 7.7 |
| B | 7.1 |
| BA | 7.9 |
| CA | 7.6 |
| E | 7.5 |
| Haynes ® 244 ® | 7.4 |

It will be understood that the scope of the present disclosure is not necessarily limited to alloys comprising the elemental contents listed in the Examples.

The following numbered clauses are directed to various non-limiting embodiments according to the present disclosure:

Clause 1. A nickel-base alloy comprising, in weight percent based on total weight of the nickel-base alloy: 8% to 24% molybdenum; 0 to 12% tungsten; 3.5% to 10% chromium; 2% to 10% vanadium; 0 to 10% iron; and nickel.

Clause 2. The nickel-base alloy of clause 1, comprising 14% to 20% molybdenum, in weight percent based on total weight of the nickel-base alloy.

Clause 3. The nickel-base alloy of any clause 1, comprising 15% to 17% molybdenum, in weight percent based on total weight of the nickel-base alloy.

Clause 4. The nickel-base alloy of any of clauses 1-3, comprising 4% to 11% tungsten, in weight percent based on total weight of the nickel-base alloy.

Clause 5. The nickel-base alloy of any of clauses 1-3, comprising 6% to 11% tungsten, in weight percent based on total weight of the nickel-base alloy.

Clause 6. The nickel-base alloy of any of clauses 1-5, comprising 5% to 8.5% chromium, in weight percent based on total weight of the nickel-base alloy.

Clause 7. The nickel-base alloy of any of clauses 1-5, comprising 6% to 8% chromium, in weight percent based on total weight of the nickel-base alloy.

Clause 8. The nickel-base alloy of any of clauses 1-7, comprising 3% to 7% vanadium, in weight percent based on total weight of the nickel-base alloy.

Clause 9. The nickel-base alloy of any of clauses 1-7, comprising 3.5% to 6% vanadium, in weight percent based on total weight of the nickel-base alloy.

Clause 10. The nickel-base alloy of any of clauses 1-9, comprising 0.3% to 2% niobium, in weight percent based on total weight of the nickel-base alloy.

Clause 11. The nickel-base alloy of any of clauses 1-9, comprising up to 0.3% niobium, in weight percent based on total weight of the nickel-base alloy.

Clause 12. The nickel-base alloy of any of clauses 1-11, comprising 0.5% to 3% iron, in weight percent based on total weight of the nickel-base alloy.

Clause 13. The nickel-base alloy of any of clause 1-12, optionally further comprising, in weight percent based on total weight of the nickel-base alloy, at least one of: up to 4% titanium; up to 15% cobalt; up to 5% tantalum; up to 2% silicon; up to 5% copper; up to 2% rhenium; up to 1% hafnium; up to 1% zirconium; up to 0.2% magnesium; up to 0.1% boron; up to 0.5% carbon; up to 1% total rare earth elements; up to 2% aluminum; and up to 5% manganese.

Clause 14. The nickel-base alloy of clause 1, comprising, in weight percent based on total weight of the nickel-base alloy: 14.5% to 17.5% molybdenum; 7.5% to 11% tungsten; 6% to 8% chromium; 4% to 5% vanadium; 0 to 0.3% niobium; 0 to 3% iron; and nickel.

Clause 15. The nickel-base alloy of clause 1, comprising, in weight percent based on total weight of the nickel-base alloy: 14.5% to 17.5% molybdenum; 7.5% to 11% tungsten; 6% to 8% chromium; 3.5% to 5.5% vanadium; 0 to 0.3% niobium; 0 to 3% iron; and nickel; wherein a mean coefficient of linear thermal expansion from 70° F. (21° C.) to 1400° F. (760° C.) is no greater than 8.5 μin/in-° F.; and wherein a yield strength at 1400° F. (760° C.) is at least 60 ksi (414 MPa).

Clause 16. A nickel-base alloy consisting of, in weight percent based on total weight of the nickel-base alloy: 14.5% to 17% molybdenum; 7% to 11% tungsten; 6% to 8% chromium; 3.5% to 5.5% vanadium; 0 to 0.3% niobium; 0.5% to 3% iron; 0 to 2% titanium; 0 to 0.5% cobalt; 0 to 0.5% tantalum; 0.01% to 0.5% silicon; 0 to 0.5% copper; 0 to 0.5% rhenium; 0 to 0.5% hafnium; 0 to 0.5% zirconium; 0 to 0.2% magnesium; 0 to 0.1% boron; 0 to 0.5% carbon; 0 to 1% rare earth elements; 0.05% to 0.5% aluminum; 0.1% to 0.5% manganese; impurities; and nickel.

Clause 17. The nickel-base alloy of clause 1, comprising, in weight percent based on total weight of the nickel-base alloy: 14.5% to 17.5% molybdenum; 5% to 8% tungsten; 7% to 9% chromium; 3% to 5.5% vanadium; 0 to 2% to niobium; 0 to 1.5% iron; and nickel.

Clause 18. The nickel-base alloy of clause 1, comprising, in weight percent based on total weight of the nickel-base alloy: 13.5% to 16.5% molybdenum; 5% to 8% tungsten; 7% to 9% chromium; 3% to 5.5% vanadium; 0 to 2% to niobium; 0 to 1.5% iron; and nickel; wherein a mean coefficient of linear thermal expansion from 70° F. (21° C.) to 1500° F. (816° C.) is no greater than 8 μin/in-° F.; and wherein a yield strength at 1500° F. (816° C.) is at least 80 ksi (551 MPa).

Clause 19. The nickel-base alloy of clause 1, consisting of, in weight percent based on total weight of the nickel-base alloy: 13.5% to 16.5% molybdenum; 5.5% to 7.5% tungsten; 7% to 8.5% chromium; 3.75% to 5.5% vanadium; 0 to 2% to niobium; 0.5% to 1.5% iron; 0 to 2% titanium; 0 to 12% cobalt; 0 to 2% tantalum; 0.01% to 0.5% silicon; 0 to 0.5% copper; 0 to 0.5% rhenium; 0 to 0.5% hafnium; 0 to 0.5% zirconium; 0 to 0.2% magnesium; 0 to 0.1% boron; 0 to 0.5% carbon; 0 to 1% rare earth elements; 0.05% to 0.5% aluminum; 0.1% to 0.5% manganese; impurities; and nickel.

Clause 20. The nickel-base alloy of any of clauses 1-19, wherein the molybdenum and tungsten content in the nickel-base alloy satisfy the following equations:

$$18 < Cr_{eq} < 33; \text{ and}$$

$$Mo_{eq}/Cr_{eq} > 1.8,$$

wherein:

$$Cr_{eq} = \{[Cr] + 0.54[Mo] + 0.28[W] + 1.02[V] + 0.55[Nb] + 1.09[Ti] + 0.29[Ta]\}$$

$$Mo_{eq} = \{[Mo] + 1.06[W] + 6.61[V] + 4.14[Nb] + 14.07[Ti] + 4.26[Ta]\}$$

Clause 21. The nickel-base alloy of any of clauses 1-20, wherein a weight ratio of chromium to vanadium is in a range of 0.8 to 5.

Clause 22. The nickel-base alloy of any of clauses 1-20, wherein a weight ratio of chromium to vanadium is 1.5 to 2.5.

Clause 23. The nickel-base alloy of any of clauses 1-22, wherein a mean coefficient of linear thermal expansion from 70° F. (21° C.) to 1400° F. (760° C.) is no greater than 9 μin/in-° F.

Clause 24. The nickel-base alloy of any of clauses 1-22, wherein a mean coefficient of linear thermal expansion from 70° F. (21° C.) to 1400° F. (760° C.) is no greater than 8 μin/in-° F.

Clause 25. The nickel-base alloy of any of clauses 1-24, wherein a yield strength at 1400° F. (760° C.) is at least 50 ksi (345 MPa).

Clause 26. The nickel-base alloy of any of clauses 1-24, wherein a yield strength at 1400° F. (760° C.) is at least 60 ksi (414 MPa).

Clause 27. The nickel-base alloy of any of clauses 1-26, wherein a yield strength at 1500° F. (816° C.) is at least 30 ksi (207 MPa).

Clause 28. The nickel-base alloy of any of clauses 1-26, wherein a yield strength at 1500° F. (816° C.) is at least 35 ksi (241 MPa).

Clause 31. The nickel-base alloy of any of clauses 1-30, wherein: a mean coefficient of linear thermal expansion from 70° F. (21° C.) to 1400° F. (760° C.) is no greater than 8.5 μin/in-° F.; a yield strength at 1400° F. (760° C.) is at least 60 ksi (414 MPa); and a yield strength at 1500° F. (816° C.) is at least 35 ksi (241 MPa).

Clause 32. A nickel-base alloy, comprising, in weight percent based on total weight of the nickel-base alloy: 14.5% to 17% molybdenum; 7.5% to 10.5% tungsten; 5% to 8% chromium; 3.5% to 5.5% vanadium; 0 to 0.3% to niobium; 0 to 3% iron; and nickel; and wherein a mean coefficient of linear thermal expansion from 70° F. (21° C.) to 1400° F. (760° C.) is no greater than 8.5 μin/in-° F.

Clause 33. A nickel-base alloy, comprising, in weight percent based on total weight of the nickel-base alloy: 13.5% to 16.5% molybdenum; 5% to 8% tungsten; 7% to 9% chromium; 3% to 5.5% vanadium; 0 to 2% to niobium; 0 to 1.5% iron; and nickel; and wherein a mean coefficient of linear thermal expansion from 70° F. (21° C.) to 1500° F. (816° C.) is no greater than 8 μin/in-° F.

Clause 34. An article of manufacture comprising the nickel-base alloy of any of clauses 1-33.

Clause 35. An article of manufacture comprising, in weight percent based on total weight of the article of manufacture: 8% to 24% molybdenum; 0% to 12% tungsten; 3.5% to 10% chromium; 2% to 10% vanadium; 0 to 10% iron; and nickel.

Clause 36. The article of manufacture of any of clauses 34 and 35, wherein the article of manufacture is selected from the group consisting of a foil, a sheet, a plate, a wire, a billet, a slab, a casting, and a powder.

Clause 37. The article of manufacture of any of clauses 34-36, wherein the article of manufacture is a component of a supersonic or hypersonic vehicle.

Embodiments of alloys according to the present disclosure might be produced in forms including, for example, foil, sheet, plate, wire, billet, slab, castings, powder, and other forms. Embodiments of alloys according to the present disclosure may have properties rendering them useful in certain articles of manufacture including, for example, heat exchangers, gas turbine seals, supersonic or hypersonic vehicles, rockets, and additively manufactured parts. For example, the embodiments of alloys according to the present disclosure may be included a component for a supersonic or hypersonic vehicle and/or rocket, such as, for example, a control surface, a nozzle, a skin, a leading edge, a glide body, or an engine inlet.

Various non-limiting embodiments are described and illustrated in this specification to provide an overall understanding of the disclosed inventions. It is understood that the various non-limiting embodiments described and illustrated in this specification are non-limiting and non-exhaustive. Thus, the invention is not limited by the description of the various non-limiting and non-exhaustive embodiments disclosed in this specification. Rather, the invention sought to be patented is defined solely by the claims. The features and characteristics illustrated and/or described in connection with various non-limiting embodiments may be combined with the features and characteristics of other non-limiting embodiments. Such modifications and variations are intended to be included within the scope of this specification. As such, the claims may be amended or supplemented to recite any features or characteristics expressly or inherently described in, or otherwise expressly or inherently supported by, this specification. Further, applicant reserves the right to amend the claims to affirmatively disclaim features or characteristics that may be present in the prior art. The various non-limiting embodiments disclosed and described in this specification can comprise, consist of, or consist essentially of the features and characteristics as variously described herein.

Any patent, publication, or other disclosure material that is said to be incorporated, in whole or in part, by reference herein is incorporated herein only to the extent that the incorporated material does not conflict with existing definitions, statements, or other disclosure material set forth in this disclosure. As such, and to the extent necessary, the disclosure as set forth herein supersedes any conflicting material incorporated herein by reference. Any material, or portion thereof, that is said to be incorporated by reference herein, but which conflicts with existing definitions, statements, or other disclosure material set forth herein is only incorporated to the extent that no conflict arises between that incorporated material and the existing disclosure material.

In this specification, other than where otherwise indicated, all numerical parameters are to be understood as being prefaced and modified in all instances by the term "about", in which the numerical parameters possess the inherent variability characteristic of the underlying measurement techniques used to determine the numerical value of the parameter. At the very least, and not as an attempt to limit the application of the doctrine of equivalents to the scope of the claims, each numerical parameter described in the present description should at least be construed in light of the number of reported significant digits and by applying ordinary rounding techniques.

Also, any numerical range recited in this specification is intended to include all sub-ranges of the same numerical precision subsumed within the recited range. For example, a range of "1 to 10" is intended to include all sub-ranges between (and including) the recited minimum value of 1 and the recited maximum value of 10, that is, having a minimum value equal to or greater than 1 and a maximum value equal to or less than 10, such as, for example, 2.4 to 7.6. Any maximum numerical limitation recited in this specification is intended to include all lower numerical limitations subsumed therein, and any minimum numerical limitation recited in this specification is intended to include all higher numerical limitations subsumed therein. Accordingly, Applicant reserves the right to amend this specification, including the claims, to expressly recite any sub-range subsumed within the ranges expressly recited herein. All such sub-ranges are intended to be inherently described in this specification such that amending to expressly recite any such sub-ranges would comply with the requirements of 35 U.S.C. §§ 112 and 132(a). Additionally, as used herein when referring to compositional elemental ranges, the term "up to" includes zero unless the particular element is an unavoidable impurity.

The grammatical articles "one", "a", "an", and "the", as used in this specification, are intended to include "at least one" or "one or more", unless otherwise indicated. Thus, the grammatical articles are used in this specification to refer to one or more than one (i.e., to "at least one") of the grammatical objects of the article. By way of example only, "a component" means one or more components and, thus, possibly, more than one component is contemplated and may be employed or used in an implementation of the described embodiments. Further, the use of a singular noun includes the plural, and the use of a plural noun includes the singular, unless the context of the usage requires otherwise.

One skilled in the art will recognize that the herein described alloys and methods, and the discussion accompanying them, are used as examples for the sake of conceptual clarity and that various modifications are contemplated. Consequently, as used herein, the specific examples/embodiments set forth and the accompanying discussion are intended to be representative of their more general classes. In general, use of any specific exemplar is intended to be representative of its class and should not be taken as limiting. While the present disclosure provides descriptions of various specific embodiments for the purpose of illustrating various aspects of the present disclosure and/or its potential applications, it is understood that variations and modifications will occur to those skilled in the art. Accordingly, the invention or inventions described herein should be understood to be at least as broad as they are claimed and not as more narrowly defined by particular examples and illustrative embodiments provided herein.

What is claimed is:

1. A nickel-base alloy consisting of, in weight percent based on total weight of the nickel-base alloy:

13% to 20% molybdenum;
5% to 12% tungsten;
6% to 10% chromium;
2% to 10% vanadium;
0 to 10% iron;
0 to 2% niobium;
0 to 2% titanium;
0 to 10% cobalt;
0 to 3% tantalum;
0.01% to 0.5% silicon;
0 to 2% copper;
0 to 1% rhenium;
0 to 0.5% hafnium;
0 to 0.5% zirconium;
0 to 0.2% magnesium;
0 to 0.1% boron;
0 to 0.5% carbon;
0 to 1% rare earth elements;
0 to 1% aluminum;
0 to 2% manganese;
impurities; and
nickel.

2. The nickel-base alloy of claim 1, wherein a molybdenum content is 13% to 19%, in weight percent based on total weight of the nickel-base alloy.

3. The nickel-base alloy of claim 1, wherein a molybdenum content is 14% to 18%, in weight percent based on total weight of the nickel-base alloy.

4. The nickel-base alloy of claim 1, wherein a tungsten content is 6% to 11%, in weight percent based on total weight of the nickel-base alloy.

5. The nickel-base alloy of claim 1, wherein a chromium content is 6% to 8.5%, in weight percent based on total weight of the nickel-base alloy.

6. The nickel-base alloy of claim 1, wherein a chromium content is 6% to 8%, in weight percent based on total weight of the nickel-base alloy.

7. The nickel-base alloy of claim 1, wherein a vanadium content is 3% to 7%, in weight percent based on total weight of the nickel-base alloy.

8. The nickel-base alloy of claim 1, wherein a vanadium content is 3.5% to 6%, in weight percent based on total weight of the nickel-base alloy.

9. The nickel-base alloy of claim 1, wherein a niobium content is up to 0.3%, in weight percent based on total weight of the nickel-base alloy.

10. The nickel-base alloy of claim 1, wherein an iron content is 0.5% to 3%, in weight percent based on total weight of the nickel-base alloy.

11. The nickel-base alloy of claim 1, consisting of, in weight percent based on total weight of the nickel-base alloy:

14.5% to 17% molybdenum;
7% to 11% tungsten;
6% to 8% chromium;
3.5% to 5.5% vanadium;
0 to 0.3% niobium;
0.5% to 3% iron;
0 to 2% titanium;
0 to 0.5% cobalt;
0 to 0.5% tantalum;
0.01% to 0.5% silicon;
0 to 0.5% copper;
0 to 0.5% rhenium;
0 to 0.5% hafnium;
0 to 0.5% zirconium;
0 to 0.2% magnesium;
0 to 0.1% boron;
0 to 0.5% carbon;
0 to 1% rare earth elements;
0.05% to 0.5% aluminum;
0.1% to 0.5% manganese;
impurities; and
nickel.

12. The nickel-base alloy of claim 1, consisting of, in weight percent based on total weight of the nickel-base alloy:

14.5% to 17.5% molybdenum;
5% to 8% tungsten;
7% to 9% chromium;
3% to 5.5% vanadium;
0 to 2% to niobium;
0 to 1.5% iron;
0 to 2% titanium;
0 to 10% cobalt;
0 to 3% tantalum;
0.01% to 0.5% silicon;
0 to 2% copper;
0 to 1% rhenium;
0 to 0.5% hafnium;
0 to 0.5% zirconium;
0 to 0.2% magnesium;
0 to 0.1% boron;
0 to 0.5% carbon;
0 to 1% rare earth elements;
0 to 1% aluminum;
0 to 2% manganese;
impurities; and
nickel.

13. The nickel-base alloy of claim 1, consisting of, in weight percent based on total weight of the nickel-base alloy:

13.5% to 16.5% molybdenum;
5% to 8% tungsten;
7% to 9% chromium;
3% to 5.5% vanadium;
0 to 2% to niobium;
0 to 1.5% iron;
0 to 2% titanium;
0 to 10% cobalt;
0 to 3% tantalum;
0.01% to 0.5% silicon;
0 to 2% copper;
0 to 1% rhenium;
0 to 0.5% hafnium;
0 to 0.5% zirconium;
0 to 0.2% magnesium;
0 to 0.1% boron;
0 to 0.5% carbon;
0 to 1% rare earth elements;
0 to 1% aluminum;
0 to 2% manganese;
impurities; and
nickel;

wherein a mean coefficient of linear thermal expansion from 70° F. (21° C.) to 1500° F. (816° C.) is no greater than 8 μin/in-° F.; and wherein a yield strength at 1500° F. (816° C.) is at least 60 ksi (414 MPa).

14. The nickel-base alloy of claim 1, consisting of, in weight percent based on total weight of the nickel-base alloy:

13.5% to 16.5% molybdenum;
5.5% to 7.5% tungsten;
7% to 8.5% chromium;
3.75% to 5.5% vanadium;
0 to 2% to niobium;
0.5% to 1.5% iron;
0 to 2% titanium;
0 to 10% cobalt;
0 to 2% tantalum;
0.01% to 0.5% silicon;
0 to 0.5% copper;
0 to 0.5% rhenium;
0 to 0.5% hafnium;
0 to 0.5% zirconium;
0 to 0.2% magnesium;
0 to 0.1% boron;
0 to 0.5% carbon;
0 to 1% rare earth elements;
0.05% to 0.5% aluminum;
0.1% to 0.5% manganese;
impurities; and
nickel.

15. The nickel-base alloy of claim 1, wherein the molybdenum and tungsten content in the nickel-base alloy satisfy the following equations:

$$18 < Cr_{eq} < 33; \text{ and}$$

$$Mo_{eq}/Cr_{eq} > 1.8,$$

wherein:

$$Cr_{eq} = \{[Cr] + 0.54[Mo] + 0.28[W] + 1.02[V] + 0.55[Nb] + 1.09[Ti] + 0.29[Ta]\}$$

$$Mo_{eq} = \{[Mo] + 1.06[W] + 6.61[V] + 4.14[Nb] + 14.07[Ti] + 4.26[Ta]\}.$$

16. The nickel-base alloy of claim 1, wherein a weight ratio of chromium to vanadium is 0.8 to 5.

17. The nickel-base alloy of claim 1, wherein a weight ratio of chromium to vanadium is 1.5 to 2.5.

18. The nickel-base alloy of claim 1, wherein a mean coefficient of linear thermal expansion from 70° F. (21° C.) to 1400° F. (760° C.) is no greater than 9 μin/in-° F.

19. The nickel-base alloy of claim 1, wherein a mean coefficient of linear thermal expansion from 70° F. (21° C.) to 1400° F. (760° C.) is no greater than 8 μin/in-° F.

20. The nickel-base alloy of claim 1, wherein:

a mean coefficient of linear thermal expansion from 70° F. (21° C.) to 1400° F. (760° C.) is no greater than 8 μin/in-° F.;

a yield strength at 1400° F. (760° C.) is at least 60 ksi (414 MPa); and a yield strength at 1500° F. (816° C.) is at least 35 ksi (241 MPa).

21. A nickel-base alloy comprising, in weight percent based on total weight of the nickel-base alloy:

13% to 16% molybdenum;
8.5% to 12% tungsten;
6% to 8% chromium;
4% to 5% vanadium;
0 to 0.3% niobium;
0 to 3% iron; and
nickel.

22. A nickel-base alloy comprising, in weight percent based on total weight of the nickel-base alloy:

14% to 18% molybdenum;
7.5% to 10.5% tungsten;
6% to 8% chromium;
3.5% to 5.5% vanadium;
0 to 0.3% niobium;
0 to 3% iron; and
nickel.

23. A nickel-base alloy comprising, in weight percent based on total weight of the nickel-base alloy:

14% to 20% molybdenum;
7.5% to 12% tungsten;
6% to 10% chromium;
3.5% to 10% vanadium;
0 to 2% niobium;
0 to 10% iron; and
nickel.

* * * * *